US005908375A

United States Patent [19]

Simmons et al.

[11] Patent Number: 5,908,375

[45] Date of Patent: Jun. 1, 1999

[54] MANUAL FEED CUSHIONING MACHINE AND METHOD

[75] Inventors: James A. Simmons, Painesville Township; Richard O. Ratzel, Westlake; David V. Murphy, Concord, all of Ohio

[73] Assignee: Ranpak Corp., Concord Township, Ohio

[21] Appl. No.: 08/486,652

[22] Filed: Jun. 7, 1995

Related U.S. Application Data

[63] Continuation-in-part of application No. 08/386,355, Feb. 8, 1995, which is a continuation-in-part of application No. 08/337,929, Nov. 10, 1994, Pat. No. 5,607,383, which is a continuation-in-part of application No. 08/326,782, Oct. 20, 1994, abandoned, which is a continuation-in-part of application No. 08/279,150, Jul. 22, 1994, Pat. No. 5,593,376.

[51] Int. Cl.[6] ..... B31F 1/00

[52] U.S. Cl. ..... 493/346; 493/350; 493/464

[58] Field of Search ..... 493/346, 349, 493/350, 464, 476

[56] References Cited

U.S. PATENT DOCUMENTS

| | | | |
|---|---|---|---|
| 1,569,569 | 1/1926 | Pels . | |
| 1,958,132 | 5/1934 | Davis . | |
| 2,101,170 | 12/1937 | Engel . | |
| 2,569,589 | 10/1951 | Trissell . | |
| 2,882,802 | 4/1959 | Walker . | |
| 3,065,657 | 11/1962 | Thompson . | |
| 3,069,107 | 12/1962 | Hirt . | |
| 3,238,852 | 3/1966 | Schur et al. . | |
| 3,603,216 | 9/1971 | Johnson . | |
| 3,613,522 | 10/1971 | Johnson . | |
| 3,650,419 | 3/1972 | Upshur et al. . | |
| 3,650,877 | 3/1972 | Johnson . | |
| 3,655,500 | 4/1972 | Johnson . | |
| 3,662,646 | 5/1972 | O'Brien . | |
| 3,695,133 | 10/1972 | Finke . | |
| 3,732,751 | 5/1973 | Berman . | |
| 3,799,039 | 3/1974 | Johnson . | |
| 3,808,933 | 5/1974 | Buan . | |
| 3,910,144 | 10/1975 | Hess . | |
| 3,941,021 | 3/1976 | Meinholdt . | |
| 4,026,198 | 5/1977 | Ottaviano . | |
| 4,085,662 | 4/1978 | Ottaviano . | |
| 4,092,005 | 5/1978 | Benroth . | |
| 4,237,776 | 12/1980 | Ottaviano . | |
| 4,332,127 | 6/1982 | Stajert . | |
| 4,413,698 | 11/1983 | Conrad . | |
| 4,421,406 | 12/1983 | Feinleib . | |
| 4,557,716 | 12/1985 | Ottaviano . | |
| 4,650,456 | 3/1987 | Armington . | |
| 4,699,609 | 10/1987 | Komaransky et al. . | |
| 4,717,613 | 1/1988 | Ottaviano . | |
| 4,750,896 | 6/1988 | Komaransky et al. . | |
| 4,884,999 | 12/1989 | Baldacci . | |
| 4,925,175 | 5/1990 | DuBois . | |
| 4,937,131 | 6/1990 | Baldacci et al. . | |
| 4,968,291 | 11/1990 | Baldacci et al. . | |
| 5,022,639 | 6/1991 | DuBois . | |
| 5,088,370 | 2/1992 | Kondo . | |
| 5,123,889 | 6/1992 | Armington et al. . | |
| 5,131,903 | 7/1992 | Levine et al. . | |
| 5,142,973 | 9/1992 | Tur et al. . | |
| 5,203,761 | 4/1993 | Reichantal | 493/346 |
| 5,297,919 | 3/1994 | Reichantal | 493/349 |
| 5,327,805 | 7/1994 | Reichantal | 83/471.2 |
| 5,674,172 | 10/1997 | Armington | 493/29 |

*Primary Examiner*—James F. Coan

*Attorney, Agent, or Firm*—Renner, Otto, Boisselle & Sklar, P.L.L.

[57] ABSTRACT

A cushioning conversion machine and method for converting stock material into a cushioning product, characterized by a manual feed mechanism or assembly. The machine includes a shaping member over which the stock material is drawn to form the stock material into a three-dimensional shape and the manual feed mechanism draws the stock material over the shaping member. The manual feed mechanism may include a rotatable member for engaging and advancing the stock material, and an operator member mounted for reciprocating movement and operatively connected to the rotatable member.

15 Claims, 65 Drawing Sheets

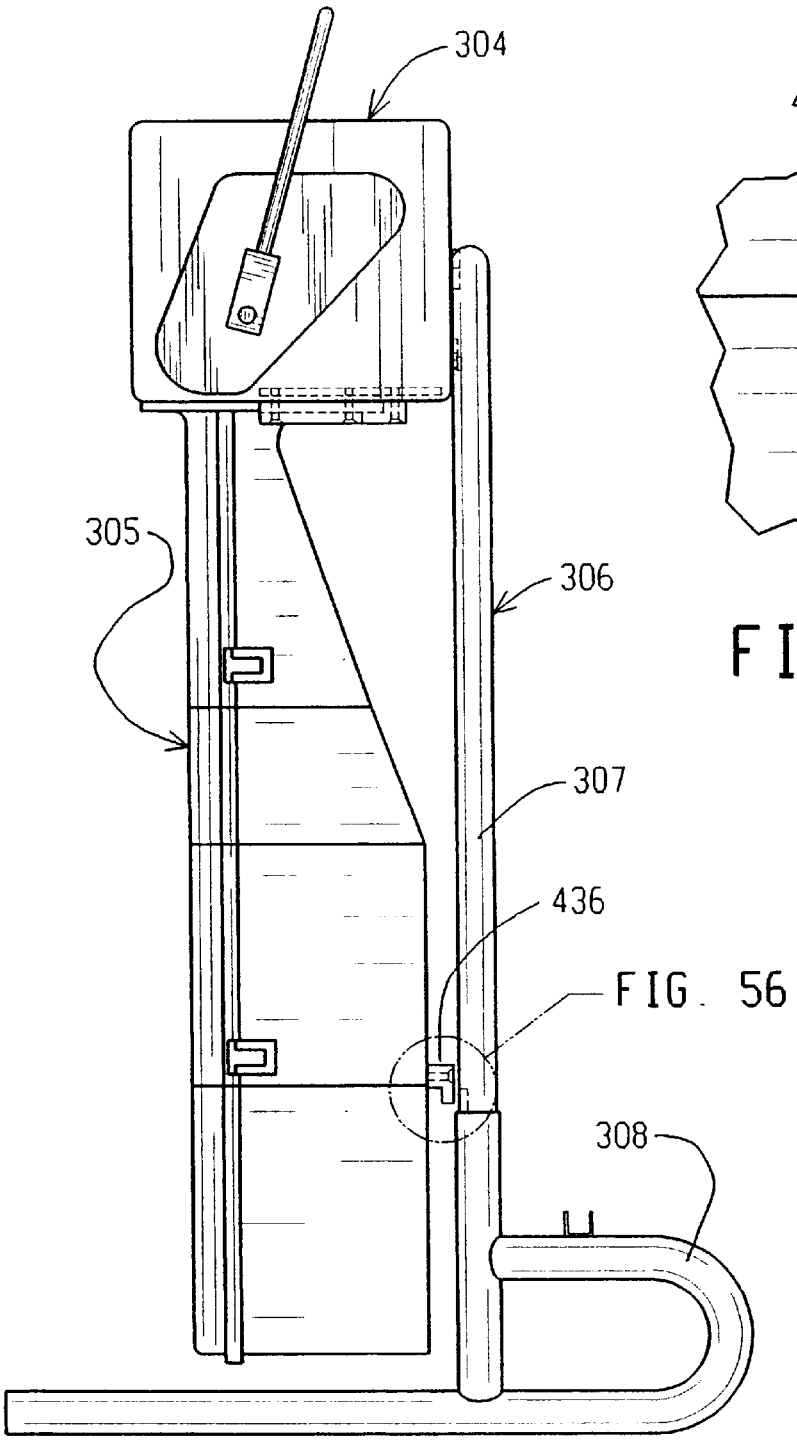
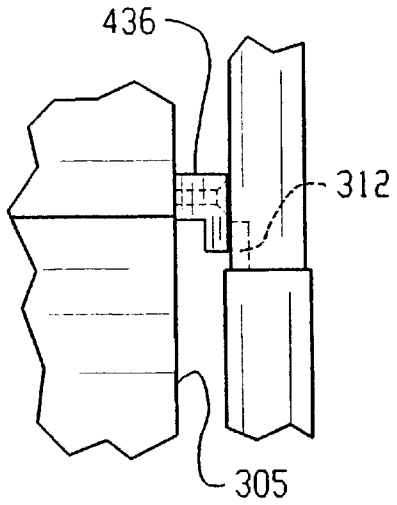
FIG. 56
FIG. 55

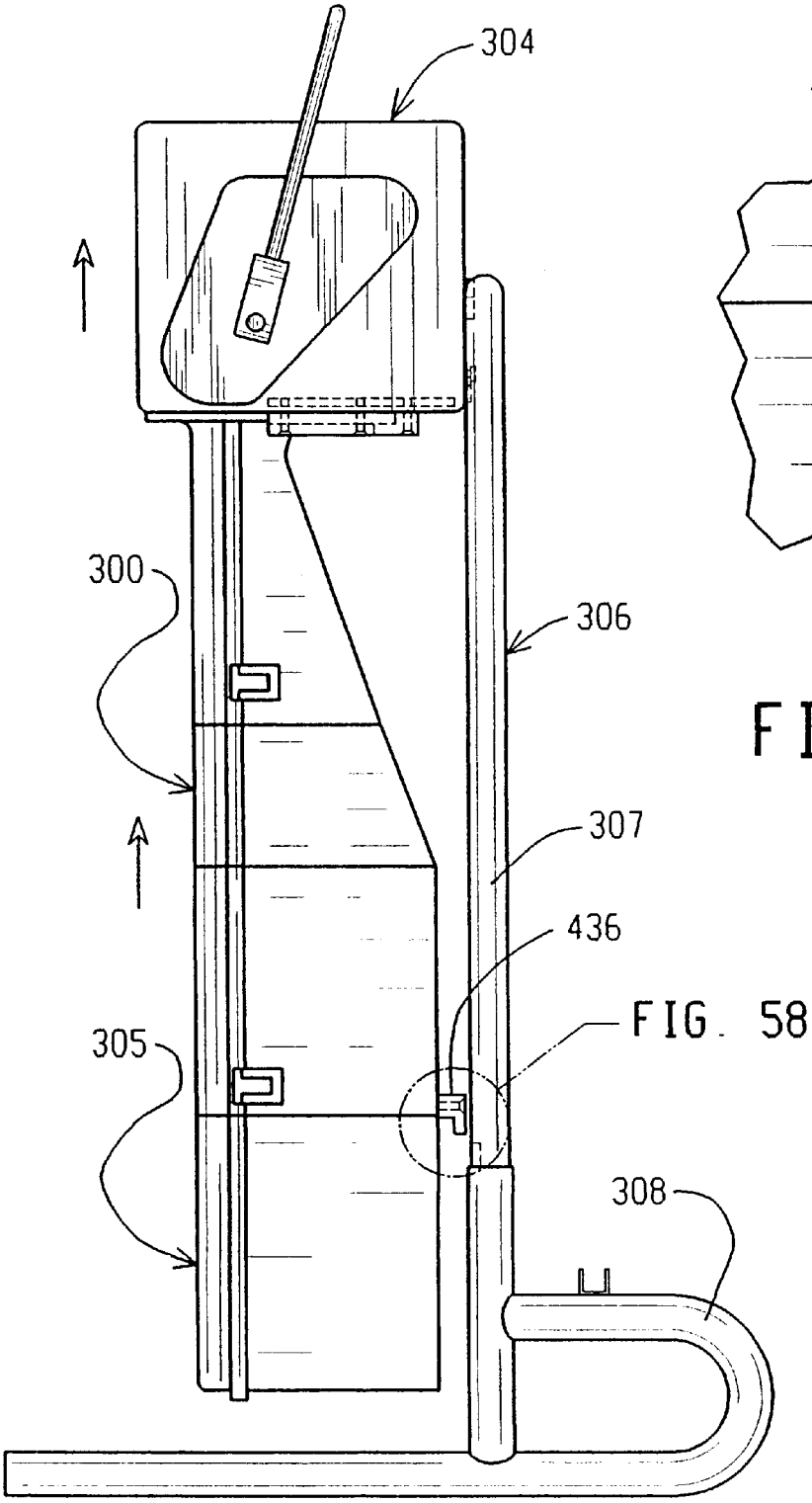
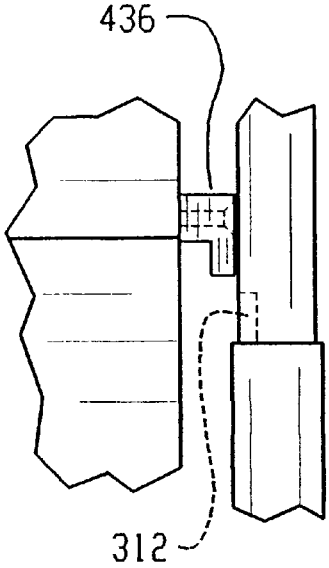
FIG. 58
FIG. 57

MANUAL FEED CUSHIONING MACHINE AND METHOD

RELATED APPLICATION DATA

This application is a continuation-in-part of copending application Ser. No. 08/386,355, filed Feb. 8, 1995, which is a continuation-in-part of co-pending application Ser. No. 08/337,929 filed Nov. 10, 1994, now U.S. Pat. No. 5,607,383, which is a continuation-in-part of Ser. No. 08/326,782 filed Oct. 20, 1994, now abandonded, which is a continuation-in-part of Ser. No. 08/279,150 filed on Jul. 22, 1994, now U.S. Pat. No. 5,593,376. All of the aforesaid applications are hereby incorporated herein by reference.

FIELD OF THE INVENTION

The invention hereindescribed relates generally to a dunnage-creating machine such as a cushioning conversion machine for producing a dunnage product from sheet-like stock material supplied, for example, in roll form and, more particularly, to an improved modular construction of such machine which enables, among other things, the provision of a low cost machine for low volume users.

BACKGROUND AND OF THE INVENTION

In the process of shipping an item from one location to another, a protective packaging material is typically placed in the shipping case, or box, to fill any voids and/or to cushion the item during the shipping process. Some conventional protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

The foregoing and other disadvantages of conventional plastic packaging materials have made paper protective packaging material a very popular alternative. Paper is biodegradable, recyclable and renewable, making it an environmentally responsible choice for conscientious industries. Furthermore, paper protective dunnage material is particularly advantageous for use with particle-sensitive merchandise, as its clean dust-free surface is resistant to static cling.

While paper in sheet form could possibly be used as a protective packaging material, it is usually preferable to convert the sheets of paper into a pad-like or other relatively low density dunnage product. This conversion may be accomplished by a cushioning conversion machine, such as those disclosed in commonly assigned U.S. Pat. Nos. 4,968,291 and 5,123,889. The therein disclosed cushioning conversion machines convert sheet-like stock material, such as paper in multi-ply form, into a pad-like dunnage product having longitudinally extending pillow-like portions that are connected together along a stitched central portion of the product. The stock material preferably consists of three superimposed webs or layers of biodegradable, recyclable and reusable thirty-pound Kraft paper rolled onto a hollow cylindrical tube. A thirty-inch wide roll of this paper, which is approximately 450 feet long, will weigh about 35 pounds and will provide cushioning equal to approximately four fifteen cubic foot bags of plastic foam peanuts while at the same time requiring less than one-thirtieth the storage space.

Specifically, these machines convert the stock material into a continuous unconnected strip having lateral pillow-like portions separated by a thin central band. This strip is connected or coined along the central band to form a coined strip which is cut into sections of a desired length. The cut sections each include lateral pillow-like portions separated by a thin central band and provide an excellent relatively low density pad-like product which may be used in place of conventional plastic protective packaging material.

The several embodiments of machines shown in the aforesaid patents and other commonly assigned patents and applications have achieved considerable commercial success. Nevertheless, environmental and other concerns generally create a continuing need for further improvements in such machines. Also, there appears to be a specific need for similar machines which can be economically used to produce the same pad as such earlier machines in low volume situations, e.g., a machine that is cost competitive with prior art low volume dunnage practices such as loose fill dispensed from an overhead bag or manually crumpled paper from a roll or newsprint. Additionally or alternatively, a specific need exists for more lighter and portable machines, as well as improvements more generally providing for improved performance, lower cost, easier maintenance and repair, etc.

SUMMARY OF THE INVENTION

The present invention provides a novel dunnage-creating machine and related methodology characterized by various features including, inter alia, a modular construction for flexible usage, easier access to interior components, and a low cost cutting assembly including a unitized blade assembly, a manually powered feeding and cutting mechanism, a new form of shaping and forming assembly, and an interlock mechanism. The features of the invention may be individually or collectively used in dunnage-creating machines of various types, although they lend themselves particularly to the provision of relatively lightweight and portable machines which can be economically used to produce the same pad as the above mentioned earlier machines in low volume situations, including in particular a machine that is cost competitive with prior art low volume dunnage practices such as loose fill dispensed from an overhead bag or manually crumpled paper from a roll or newsprint. Various aspects of the invention are hereinafter summarized and more fully described below.

According to one aspect of the invention, a cushioning conversion machine for converting sheet-like material into a relatively low density cushioning dunnage product comprises first and second units having separate housings. The first unit includes in the housing thereof a shaping member over which the sheet-like stock material is drawn to form the stock material into a three-dimensional shape. The second unit includes in the housing thereof a feed mechanism for drawing the stock material over the shaping member of the first unit. The housings of the first and second units respectively have an outlet opening and an inlet opening relatively positionable with respect to one another to provide a pathway for transfer of the sheet-like material from the first unit to the second unit.

In a preferred embodiment, the first and second units may be arranged in plural relative positional relationships, and the housings thereof may be detachably interconnected. The housings of the first and second units may have respective coplanar bottom supports for resting atop a support surface, or in an alternative arrangement one of the first and second units may be supported by wheels for movement towards and away from the other unit. In the latter case, cooperative guide members on the housings of the first and second units may be provided for relatively positioning the first and second units when brought together. In either case, the first and second units may be oriented vertically, horizontally or otherwise. The second unit may include a frame and an outer shell enclosing the frame, the latter including an exit chute for guided and constrained passage of the dunnage product out of the second unit.

As is also preferred, a manually releasable connection is provided between said first and second units, as in the form of a slip fit connection. The slip fit connection holds the units together against separation in a longitudinal direction while permitting separation in a transverse direction. The slip fit connection includes a flange on one of the units and a slot on the other of the units for slidably receiving the flange, and preferably a manually releasable locking device, such as a thumb screw or the like, is provided to lock the units together against separation in said transverse direction.

According to another aspect of the invention, a cushioning conversion machine for converting sheet-like material into a relatively low density cushioning dunnage product comprises a shaping member over which the sheet-like stock material is drawn to form the stock material into a three-dimensional shape, a feed mechanism for drawing the stock material over the shaping member, and an outer shell forming interiorly thereof a converging chute cooperative with the shaping member to roll the edges of the stock material to form lateral pillow-like portions. The shell includes a base portion and a removable cover portion, and preferably, the shaping member is carried by the removable cover.

In a preferred embodiment, adapted for use with stock material having multiple plies, the base portion of the outer shell has laterally spaced apart side walls, and a plurality of separator members are mounted to and extend between the side walls for use in separating the plies of the multi-ply stock material. The cover may be hingedly connected to the base portion for swinging movement between open and closed positions, or the cover may be removably secured to the base portion as by latches or the like. The base portion of the shell preferably has planar bottom supports for resting atop a support surface and as is preferred, the base portion and cover are plastic moldings.

According to a further aspect of the invention, a cushioning conversion machine for converting sheet-like material into a relatively low density cushioning dunnage product comprises a shaping member over which the sheet-like stock material is drawn to form the stock material into a three-dimensional shape, a feed mechanism for drawing the stock material over the shaping member, and a cutting assembly for cutting the cushioning dunnage product into cut sections. The cutting assembly includes a blade assembly and an operator assembly for operating the blade assembly. The blade assembly includes a guide frame and a pair of relatively movable blades mounted on the guide frame for relative movement towards and away from one another, and the guide frame is removably mounted to the machine independently of the operator assembly whereby the blade assembly can be removed without having to remove the operator assembly.

In a preferred embodiment, the operator assembly includes a handle member movable in a first direction to move the blades together and in a second direction to move the blades apart. The operator assembly further includes at least one slotted crank connected to the handle for rotation in opposite directions in response to movement of the handle in the first and second directions, respectively, The blades include at least one moving blade mounted on the guide frame for movement towards and away from the other blade, and a pin is connected to the moving blade and engaged in a slot in the slotted crank for movement of the moving blade in response to rotation of the slotted crank. The slot in the slotted crank is open ended to permit removal of the pin in a direction parallel to the slot when the blade assembly is removed from the machine. The slotted crank is connected to a crank shaft and the handle is connectable to the crank shaft at any one of plural mounting positions.

As is preferred, the handle is movable in said second direction to a feed position at which said blades are relatively moved apart sufficiently to permit passage of the dunnage product therebetween and in said first direction to a cut complete position sufficient to cut the dunnage product to form a cut piece. The feed mechanism includes at least one rotatable member for engaging and advancing the stock material, a drive motor for driving the rotatable member, and a control member operatively connected to the drive motor for controlling energization and de-energization of the drive motor. The control member is functionally related to the handle such that movement of the handle in the second direction to the feed position effects energization of the drive motor and movement of the handle in the first direction effects de-energization of the drive motor.

The invention also provides a blade assembly for use in a cushioning conversion machine to cut a continuous strip of dunnage into separate pieces. The blade assembly comprises a guide frame and a pair of blades mounted for relative movement on the guide frame. The guide frame includes a moving blade carriage and a guide for guiding transverse movement of the moving blade carriage, and the moving blade carriage includes, preferably at each end thereof, a cam pin engageable in a slot of a slotted crank and cooperative therewith to effect movement of the moving blade carriage in response to movement of the slotted crank.

The invention also provides a stitching assembly adapted for use in a cushioning conversion machine which converts sheet-like material into a relatively low density cushioning dunnage product. The stitching assembly comprises a frame, a pair of shafts mounted to the frame with at least one of the shafts being movable transversely towards and away from the other shaft, a pair of rotatable, toothed-wheel gear members carried for rotation of the shafts and adapted to be disposed in meshed condition for coining the sheet-like material as the latter passes between the members, and at least one spring biasing means operative on the one shaft for urging the shaft and the gear member carried thereon towards the other shaft and gear member resiliently to hold the gear members in meshed relationship with the sheet-like material therebetween. The spring biasing means includes a tie member extending transversely with respect to the one shaft and being anchored at one end to a fixed support on the frame, an adjustable stop on the tie member and adjustable along the length thereof towards and away from the one shaft, and a spring member interposed between the one shaft and adjustable stop for resiliently biasing the one shaft towards the other shaft.

In a preferred embodiment, the one shaft has an aperture through which the tie member extends, and the spring member includes a coil spring supported on the tie member. Preferably, a pair of spring biasing means are provided at opposite ends of the one shaft, the frame includes laterally spaced apart side members between which the shafts extend, and the tie members of the pair of spring biasing means are anchored to the frame by laterally spaced apart brackets affixed to the side members, respectively.

According to still another embodiment of the invention, a cushioning conversion machine for converting sheet-like material into a relatively low density cushioning dunnage product comprises a shaping member over which the sheet-like stock material is drawn to form the stock material into a three-dimensional shape, and a feed mechanism for drawing the stock material over the shaping member of the first unit, the feed mechanism including at least one rotatable member for engaging and advancing the stock material, and an operator member mounted for reciprocating movement and operatively connected to the rotatable member to rotate the one rotatable member during movement of the operator member from a first position to a second position and not during return movement of the operator member from the second position to the first position.

In a preferred embodiment, a one-way clutch device connects the rotatable member to the operator member that preferably includes a handle mounted for back and forth swinging movement. Integrated into this arrangement is a cutting assembly for cutting the cushioning dunnage product into cut sections, the cutting assembly including a pair of relatively movable blades. The operator member is movable from the first position away from the second position to a third position to move the blades together and from the third position to the second position to move the blades apart. A first gear is connected to the one rotatable member and a second gear is connected to the operator member, this second gear having a toothed segment for meshing with the first gear during movement of the operator between the first and second positions and an untoothed segment for passing over the teeth of the first gear during movement of the operator member between the first and third positions. A one-way clutch device preferably connects the first gear to the rotatable member.

According to yet another aspect of the invention, a cushioning conversion machine for converting sheet-like material into a relatively low density cushioning dunnage product comprises a shaping member over which the sheet-like stock material is drawn to form the stock material into a three-dimensional shape, a feed mechanism for drawing the stock material over the shaping member, a converging chute cooperative with the shaping member to roll the edges of the stock material to form lateral pillow-like portions, and a forming member having a U-shape with a first leg attached to a top wall of the chute and a second leg extending into the chute generally parallel with a bottom wall of the chute. In a preferred embodiment, the base of the U-shape forming member is curved and merges tangentially with the second leg forwardly of the converging chute. The forming member may also be of uniform width, and an adjustment device may be provided for adjusting the spacing between the second leg and the bottom wall of the converging chute. The adjustment device preferably is connected between the first and second legs. As is also preferred, top and bottom walls of the converging chute are generally planar and the converging chute has outwardly bowed side walls extending between the top and bottom walls. The second leg of the forming member preferably extends to a point adjacent the outlet opening of the converging chute.

According to yet another aspect of the invention, there is provided in combination a cushioning conversion machine for converting sheet-like material into a relatively low density cushioning dunnage product and a stand for holding the machine upright. The stand comprises a vertical support to which the machine is mounted and a base extending in opposite directions from the vertical support for resting atop a horizontal surface. The base includes laterally spaced apart supports for supporting the ends of a holder for a roll of stock material. In a preferred embodiment, the vertical support and base are interconnected by telescoping members, the telescoping members being interengaged with a slip fit whereby the base can be easily separated from the vertical support without disassembly of the machine from the support. Preferably the base is formed by a pair of laterally spaced apart feet each connected to the vertical support by telescoping members, the telescoping members being interengaged with a slip fit whereby the foot can be easily separated from the vertical support, and each foot including a respective one of the laterally spaced apart supports.

According to yet another aspect of the invention, there is provided in combination a cushioning conversion machine for converting sheet-like material into a relatively low density cushioning dunnage product, and a support for holding the machine, the machine and support having cooperating hooks and catches which hold the machine to the support. In a preferred embodiment, the hooks and catches, which may include mating pegs and keyholes, are disengagable upon relative movement of the machine and support in a first direction for removal of the machine from the stand, and a releasable locking device is provided to prevent such relative movement of the machine and support. The releasable locking device preferably is manually releasable without the aid of a tool.

Further in accordance with a preferred embodiment, the support comprises a frame to which the machine is mounted and a base for resting atop a horizontal surface. The base includes laterally spaced apart support members for supporting the ends of a holder for a roll of stock material. The base may be connected to the frame by sliding telescoping members which permit removal of the base from the frame and its replacement by a hanger including laterally spaced apart supports for supporting the ends of a holder for a roll of stock material, whereby the machine can be supported, for example, atop a table in a horizontal orientation, preferably with the frame being equipped with non-skid devices such as suction cups for holding the frame to the table top.

In connection with a preferred embodiment of the machine including the aforesaid feed and shaping units each having separate housings, the hooks and catches include a first hook and catch for holding the first unit to the support and a second hook and catch for holding the second unit to the support. Preferably, the first hook and catch include a transversely extending hanger on the first unit and a transversely extending frame member of the support. As will be seen, the machine may be hung from the support in cantilever-like manner by the cooperating hooks and catches and, more particularly, the first and second units may be hung from the support in cantilever-like manner by the first hook and catch and second hook and catch, respectively.

According to yet another aspect of the invention, a cushioning conversion machine for converting sheet-like material into a relatively low density cushioning dunnage product comprises a former through which the sheet-like stock material is advanced to form the stock material into a three-dimensional shape; a feed mechanism for advancing the stock material through the former; a cutting assembly for cutting the cushioning dunnage product into cut sections, the cutting assembly including at least one blade movable from a first position that permits advancement of the stock material through a cutting zone to a second position for cutting the cushioning dunnage product in the cutting zone; and a stop member movable between an enabling position which permits movement of the blade from the first position to the second position and a disabling position which prevents movement of the blade from the first position to the second position. In a preferred embodiment, the cutting assembly includes an actuator member operatively connected to the one blade such that movement of the actuator member from a third position to a fourth position in a blade actuating direction moves the blade from the first position to the second position, and the stop member is mounted in the machine for movement between an ambush position which permits movement of the actuator member from the third position to the fourth position and an interference position which blocks movement of the actuator member from the third position to the fourth position. As is preferred, the stop member includes a pin mounted in the machine for axial movement between the enabling and disabling positions and the pin is biased toward the enabling position. Plural stop surfaces are spaced apart along the axis of the pin, and the pin has a transaxially extending abutment surface selectively engageable with the stop surfaces for defining plural axially displaced positions of the pin, with at least one of the positions corresponding to the enabling position of the stop member and another of the positions corresponding to the disabling position of the stop member.

In accordance with another aspect of the invention, a cushioning conversion machine for converting sheet-like material into a relatively low density cushioning dunnage product comprises a former through which the sheet-like stock material is advanced to form the stock material into a three-dimensional shape; a feed mechanism for advancing the stock material through the former; a blade assembly for cutting the cushioning dunnage product into cut sections, the blade assembly including at least one movable blade for cutting the cushioning dunnage product; and an operator assembly. The operator assembly includes a pair of cranks operatively engaging opposite ends of the blade assembly such that rotation of the cranks effects movement of the one movable blade, and a handle having opposite ends each operatively connected to a respective one of the cranks for rotating the cranks upon movement of the handle. At least one end of the handle is adjustable relative to the respective crank whereby the operator assembly can be aligned with the blade assembly. In a preferred embodiment, each end of the handle is rotationally adjustable relative to the respective crank. More particularly, the cranks are secured to respective axially aligned pivot shafts for rotation therewith. The handle has at each end thereof a mount for attachment to a hub on a respective pivot shaft, and at least one fastener is used for securing the mount to the hub, the fastener passing through an aperture in one of the mount and hub, and the aperture being circumferentially elongated relative to the axis of the respective pivot shaft to provide for rotational adjustment of the handle relative to the crank.

According to still another aspect of the invention, a cushioning conversion machine for converting sheet-like material into a relatively low density cushioning dunnage product comprises first and second units having separate housings each containing respective assemblies cooperative to convert the sheet-like material into a relatively low density, three dimensional cushioning dunnage product, the housings of the first and second units respectively having an outlet opening and an inlet opening relatively positionable with respect to one another to provide a pathway for transfer of the sheet-like material from the first unit to the second unit, and wherein the first and second units have a slip fit connection between the first and second units, the slip fit connection holding the units together against separation in a longitudinal direction while permitting separation in a transverse direction. In a preferred embodiment, the slip fit connection includes a flange on one of the units and a slot on the other of the units for slidably receiving the flange. Preferably, the other of the units includes a back plate and an outer shell having a back wall forming the slot with the back plate.

According to a still further aspect of the invention, A cushioning conversion machine for converting sheet-like material into a relatively low density cushioning dunnage product is provided with a shell enclosing a shaping assembly through which the sheet-like material is passed for forming into a three-dimensional shape. The shell has a back wall and opposite side walls forming with respective corners of the shell with the back wall. Stock supports are secured to the shell at the corners, the stock supports having lower and upper end portions, the lower portions being laterally spaced apart to support therebetween a supply of the sheet-like material, and the upper portions being generally L-shape with the legs of the L being secured respectively to the back wall and respective side wall. In a preferred embodiment, the lower portion of each stock support includes an upwardly opening slot for receiving the end of a holder for a roll of the sheet-like material.

In accordance with another aspect of the invention, there is provided in combination, a cushioning conversion machine for converting sheet-like material into a relatively low density cushioning dunnage product and a stand for holding the machine upright. The machine and stand have a major transverse plane passing through the center of gravity of the machine and stand, and the stand has a bottom surface for resting atop a horizontal surface and defining therewith a support plane. The stand also includes at least one roller upwardly offset from the support plane and horizontally offset from the transverse plane, and there is provided a pivot for engaging the horizontal surface to form a fulcrum about which the machine and base may be rocked in the direction of the horizontal offset of the one roller. The roller is so positioned to engage the horizontal support surface before the center of gravity of the machine and stand has been rotated 20° beyond a vertical plane intersecting the fulcrum point, whereby upon engagement of the roller with the horizontal surface the machine and stand may be rolled along the horizontal surface. In a preferred embodiment, the roller is so positioned to engage the horizontal support surface before the center of gravity of the machine and stand has been rotated 10° beyond the vertical plane. A bumper may be provided for engaging the horizontal support surface to prevent the machine and stand from being rotated more than a predetermined amount after the roller has engaged the horizontal support surface. Preferably there also is provided a handle proximate the upper end of the machine for facilitating tilting of the machine and subsequent rolling of the machine along the horizontal surface.

According to another aspect of the invention, there is provided a cushioning conversion machine for converting sheet-like material into a relatively low density cushioning dunnage product, comprising a shaping assembly which forms the stock material into a three-dimensional shape, and a feed assembly for feeding the stock material through the shaping assembly, the feed assembly including a motor, an energy storage device for storing power, and a circuit for selectively supplying power from the energy storage device to the motor for energizing the motor. In a preferred embodiment, the motor is an electrical motor and the energy storage device is a battery carried on support structure for the shaping assembly and motor. Preferably, the support structure, such as a stand, includes wheels for rolling of the machine over a floor surface.

The foregoing and other features of the invention are hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

FIGS. 52–60 are sequential elevational views showing the manner in which the conversion machine is attached to the support stand, with FIGS. 56 and 58 being enlarged portions of FIGS. 55 and 57, respectively, and FIGS. 59A and 60 being enlarged portions of FIG. 59, respectively.

DETAILED DESCRIPTION

Figure 1:
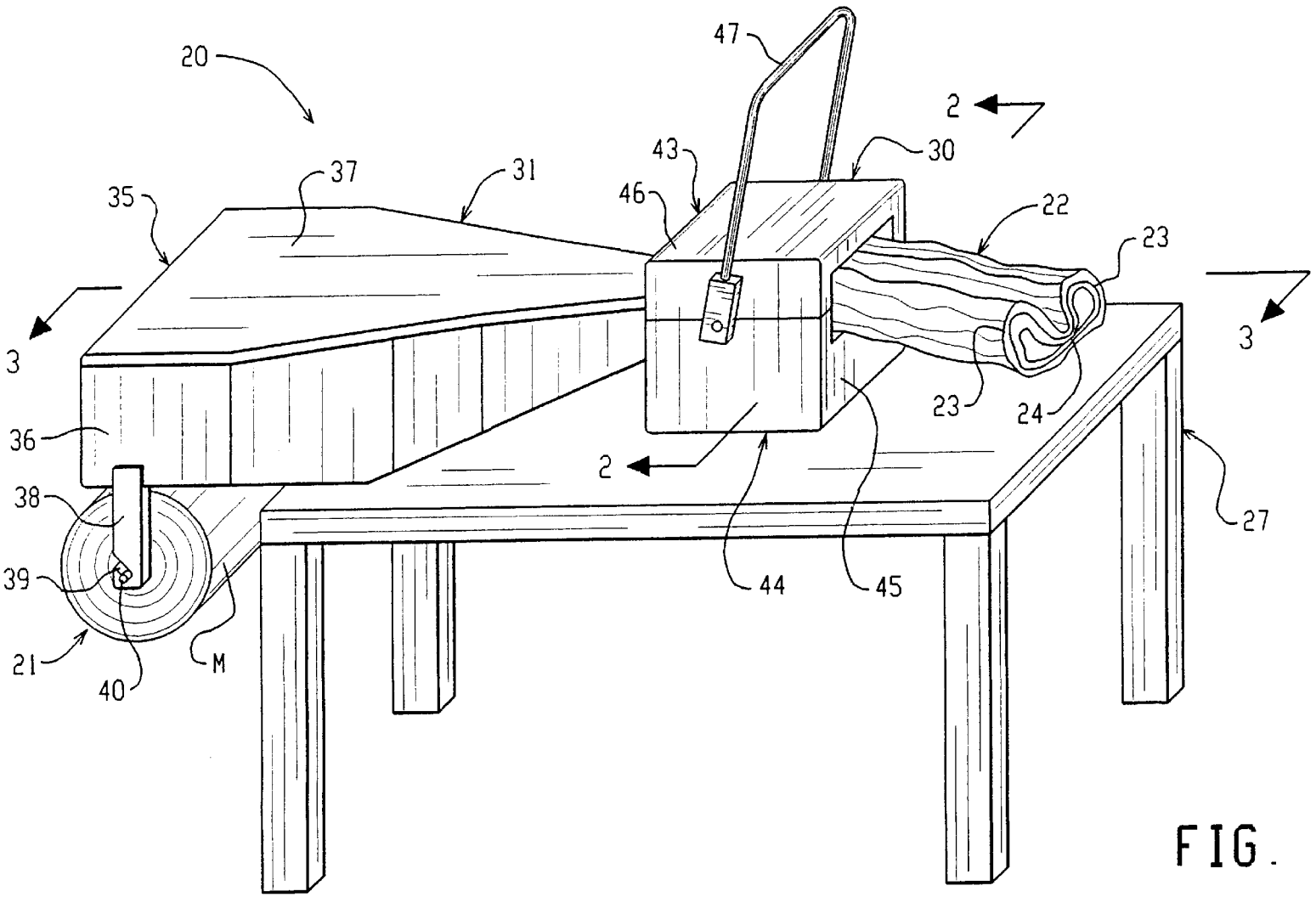
FIG. 1 is a perspective view of a cushioning conversion machine according to the present invention showing front and rear units thereof assembled with respect to one another and supported on a table.

Referring now to the drawings in detail, and initially to FIG. 1, a cushioning conversion machine according to the present invention is generally indicated by reference numeral 20. The machine 20 is shown positioned in a horizontal manner and loaded with a roll 21 of sheet-like stock material M. The stock material M preferably consists of two or three superimposed plies or layers of biodegradable, recyclable and reusable thirty-pound Kraft paper rolled onto a hollow cylindrical tube. The machine 20 converts the stock material into a continuous unconnected strip of relatively low density cushioning dunnage product 22 having lateral pillow-like portions 23 separated by a thin central band 24. This strip 22 is cut into sections, or pads, of a desired length for use as a protective packaging material. As shown, the machine 20 is of compact size and may be supported on a table 27 or other platform for convenient dispensing of cut sections of the dunnage product 22.

The machine 20 is of a modular construction including a front or downstream module, section or unit 30 and a rear or upstream module, section or unit 31. The references to forward and rear are arbitrary, but are used to facilitate a description of the relative relationship of the components of the machine. The rear unit 30 and front unit 31 also are herein referred to as the shaping unit and the feed/cutting unit, respectively, in view of the hereinafter described functions associated therewith. The rear unit 30 and front unit 31 are also herein referred to as the former and head.

The references herein to downstream and upstream are made in relation to the movement direction of the stock material M through the machine. It will also be appreciated that references to top and bottom, upper and lower, etc. are made in relation to an illustrated orientation of the machine to describe positional relationships between components of the machine and not by way of limitation, unless so indicated. The present invention also embodies the various combinations of any one feature of the invention with one or more other features of the invention, even though shown in separate embodiments.

The rear unit 31 has a housing in the form of an outer or external shell 35. The shell 35 has a base 36 and a cover 37 hinged to the base by hinge 33. The cover may be opened and closed to gain access to the interior of the shell which, in FIG. 1, blocks from view interior components of the rear unit. Depending from the base 36 are laterally spaced apart mounts in the form of brackets 38 for supporting the stock roll. The brackets 38 have at their lower ends slots 39 for nested receipt of the ends of a stock roll holder 40 (such as a bar or a holder as described in copending application Ser. No. 08/267,960 filed Jun. 29, 1994) on which the stock roll is centrally supported for rotation so that the stock material may be payed off of the stock roll for passage through the machine.

The front unit 30 has a housing 43 including an outer or external shell 44 and a frame which is hidden from view in FIG. 1 by the shell 44 along with other internal components of the front unit. The external shell has a base 45 and a cover 46 which preferably are molded from a suitable, for example ABS, plastic. Also shown in FIG. 1 is an operator lever or handle member 47 which is used to control operation of the machine, i.e., feeding of stock material through the machine and cutting off sections of the dunnage product.

Figure 2:
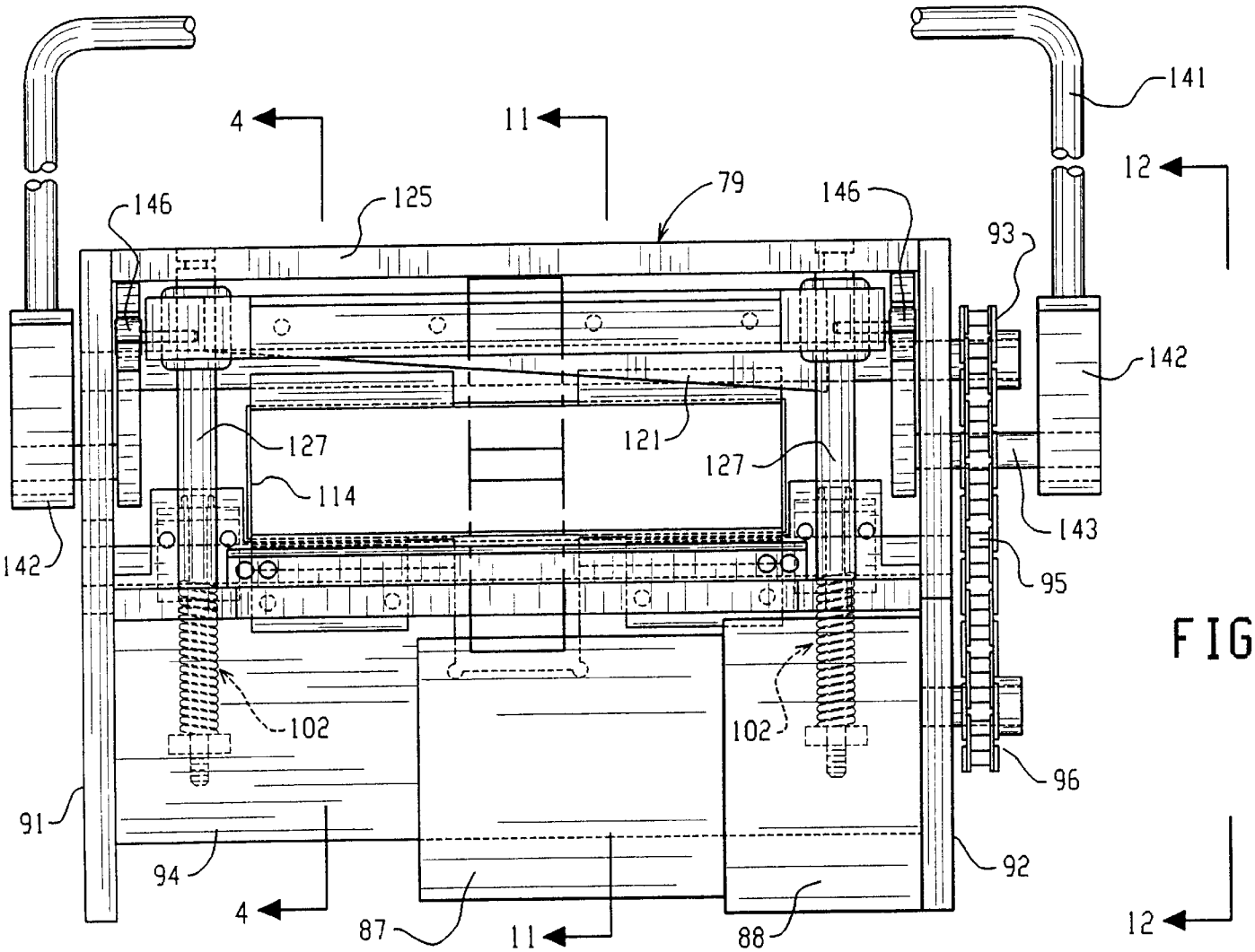
FIG. 2 is an enlarged transverse cross-sectional view through the front unit of the machine, taken along the line 2—2 of FIG. 1 and with an outer shell of the front unit removed.
Figure 3:
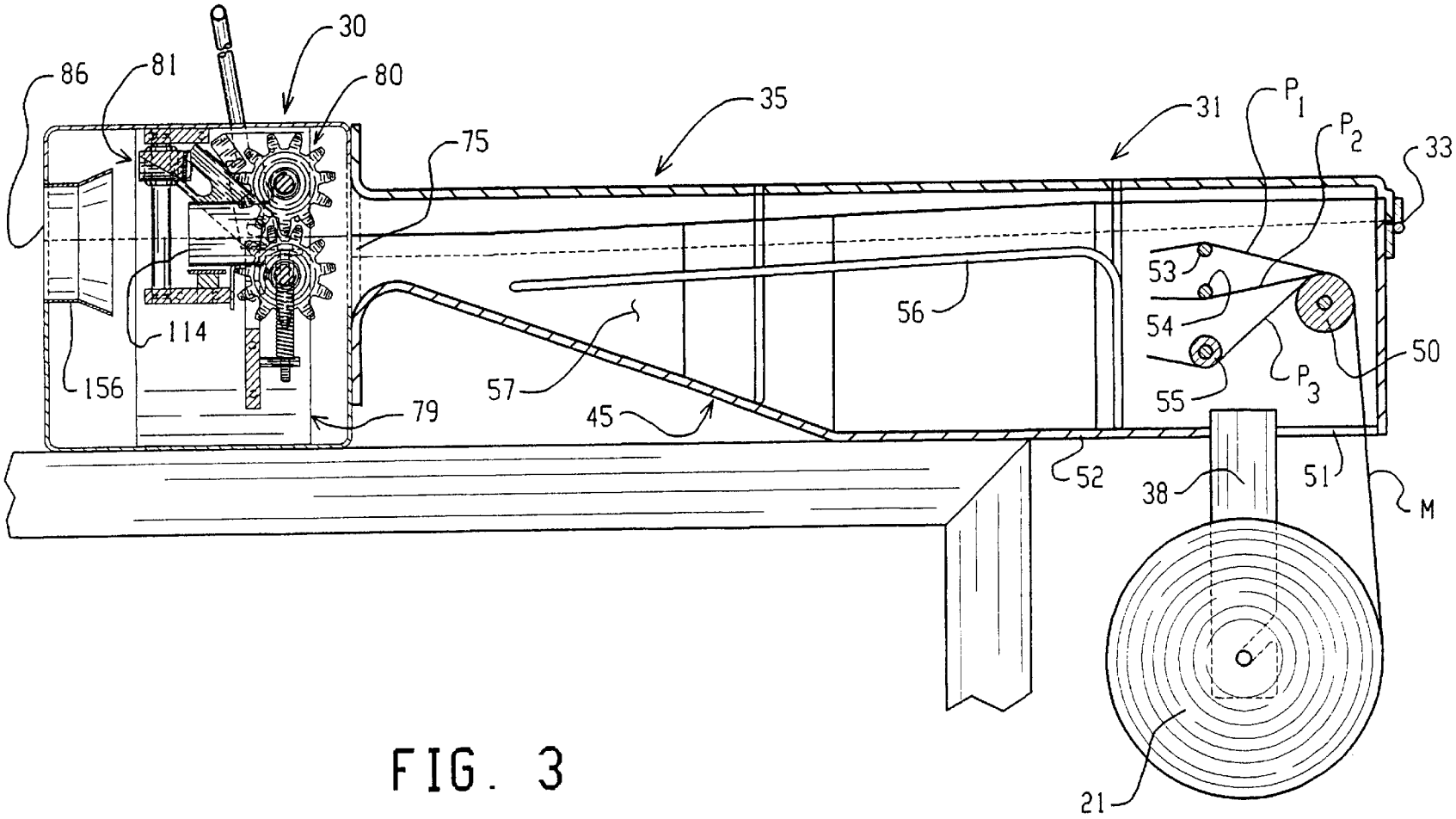
FIG. 3 is an enlarged longitudinal cross-sectional view of the machine taken along the line 3—3 of FIG. 1.

In FIGS. 2 and 3, interior components of the rear and front units 30 and 31 are shown. As will become apparent from the following description, all of the active or mechanized components of the machine are housed in the front unit. As a result of this, the rear unit is relatively light although overall the entire machine is relatively light when compared to present day commercial embodiments of the conversion machines described in U.S. Pat. Nos. 4,968,291 and 5,123,889. More particularly, such commercial machines weigh more than 400 pounds whereas a preferred embodiment of the present invention does not weigh more than 100 pounds and preferably about 80 to 50 pounds and more preferably about 60 pounds. The illustrated preferred embodiment adapted to use a 27 inch wide stock material has an overall length (with stock roll loaded) of about 48 inches as compared to the approximately 60 inches length of the commercial version of the machine shown in U.S. Pat. No. 5,123,889 (the width and height of this machine are about 34 inches and 12 inches, respectively, for a 30 inch wide stock material) or the 67 inches length of the commercial version of the machine shown in U.S. Pat. No. 4,968,291 (the width and height of this machine are about 36 inches and 42 inches, respectively, for a 30 inch wide stock material). Also, the housing of the rear unit has a width of about 28 inches and a height of about 9 inches, whereas the housing of the front unit has a length of about 11 inches, a width of about 15 inches and a height of about 11 inches. Yet, this compact, lightweight and portable machine of the invention is operable to produce approximately the same size pad-like dunnage product of about 7 to 9 inches in width and about 1½ to 3 inches in thickness that is produced by the heavier machines, details of such product and its formation being described in commonly assigned U.S. Pat. No. 4,717,613, which is hereby incorporated herein by reference. Also, the preferred dunnage product has a density of about 0.6 to 0.7 pounds per cubic foot.

As seen at the right in FIG. 3, the rear unit 31 includes an entry guide preferably in the form of an entry roller 50 that provides a non-varying point of entry for the sheet-like stock material M from the stock roll 21. The stock material passes from the stock roll through an inlet opening 51 in the bottom wall 52 of the shell base 45. From the roller 50, the stock material passes over separating members, preferably rollers 53–55, which separate the multiple plies $P_1$–$P_3$ from one another prior to passing over a forming frame 56 and into a converging chute 57. The stock material preferably consists of two or three superimposed webs or layers of biodegradable, recyclable and reusable thirty-pound Kraft paper rolled onto a hollow cylindrical tube and having a preferred width of 27 inches, although other widths including the standard 30 inch width may be used. A 27 inch wide roll of three-ply 30 pound Kraft paper having a length of 450 feet will weigh about 32 pounds and will provide cushioning equal to approximately 3½ fifteen cubic foot bags of plastic foam peanuts.

Figure 13:
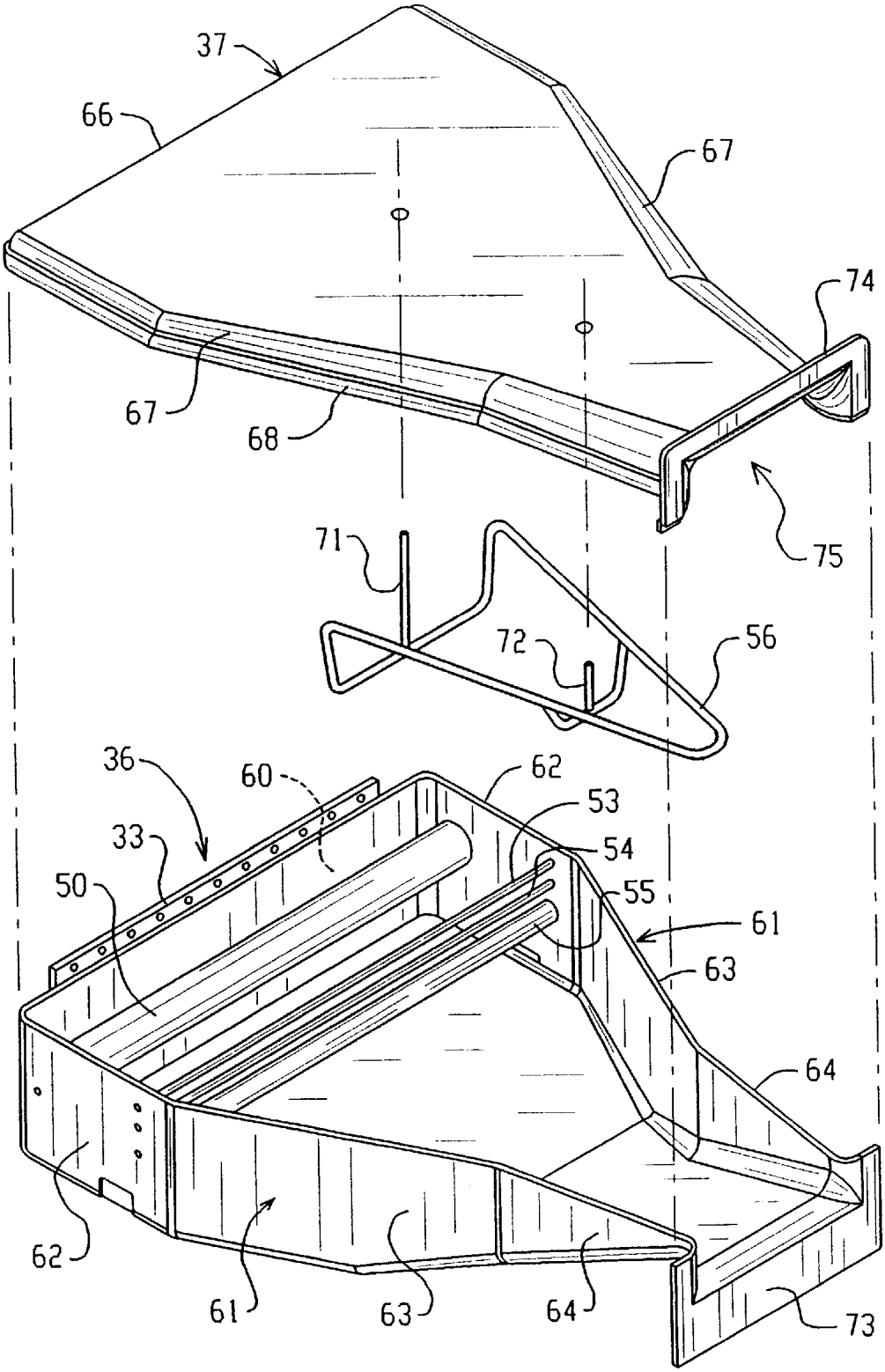
FIG. 13 is an exploded perspective view of the rear unit of the machine.

The forming frame 56 (as a preferred form of shaping member) and the converging chute 57 cooperatively function substantially as described in commonly assigned U.S. Pat. No. 5,123,889. However, in accordance with the present invention, the converging chute preferably is formed by a portion of the external shell 35 where the shell walls converge towards one another. As best illustrated in FIG. 13, the base has a rear wall 60 and laterally spaced apart side walls 61. The side walls have parallel rear portions 62, converging intermediate portions 63 and converging front portions 64, the latter defining an angle less the angle defined by the intermediate portions 59. The cover 37 is correspondingly configured and provided with a rear edge portion 66 and side edge portions 67 that are turned downwardly to engage the top edges of the rear and side walls of the base. As shown, the depending rear and side edge portions of the cover may be offset outwardly at their lower edges to form a peripheral lip 68 that overlaps the upper edge portions of the rear and side walls of the base. It is here noted that while the rear and side walls of the shell are predominately formed by the base as opposed to the cover, more or less of the rear and side walls of the shell may be formed by the base, as may be desired. That is, the parting line between the base and cover may be otherwise located, such as along a mid-plane through the shell, although preferably the parting line is disposed above the mid-plane.

Before leaving FIG. 13, it is noted that the forming frame 56 is secured to and thus carried by the cover 37. This feature of the invention facilitates initial feeding of stock material M through the machine. Conventional practice is to fold triangular portions of the leading end portion of the stock material towards one another to form an arrow shape that is fed under the forming frame prior to passage to a feed mechanism. With the forming frame carried by the cover, it is moved out of the way when the cover is opened. This provides convenient access to the interior of the shell for folding the leading end portion of the stock material to a an arrow shape and advancing the stock material forwardly for engagement by the feed mechanism. As shown, the forming frame has secured to the centers of transverse members thereof upright posts 71 and 72 that are attached at their upper ends to the cover. For further details of the forming frame and its function, reference may be had to commonly assigned U.S. Pat. Nos. 4,717,613 and 4,750,896, which are hereby incorporated herein by reference. Further in accordance with the present invention, the forming frame may be formed integrally with the chute, i.e., as part of a single plastic molding and preferably the cover.

FIG. 13 also shows how the entry roller 50 and separating rollers 53–55 are supported by and extend between the rear portions 62 of the side walls 61 of the base 36 or more generally the shell 31, whereupon the shell further functions as an external frame for the separating rollers. The rollers may be of any suitable type and suitably journalled for rotation. For example, the rollers may include outer roller sleeves which rotate on shafts extending therethrough, with the ends of the shafts secured to the side walls of the shell. The lowermost roller preferably is of greater diameter than the upper two rollers.

It also can be seen in FIG. 13 that the front ends of the base and cover have outwardly extending lips 73 and 74, respectively, that are coplanar and together form a flange that surrounds an exit opening 75 through which the stock material M passes from the rear unit to the front unit.

Figure 11:
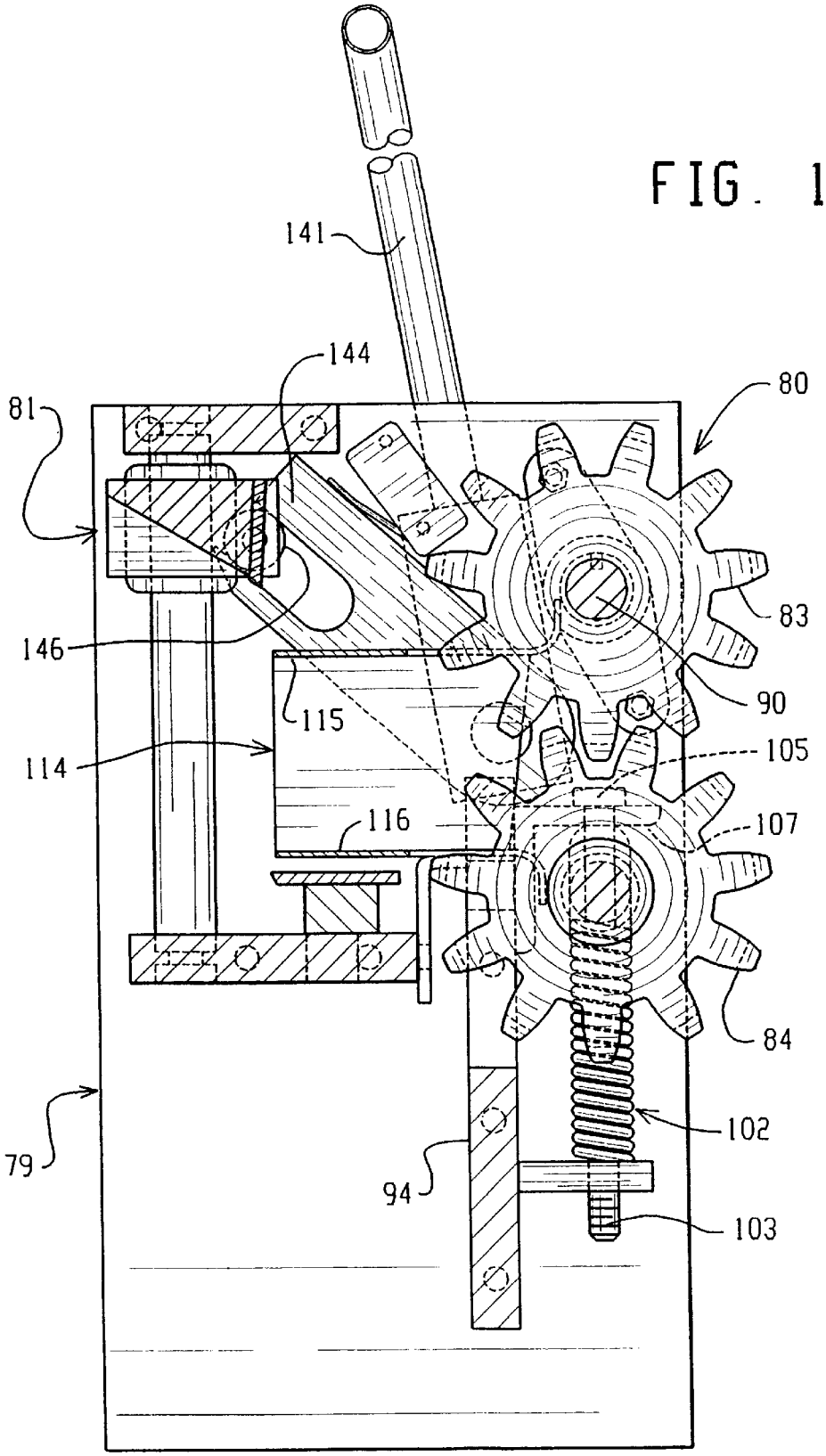
FIG. 11 is a cross-sectional view taken along the line 11—11 of FIG. 2.
Figure 12:
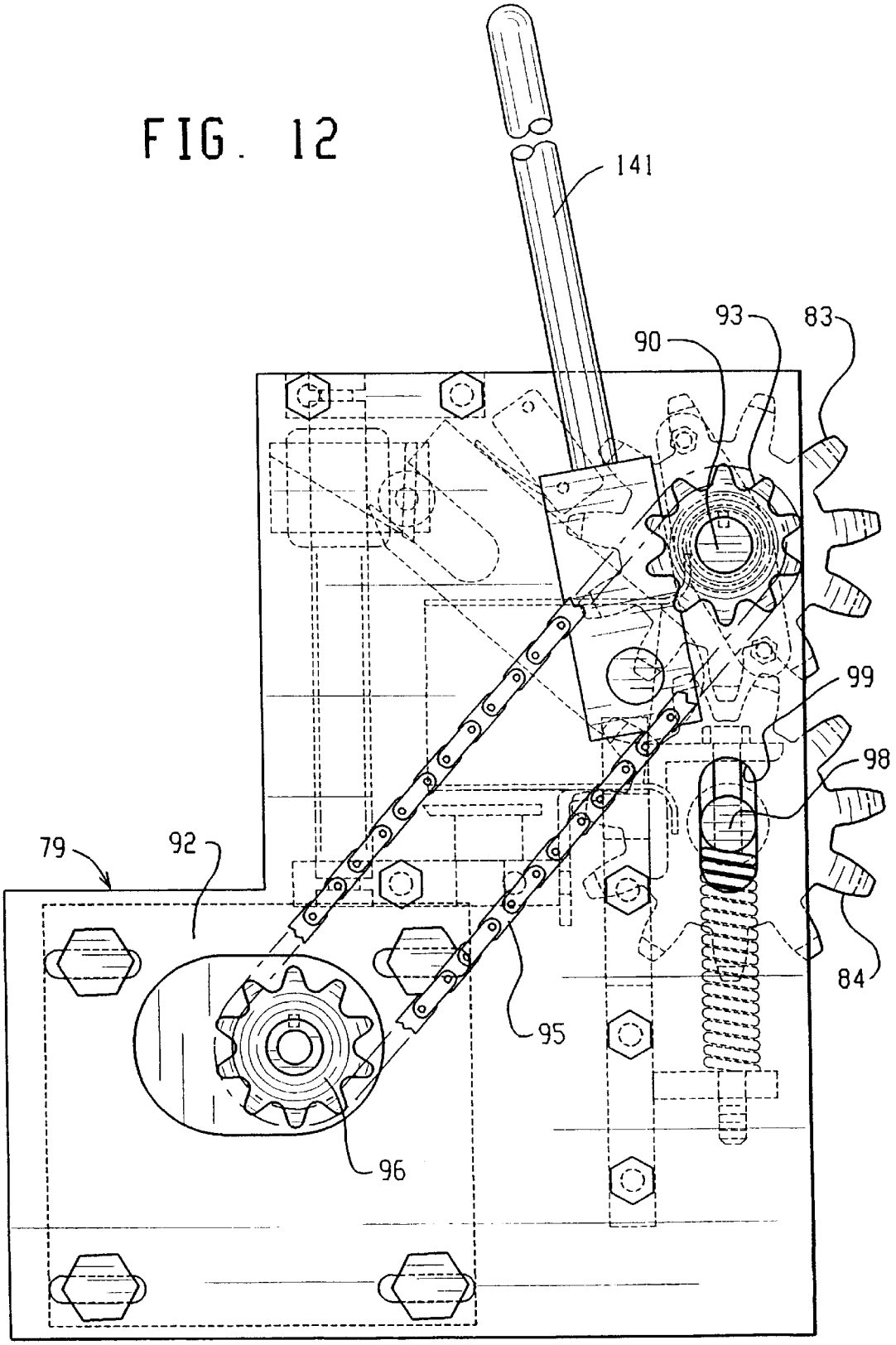
FIG. 12 is a side elevational view taken from the line 12—12 of FIG. 2.

Again referring to FIGS. 2 and 3 and additionally to FIGS. 11 and 12, the front unit 30 includes a frame 79 to which are mounted a feed/stitching mechanism 80 and a cutting mechanism 81. The feed/stitching mechanism 80 comprises rotatable, generally loosely meshed gear-like members 83 and 84 which are adapted to coin the stock material along the central band 24 (FIG. 1) to stitch the stock material together thereby to maintain the three-dimensional shape illustrated in FIG. 1. The rotating gear-like members engage and move the product through the machine, pulling the stock material over the forming frame and discharging the product out through an exit opening 86. An electric motor 87 and speed reducer 88 are utilized to drive the gear-like member 83 which, because of the generally meshed relation between the gear-like members, drives the other gear-like member 84. The gear-like members preferably are of the type described in commonly assigned U.S. Pat. No. 4,968,291, which is hereby incorporated herein by reference, which gear-like members or gears operate to perforate the central band.

The gear-like member 83 is fixed to a drive shaft 90 that is rotatably mounted by bearings 89 secured to respective frame members 91 and 92 of the frame 79, which members are in the form of plates that are joined together in laterally spaced apart relationship by a laterally extending cross frame member or plate 94. A sprocket 93 is secured to an end of the drive shaft laterally outwardly of the relatively adjacent frame member 92. The sprocket 93 is connected by an endless chain 95 (or belt or other suitable means) to a drive sprocket 96 secured to the output shaft of the speed reducer 88 that is driven by the electric motor 87. The speed reducer and electric motor are mounted to and interiorly of the relatively adjacent frame member 92. Although this arrangement is desirable, other suitable means may be employed to rotatably drive the gear-like member 83 and such other means form a part of this description of the invention.

Figure 4:
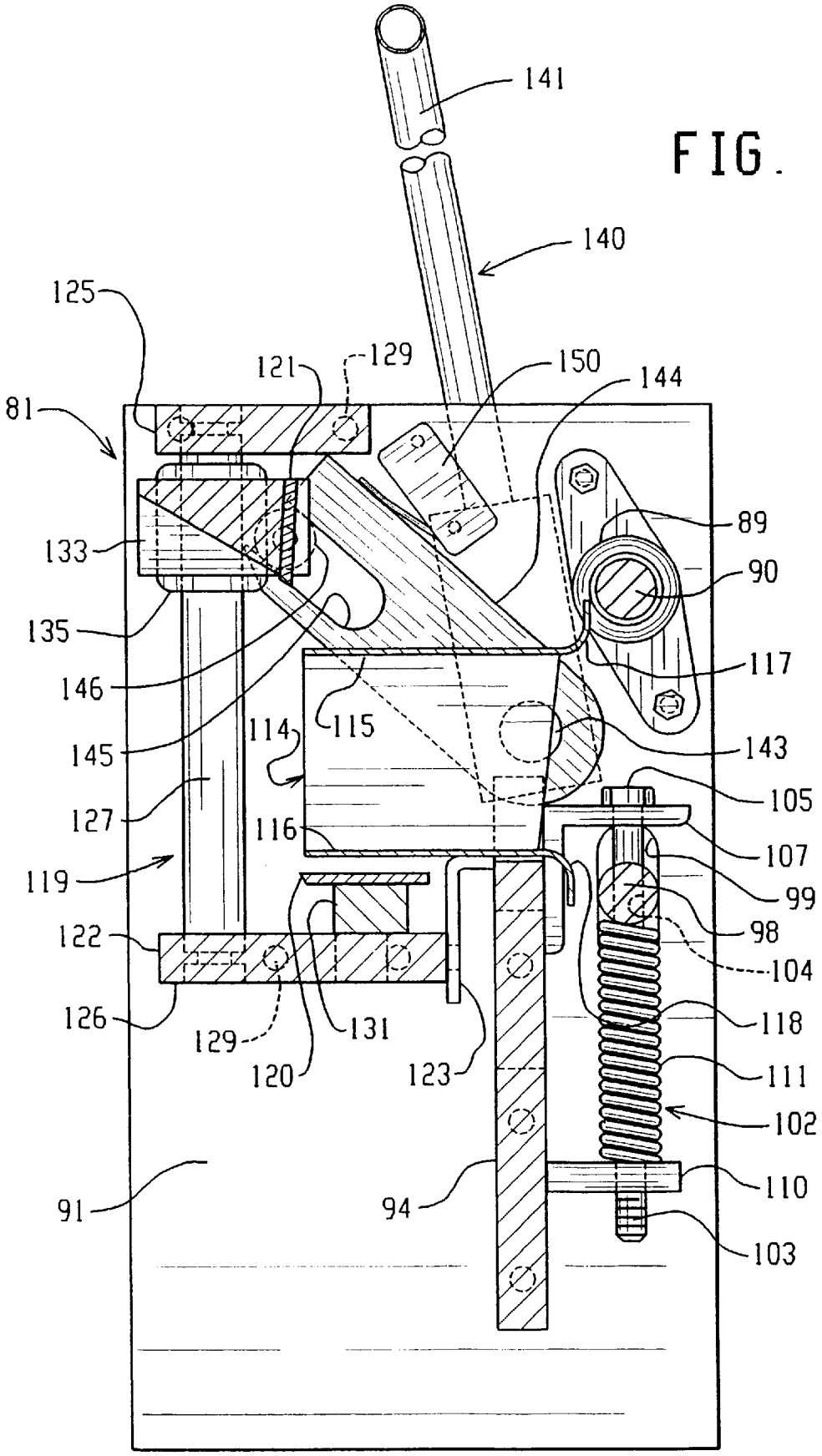
FIG. 4 is an enlarged cross-sectional view taken along the line 4—4 of FIG. 2, showing the position of internal components of the front unit with the operating handle thereof in a feed position.

The gear-like member 84 is supported for rotation on a shaft 98 arranged with the ends thereof guided in slots 99 in the frame members 91 and 92. The ends of the shaft 98 are spring loaded by spring biasing assemblies 102 that are operative to urge the shaft 98 and the gear-like member 84 carried thereon towards the other shaft 90 and gear-like member 83 member resiliently to hold the gear-like members in meshed relationship with the stock material therebetween. As best shown in FIG. 4, each spring biasing assembly 102 includes a tie member in the form of a bolt 103 that extends transversely with respect to the axis of the shaft 98 and, more particularly, diametrically through an aperture 104 in the tie member 103. The tie member has at one end thereof an enlarged head 105 whereby it is anchored to a fixed support 107. The support 107 is mounted to the cross frame member 94. Threaded on the end of the tie member opposite the support 107 is an adjustable stop 110, and supported on the tie member between the support 107 and adjustable stop 110 is a coil spring 111.

Accordingly, the shaft 98 is free to float, i.e., move towards and away from the shaft 90, to accommodate different thicknesses of stock material between the gear-like members while the springs 111 of the biasing assemblies 102 provide squeeze pressure to obtain a desired stitching or coining action. The squeeze pressure may be varied by adjusting the position of the stop 110 along the length of the tie member. This may be easily accomplished by rotating the tie member 103 thereby advancing or retracting the stop 110, it being noted that rotation of the stop is precluded by interference with the cross frame member 94. Also, the head of the tie member may be slotted or otherwise configured to facilitate turning thereof by use of a screwdriver, wrench or other suitable tool. As may be desired, the stop may be adjusted to pre-load the shaft 98.

Figure 7:
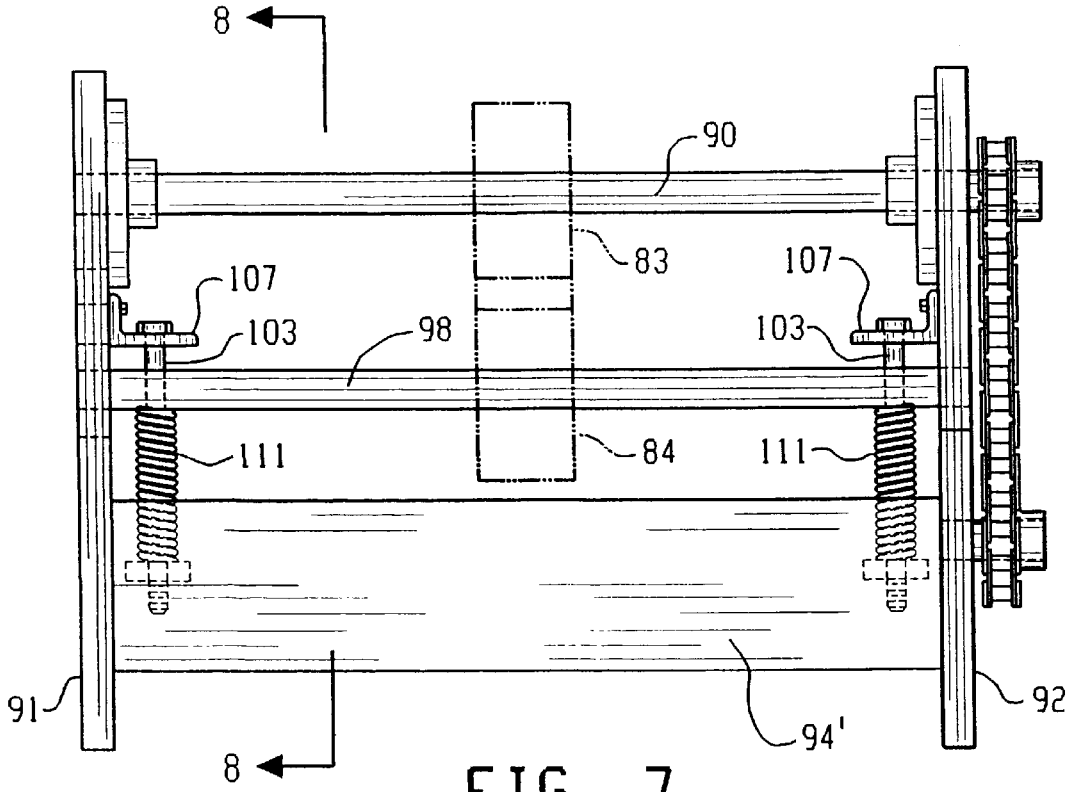
FIG. 7 is a view similar to FIG. 2, but with parts removed to illustrate an alternative mode of attachment for the spring biasing elements of the gear feed/coining assembly.
Figure 8:
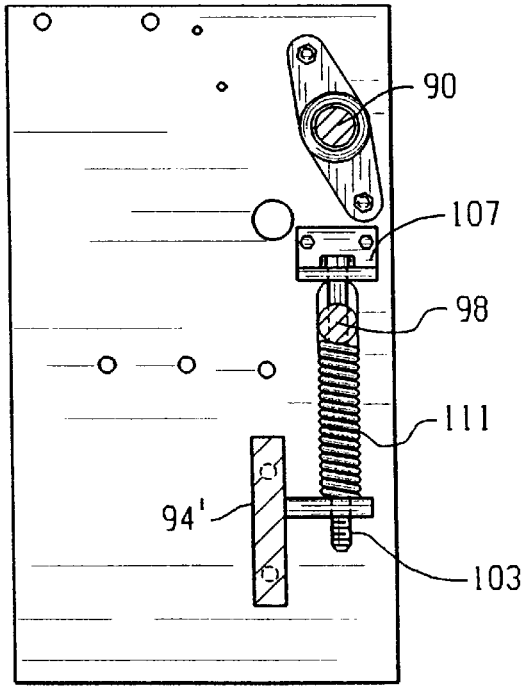
FIG. 8 is a cross-sectional view taken along the line 8—8 of FIG. 7.

As best shown in FIG. 2, the top of the cross frame member 94 has various cut-outs to accommodate other components of the front unit while providing a mount for the supports 107. In an alternative arrangement shown in FIGS. 7 and 8, the cross frame member 94 may be replaced by more simpler rectangular plate 94' and the laterally spaced apart supports 107 (which in the illustrated embodiment are in the form of L-shape brackets or ears) may be mounted to the side frame members 91 and 92. This results in less cost and weight.

The feed/stitching mechanism 80 shown in FIG. 2 performs dual functions in the operation of the machine 20. One function is a "pulling" function in which the stock material is drawn through the nip of the two cooperating and opposed gear-like members. Thus, the feed/stitching mechanism is the mechanism that pulls the stock material from the stock roll 21, through the assembly ply separating rollers, and through the forming assembly comprised of the forming frame and converging chute 57. The forming assembly 52 causes inward rolling of the lateral edges of the sheet-like stock material 22 to form the lateral pillow-like portions of the continuous strip.

The second function performed by the feed/stitching mechanism is a "stitching" or "coining" function whereby the folded over edge portions of the stock material are connected to one another and/or to the unfolded central region of the stock material. Specifically, the strip is connected by the two opposing gears coining (and preferably also perforating) its central band passing therethrough to form the coined strip 22 (FIG. 1). As the coined strip 22 travels downstream from the meshing gears, the strip is guided through and laterally constrained by a tubular guide or guide chute 114. As shown in FIGS. 2–4 the guide chute is rectangular in cross section and the top and bottom walls 115 and 116 thereof have outwardly flared edge portions 117 and 118 at the entry end of the chute. The chute forms a part of the cutting mechanism 81 that cuts the strip into sections.

Figure 5:
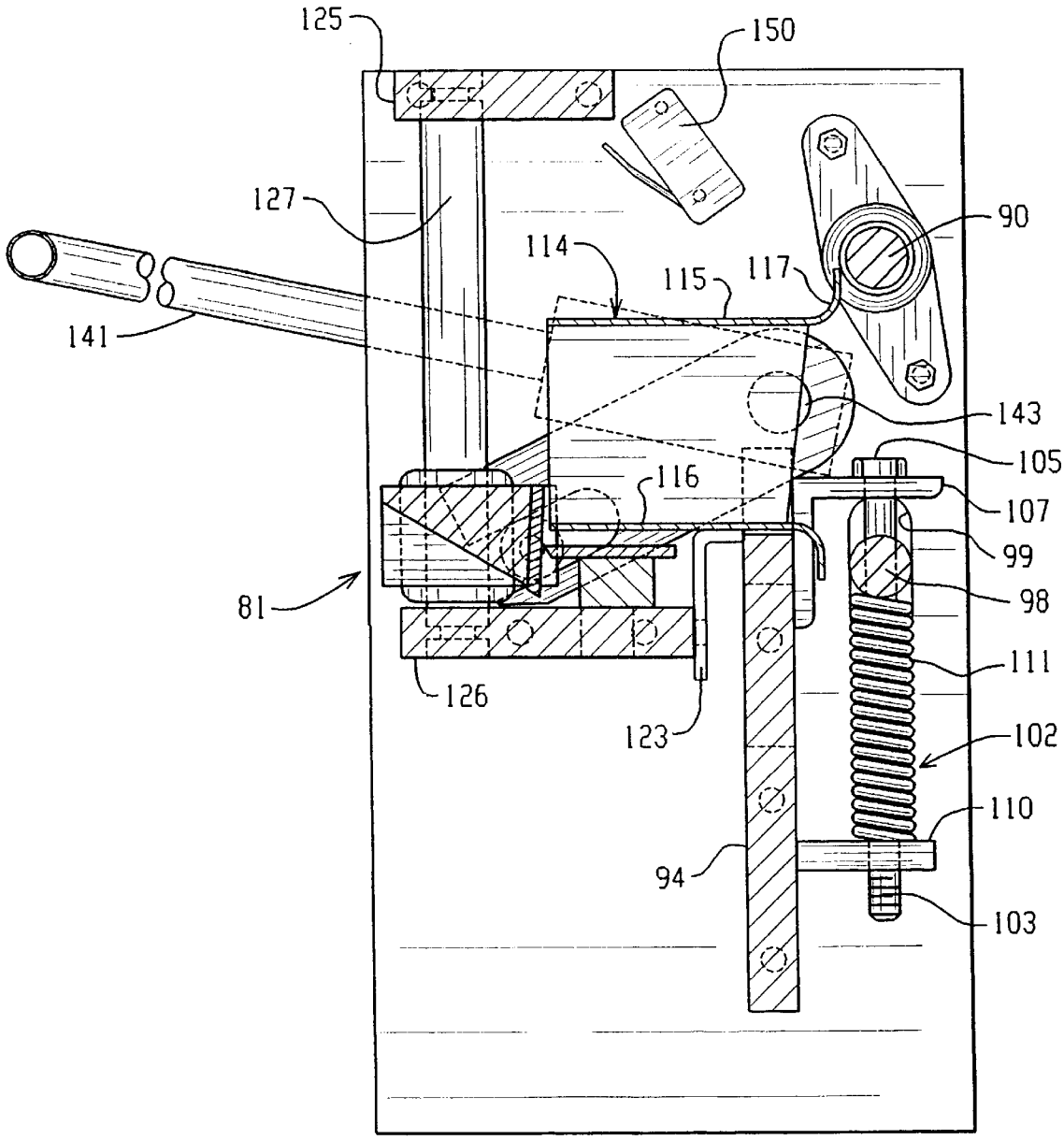
FIG. 5 is a cross-sectional view similar to FIG. 4, showing the position of the internal components with the operating handle in a cutting position.

Referring now to FIGS. 2, 4 and 5 the cutting mechanism 81 includes a blade assembly 119 including a pair of relatively movable blades 120 and 121 that are mounted on a guide frame 122 to which the guide chute 114 preferably is attached by a bracket 123. The guide frame 122 includes an upper and lower frame members 125 and 126 that are interconnected by a pair of laterally spaced apart guide rods or posts 127 which extend between the upper and lower frame members. The upper and lower frame members are adapted to be secured at the ends thereof to the side frame members 91 and 92 by suitable means such as removable bolts received in threaded holes 129 in the ends of the upper and lower frame members. When thus assembled to the side frame members, the upper and lower frame members serve to strengthen or reinforce the main frame 79 of the front unit 30, while being easily removable therefrom for the reasons discussed below.

In the illustrated preferred embodiment, the blade 120 is a stationary blade fixed to the bottom frame member 122 atop a spacer 131. The other blade 121 is a moving blade mounted to a carriage 133 which may be of the illustrated split wedge type for permitting fine adjustment of the moving blade relative to the stationary blade. The blade carriage 133 has at opposite ends thereof guide bushings 135 which slide on the guide posts 127 for movement perpendicular to the axis of the guide chute 114. Accordingly, the blades when brought together coact in a guillotine fashion to cut the coined strip 22 (FIG. 1) into the cut sections.

The stationary blade 120 is mounted at the lower side of the guide chute 114 whereas the moving blade 121 is movable between a feed position shown in FIG. 4 and a cutting position shown in FIG. 5. In the feed position the moving blade is located above and clear of the exit opening of the guide chute 114. From the feed position, the moving blade travels downwardly to the cutting position, traversing the exit opening of the guide chute and coacting with the stationary blade to cut the coined strip located between the blades. Preferably the stationary blade is positioned close to the bottom side of the exit opening of the guide chute 114 and thus extends mostly beneath the chute except for its cutting edge which projects slightly beyond the bottom edge of the chute.

The moving blade 121 is operated by an operator assembly 140. The operator assembly includes a U-shape handle member 141 that has mounting blocks 142 at the ends of the legs thereof secured to the outer ends of respective crank shafts 143. The crank shafts pass through and are rotatably supported by side frame members 91 and 92, respectively. The inner end of each crank shaft has secured thereto a slotted crank 144, herein also referred to as a lift lever. As discussed further below, the handle may be connected to the crank shafts in any one of plural angular relationships to the crank shafts.

Each slotted crank 144 has a slot 145 extending radially with respect to the rotation axis of the crank shaft. The slot 145 is adapted to receive therein a cam pin 146 provided at the corresponding end of the moving blade carriage 133 as shown in FIGS. 2, 3 and 4. In well known manner, the slotted crank cooperates with the cam pin to transfer rotary motion of the crank to linear motion of the blade carriage. Movement of the handle member 141 between its positions shown in FIGS. 4 and 5 will effect corresponding movement of the moving blade between its feed and cutting positions.

It is noted that the crank shafts reside in a plane that is perpendicular to the cutting plane of the blades and which intersects the cutting plane intermediate the stroke of the moving blade. More particularly, the plane of the crank shafts is located in the middle of the guide chute. Consequently, during the end portion (preferably approximately the last half) of the cutting stroke of the moving blade, the trailing side of the slots in the cranks will not only exert a downward force on the cam pins (and thus the moving blade) in FIGS. 4 and 5, but also a horizontal force that urges the moving blade against the stationary blade to ensure a clean cut. Preferably, the moving blade has passed overcenter by the time the dunnage product has been compressed between the blades to start a cut so that during cutting the moving blade will be held tightly against the stationary blade as it passes thereby. Moreover, this holding force will progressively increase as the moving blade completes it cutting stroke since the angle between the movement plane of the moving blade and the trailing side of the crank slots progressively increases during the end portion of the cutting stroke.

Figure 6:
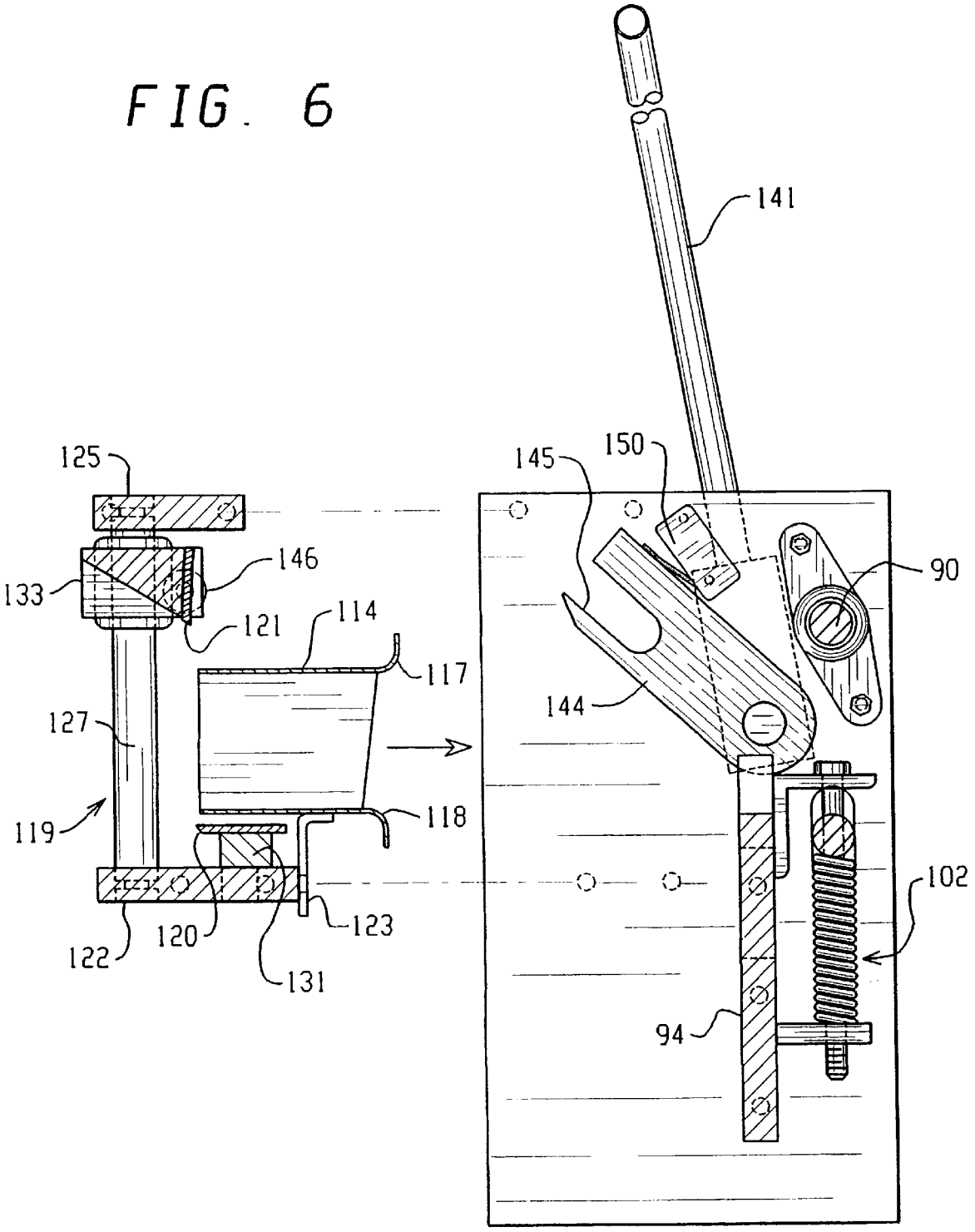
FIG. 6 is a cross-sectional view similar to FIG. 4, illustrating removal of a modular cutting assembly as an integral unit.

As shown in FIGS. 4 and 5, the slot 145 is open-ended. This is important to one of the advantages afforded by the present invention. More particularly, the open-ended slot allows the cam pin to be disengaged from the slotted crank without having to disassemble either element from its supporting structure. As illustrated in FIG. 6, this facilitates easy removal of the blade assembly 119 as an integral unit from the main frame of the front unit upon removal of the fastening bolts that secure the upper and lower guide frame members to the side frame members of the main frame. Easy removal of the blade assembly is desirable in that it allows for quick replacement of the blade assembly with another assembly, as for repair or sharpening of the blade assembly. This is particularly beneficial when field servicing the machine.

With further reference to FIGS. 4 and 5, a switch 150 is mounted to the side frame member 91 with the trip lever thereof located in the path of the relatively adjacent slotted crank 144. The switch is actuated by travel of the slotted crank to its feed position corresponding to the feed position of the handle. When the switch is actuated, the feed motor 87 is energized to rotate the gear-like members for feeding of stock material through the machine with dunnage product being advanced through the guide chute 114. Accordingly, the handle may be moved clockwise to its position illustrated in FIG. 4 to actuate the switch and energize the feed motor to advance a length of dunnage product through the guide chute until a desired length of product has been run-off. The handle may then be moved in the opposite direction, counter-clockwise in FIGS. 3 and 4, to its cutting position shown in FIG. 4 for cutting a piece of the dunnage product of the desired length. The handle may be left in the position shown in FIG. 4 until a next piece of dunnage product is needed, at which time the handle may be moved to its feed position to run-off a desired length of dunnage product. In known manner, a master on-off switch may be provided for controlling the supply of electrical power to the motor and switch. Also, a reversing switch may be provided for driving the gear-like members in reverse to aid in clearing a jam in the machine.

Figure 14:
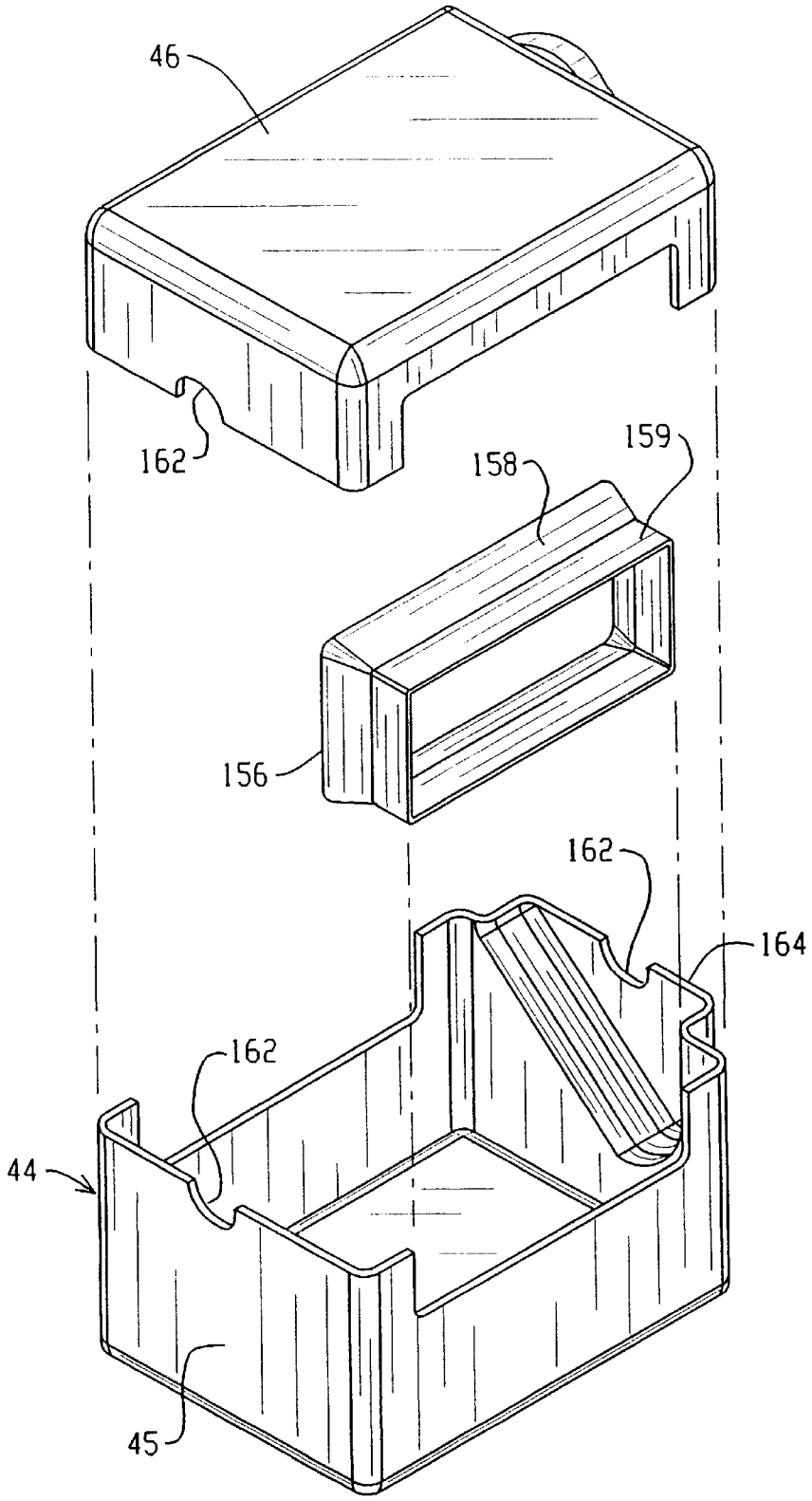
FIG. 14 is an exploded perspective view of the outer shell and the exit chute of the front unit of the machine.

The product that is fed through the guide chute 114 passes into an exit chute 156 shown in FIG. 3. The exit chute 156 is axially aligned with the guide chute 114 downstream of the cutting plane defined by the movement path of the moving blade 114. As shown in FIGS. 3 and 14, the exit chute has an outwardly flared funnel shape inlet portion 158 that tapers into a downstream rectangular portion 159. The inlet portion has a mouth greater in size than the cross-sectional area of the guide chute whereas the downstream portion has essentially the same cross-sectional shape as the guide. The flared mouth functions to receive and guide into the exit chute the newly cut leading end of the strip after a piece has been cut, which new leading end may have been pushed off axis by the cutting operation and remains off axis. As shown in FIG. 3, the bottom edge of the mouth is beneath the plane of the bottom frame member 126, the latter preventing the strip from being displaced downwardly such that it will not be captured by the mouth of the exit chute.

As shown in FIGS. 3 and 14, the exit chute 156 in disposed between the cover 46 and base 45 of the external shell or case 44 which encloses the interior components of the front unit. The operating handle is disposed externally of the shell 44 for manipulation by an operator in the above described manner. The crank shafts to which the handle ends are mounted extend through apertures 162 formed by recesses provided at the parting line of the cover and base of the shell. The cover may have an offset peripheral lip that overlaps the upper edge portion of the base in a manner similar to that described above with respect to the cover 37 and base 36.

As shown in FIG. 14, the shell is generally rectangular in shape with one side having a triangular guard portion 164 thereof displaced outwardly to accommodate the drive chain and sprockets. Preferably, the cover and base are molded from a suitable, for example ABS, plastic, as is the exit chute which may be trapped between the shell parts or secured to either one of the shell parts. The shell parts in turn are secured by suitable fastening means to the frame of the front unit.

Figure 9:
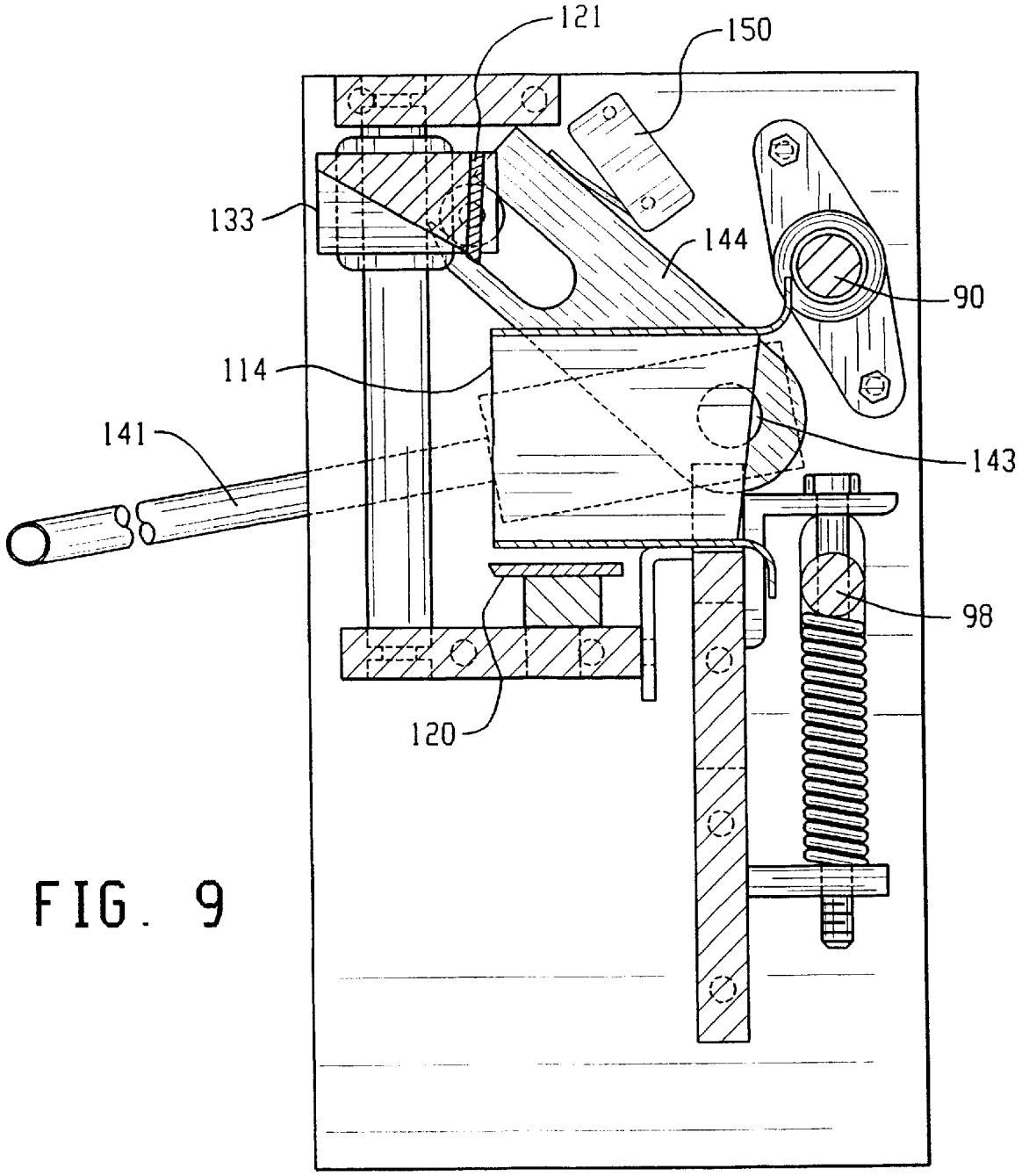
FIG. 9 is a view similar to FIG. 4, showing an alternative way that the operating handle may be mounted in the front unit, with the internal components of the front unit and the operating handle disposed in their feed position.
Figure 10:
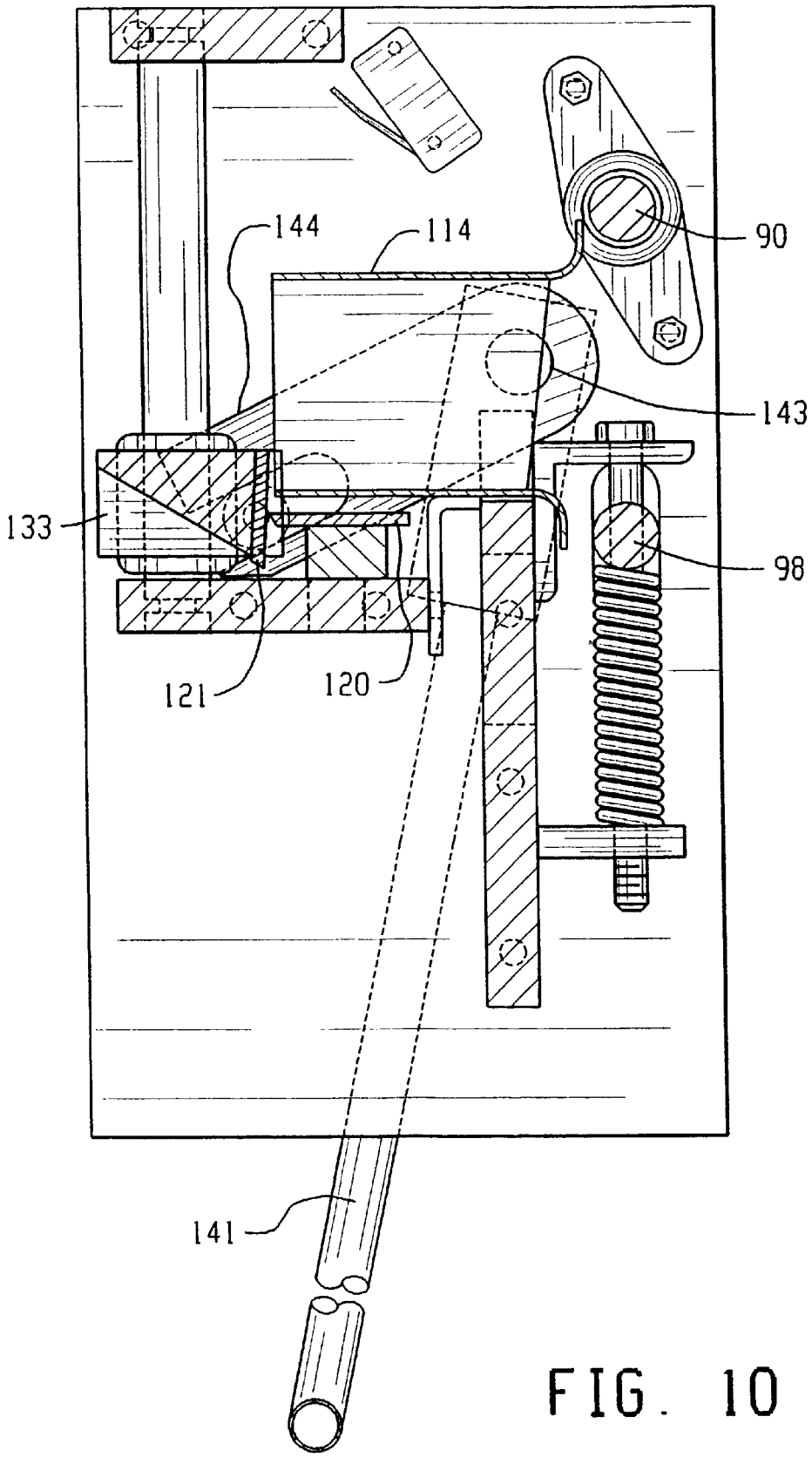
FIG. 10 is a cross-sectional view similar to FIG. 9, showing the position of the internal components with the operating handle in a cutting position.

Referring now to FIGS. 9 and 10, the handle 141 is shown secured to the crank shafts 144 at a different angular relationship, as is desirable for providing flexibility of use of the machine in different arrangements as will become more apparent from the following discussion of FIGS. 15–19. In FIGS. 9 and 10, the handle is secured in a position rotated 90° from that illustrated in FIGS. 4 and 5. This positions the handle for manipulation from the base or bottom side of the first unit as opposed to the cover or top side of the base unit. Any suitable means may be provided to mount the handle blocks to the crank shafts at one of plural different relatively rotated positions.

Referring now to FIGS. 15–19, various alternative arrangements or methods of using the conversion machine 20 are illustrated. These figures illustrate the flexibility of use afforded by the provision of modular front and rear units that may be interrelated in various ways, such as in vertical or horizontal relation or one inverted relative to the other. Arrangements other than those illustrated may also be used. For example, the rear and front units may have the axes thereof oriented other than horizontally or vertically, or the rear and front units may be arranged in other than coplanar relationship as at an angle, for example 90 degrees, while the exit opening of the rear unit and inlet opening of the front unit cooperate to provide a pathway for the stock material one to the other. In the case of such angular positioning, preferably a guideway, such as a rounded elbow, is provided between the exit and inlet openings.

Figure 15:
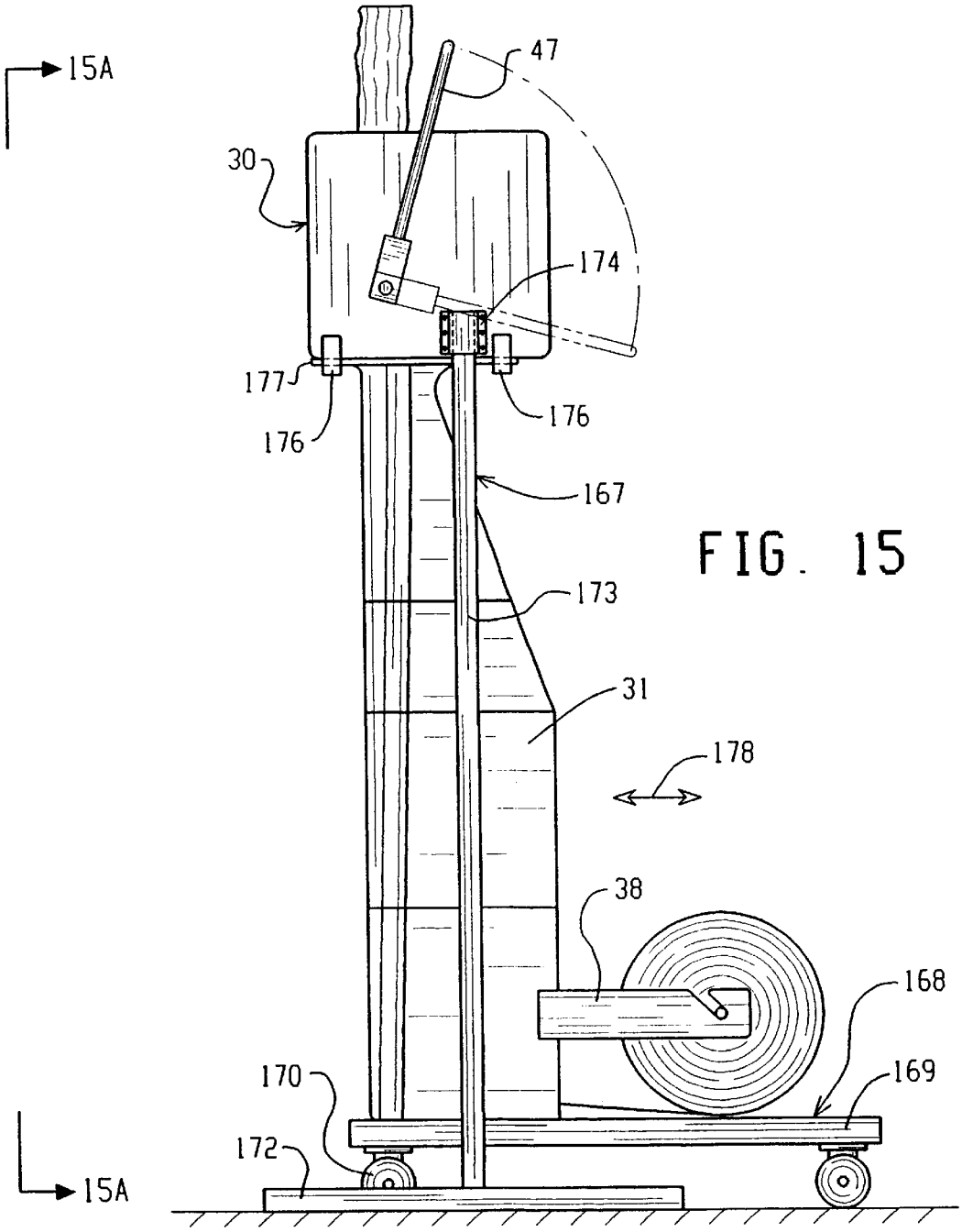
FIG. 15 is an elevational view showing the conversion machine in a vertical orientation with the front unit supported by a stand and the rear unit supported on a cart for movement toward and away from the front unit.
Figure 15A:
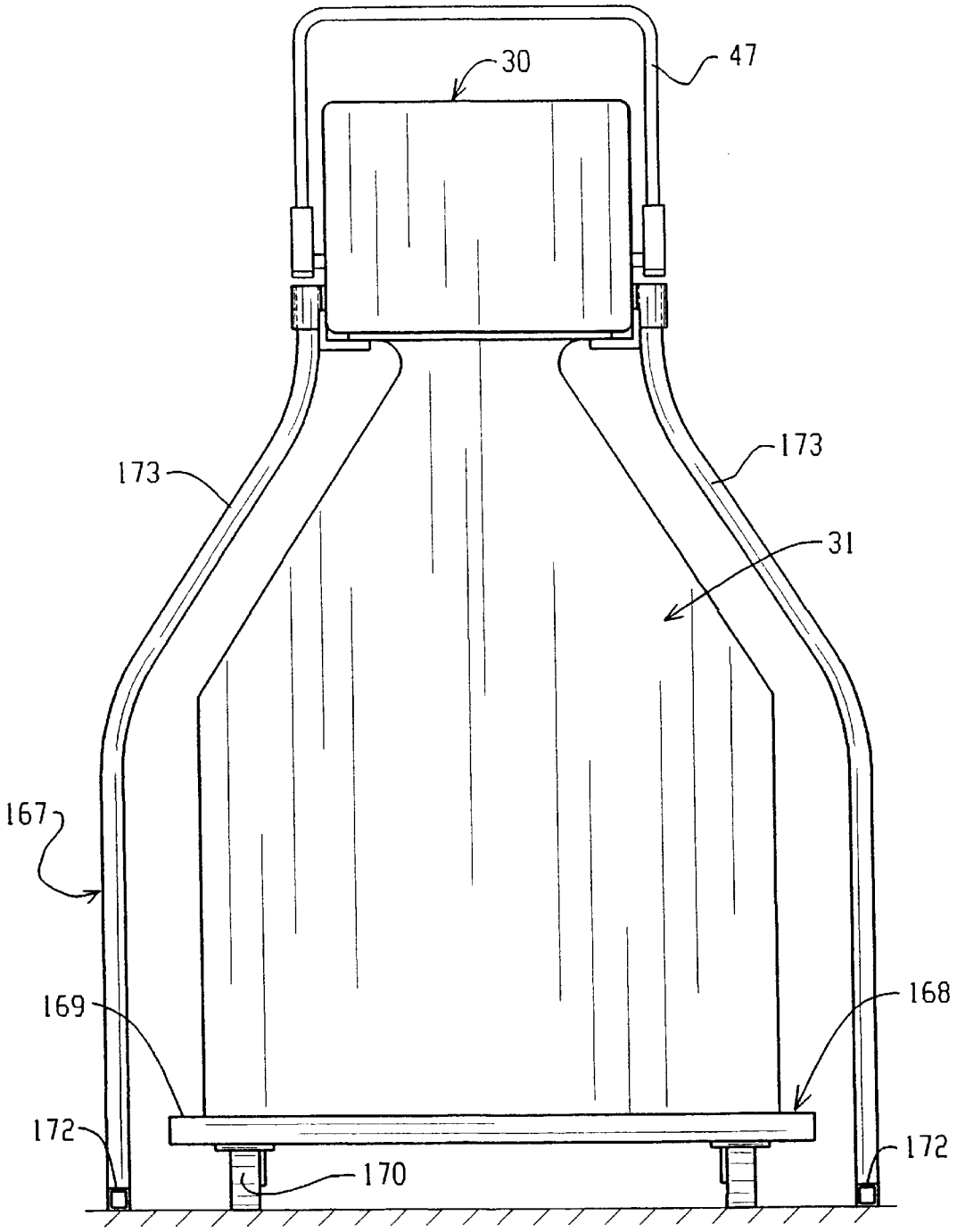
FIG. 15A is another elevational view of the conversion machine of FIG. 15, looking from the line 15A—15A of FIG. 15.

In FIGS. 15 and 15A, the rear and front units are vertically oriented with the front unit 30 supported on a stand 167 and the rear unit 31 supported on a cart 168 having a frame 169 and wheels 170 such as casters for rolling on a floor. The stand 167 includes at each side of the front unit an identical assembly of a base 172 and an upright 173. The front unit is secured to and between the upper ends of the uprights by brackets 174 or other suitable attachment hardware with the bottom thereof disposed at an elevation slightly above the top of the rear unit. The uprights have lower end portions thereof bowed outwardly to accommodate therebetween (straddle) the rear unit 31 which may be rolled beneath the front unit to align the exit opening of the rear unit with the inlet opening of the front unit for upward passage of stock material from the rear unit to the front unit. As shown, the handle 47 is mounted in its position illustrated in greater detail in FIGS. 9 and 10.

The rear unit 31 may be mounted at its rear end to the cart frame 169 with the roll support mounts 33 inverted from their position shown in FIG. 1 to receive a roll of stock material from above. Of course, the roll support mounts are positioned above the cart frame a sufficient distance to prevent interference between the stock roll and the frame. If desired, the top unit may have attached to the sides thereof depending guide elements 176 which may engage and guide the flange 177 of the rear unit into proper positional relationship with the front unit and then further assist in maintaining the rear unit is such position during use of the machine.

The ability to move the cart into and out of operational relationship with the front unit as depicted by arrows 178 has various advantages such as providing for remote loading of a stock roll onto the rear unit which may then be moved into position. If desired, more than one rear unit and cart assembly may be provided so that one may be used while the other is being loaded with a new stock roll.

Figure 16:
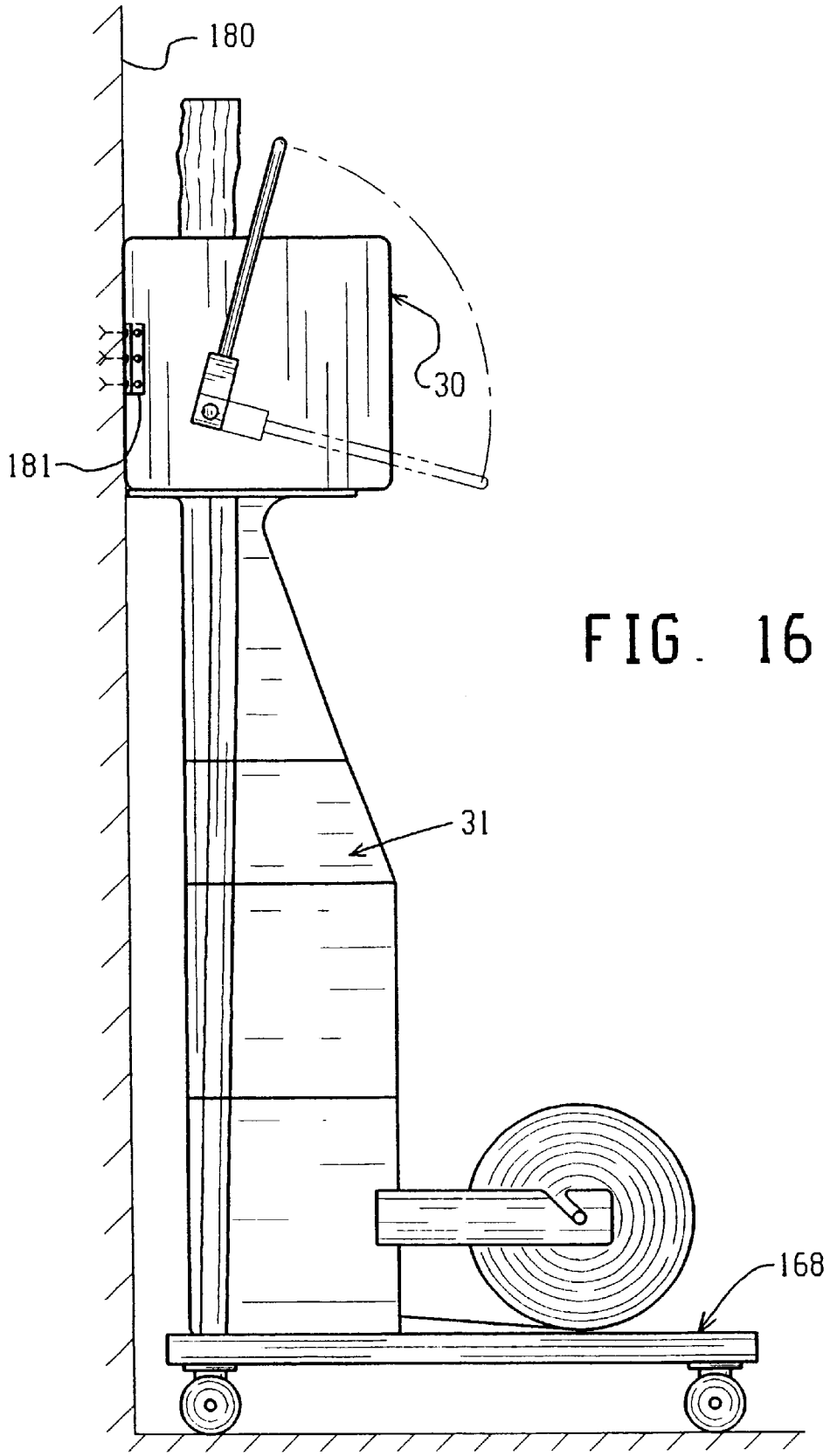
FIG. 16 is an elevational view showing the conversion machine in a vertical orientation with the front unit mounted to a wall and the rear unit supported on a cart for movement toward and away from the front unit.

In FIG. 16, the front unit 30 is shown mounted to a wall 180 or other vertical surface. The front unit is attached to the wall by mounting brackets 181 or other suitable attachment hardware at a height locating the bottom of the front unit slightly above the rear unit 31 which is supported on a cart 168 as in the same manner described above in connection with FIG. 15. Likewise, the rear unit may be moved beneath the top unit in similar manner.

Figure 17:
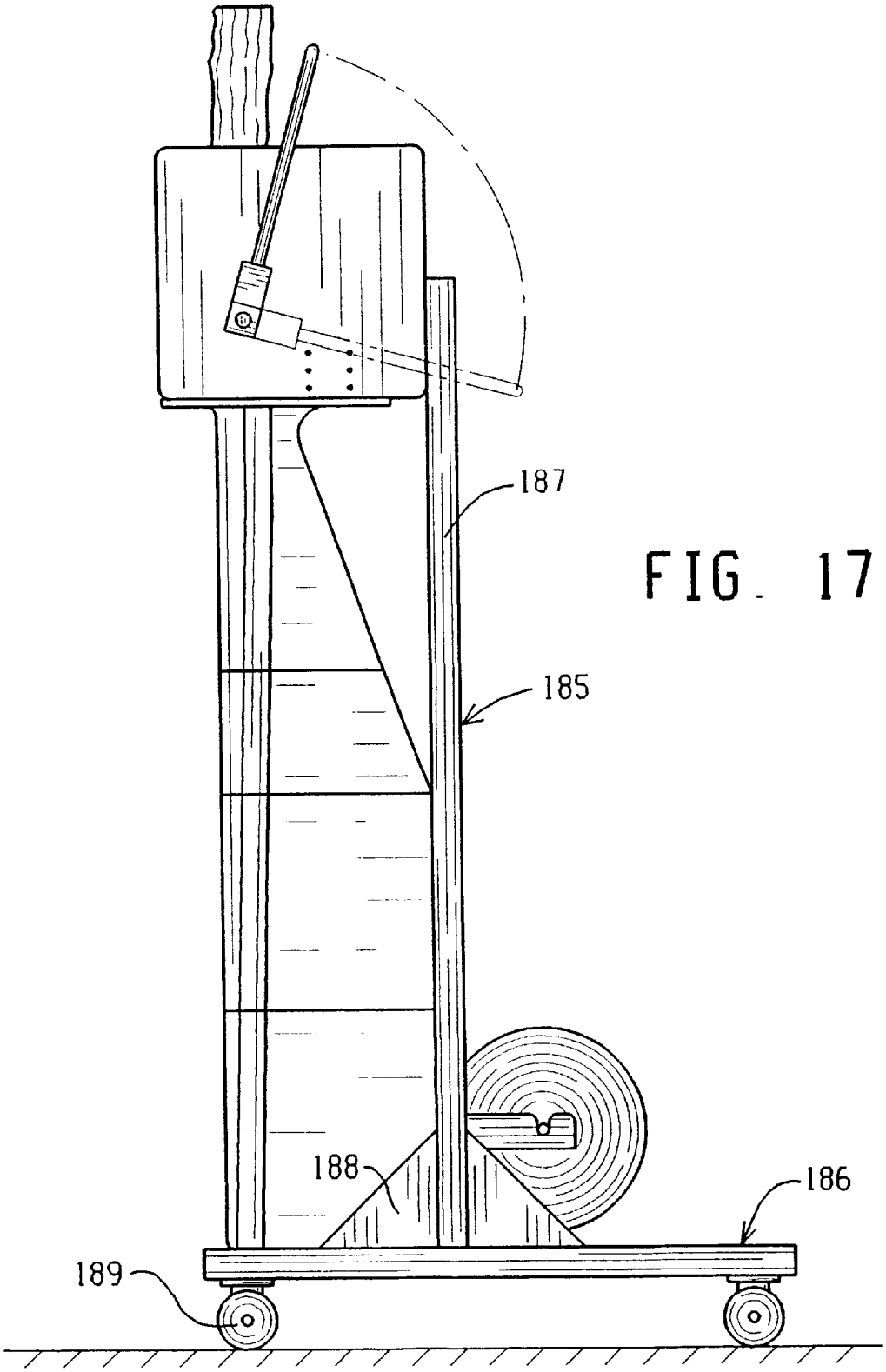
FIG. 17 is an elevational view showing the conversion machine in a vertical orientation with the front unit and rear unit supported on a cart.

In FIG. 17, the rear and front units are both supported in a vertical orientation by securement to an upright support 185 which in turn is supported on a cart 186 for transportability of the machine as from one use location to another or between use and storage positions. The upright support may be in the form of a frame having vertical posts 187 interconnected at their upper ends by a cross frame member and braced at their lower ends by gussets 188 on the cart. The cart is supported by wheels 188 such as castors for rolling on a floor.

Figure 18:
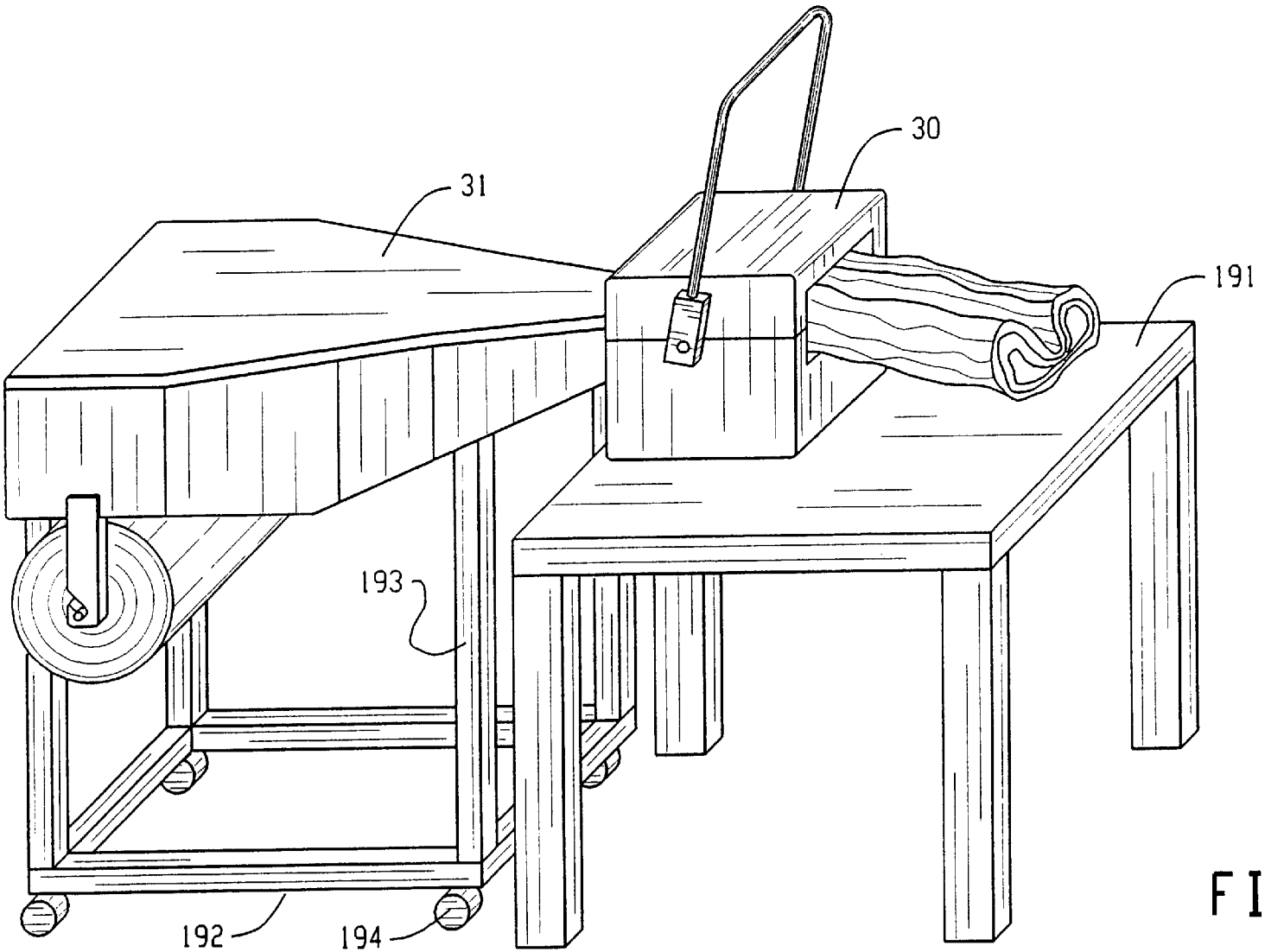
FIG. 18 is a perspective view of another embodiment of cushioning conversion machine wherein the rear unit is included in a cart for movement towards and away from the front unit supported on a table.

In FIG. 18, the rear and front units are horizontally oriented with the front unit 30 supported on a table top 191 and the rear unit 31 supported on a cart 192 having a frame 193 and wheels 194 such as casters for rolling on a floor. The exit opening of the rear unit and inlet opening of the front unit are at the same elevation whereby the rear unit may be moved into the position shown aligning the exit and inlet openings. Use of this arrangement is substantially the same as that described above with respect to FIGS. 15 and 16 except for the orientation of the machine.

Figure 19:
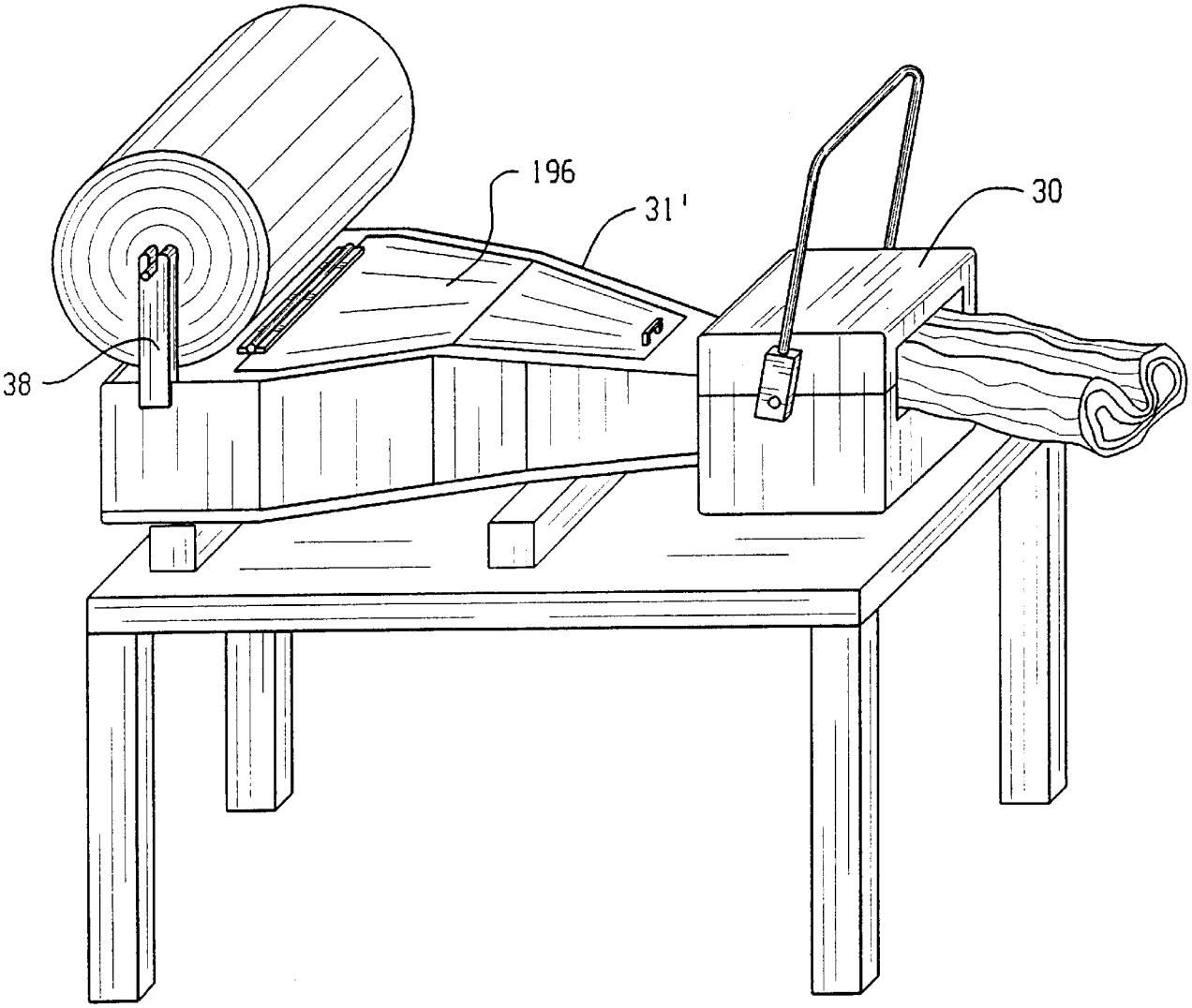
FIG. 19 is a perspective view of another embodiment of cushioning conversion machine wherein a modified front unit is assembled in an inverted position with respect to the front unit.

In FIG. 19, the rear and front units are assembled together in the same manner as that shown in FIG. 1, except that the rear member 31' is in an inverted position. For use in this arrangement, the rear unit has in the base thereof a hinged door 196 which functions like the cover of the FIG. 1 embodiment for permitting access to the interior of the rear unit to facilitate initial threading of stock material therethrough. Also, a modified form of stock roll mount 38' is provided for supporting the stock roll above the rear unit. As shown, the rear unit is supported on spacers to raise the exit opening thereof to the same elevation as the inlet opening of the front unit.

Figure 20:
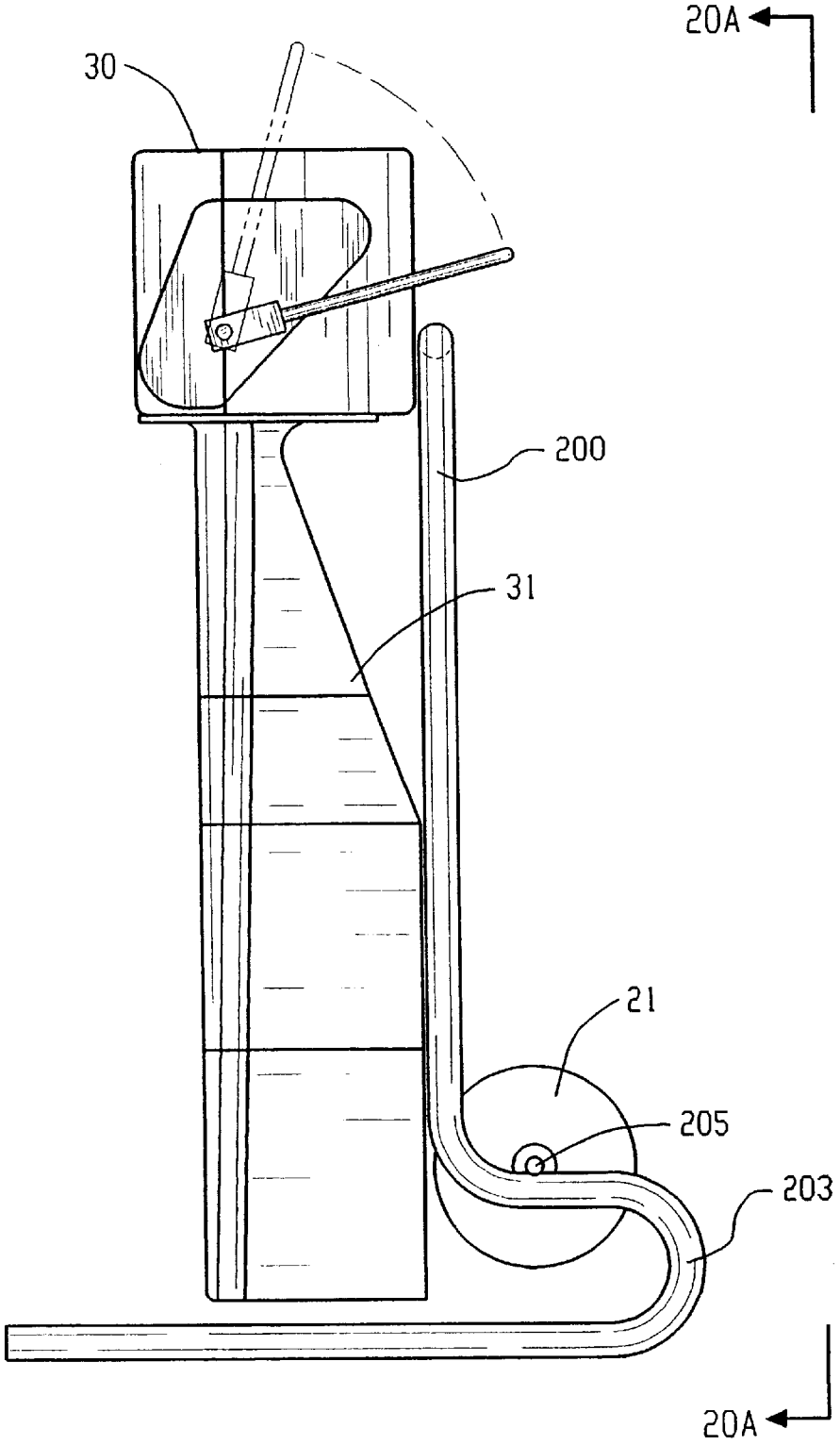
FIG. 20 is an elevational view showing the conversion machine in a vertical orientation with the front unit and rear units supported by a stand.
Figure 20A:
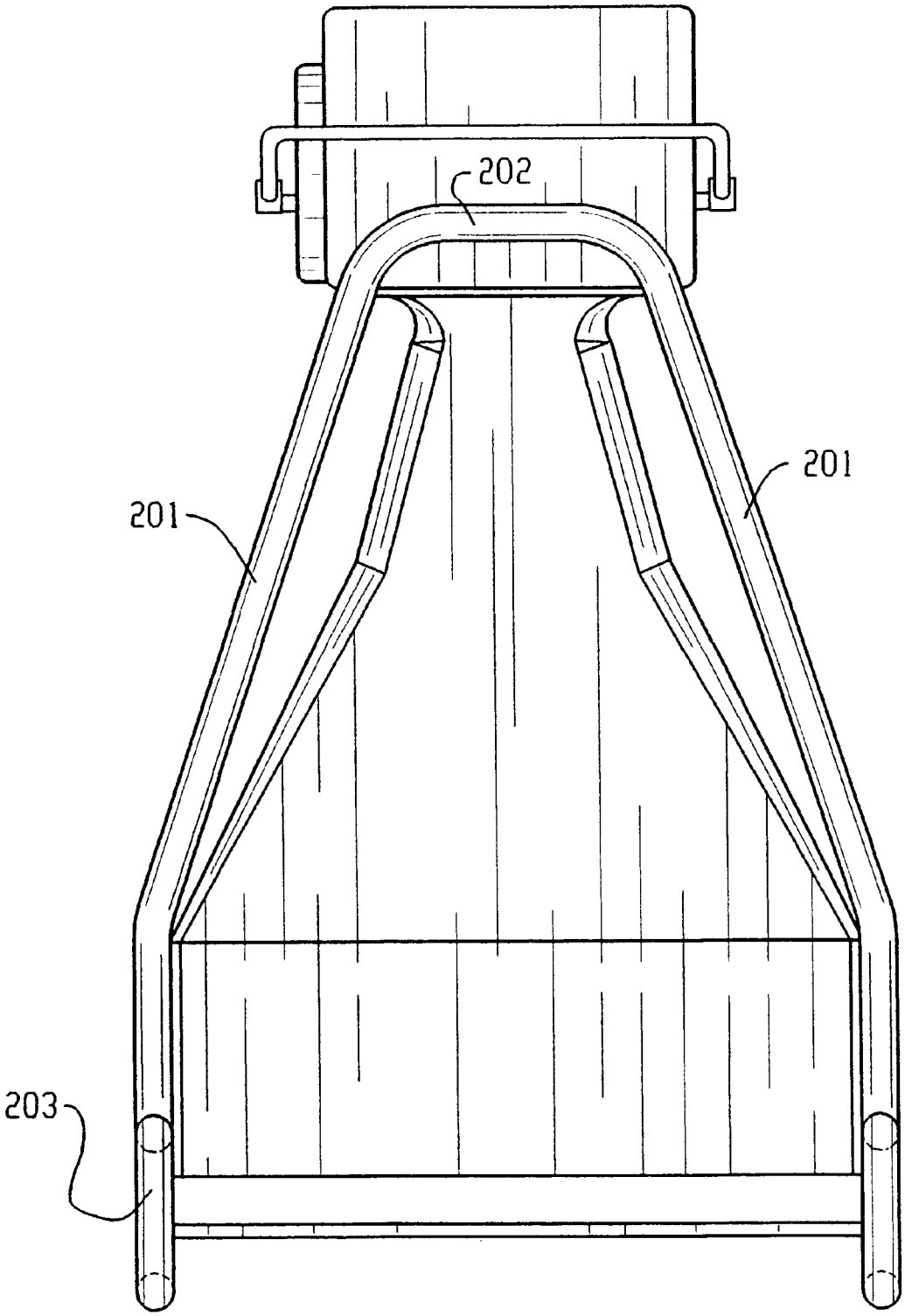
FIG. 20A is another elevational view of the conversion machine of FIG. 20, looking from the line 20A—20A of FIG. 20.

In FIGS. 20 and 20A, the front and rear units 30 and 31 are both supported in a vertical orientation by securement to an upright support 200 in the form of a bent tubular frame that may be formed, as illustrated, by bending a single length of tubing, or the like. As shown, the upper portion of the support generally has an inverted U-shape having a pair of legs 201 and a connecting bight portion 202. The legs 201 are generally coplanar and diverge from one another going from top to bottom. Each leg terminates at a foot 203 which extends out of the plane of the legs 201 in a first direction and then back on itself in the opposite direction through and beyond the plane of the legs to provide, along with the lateral separation of the feet, a broad base support for the upright support or standard 200. The elevated portion of the foot that terminates at the lower end of the respective leg may be equipped with a suitable cradle for receiving and supporting the ends of a roll holder 205 that supports the stock roll 21. Looked at another way, the feet are generally J-shape with the stem oriented to rest on a floor and the hook of the J joined at its distal end to the bottom end of the corresponding leg. If desired, the standard may be equipped with wheels such as castors for rolling on a floor.

Figure 21:
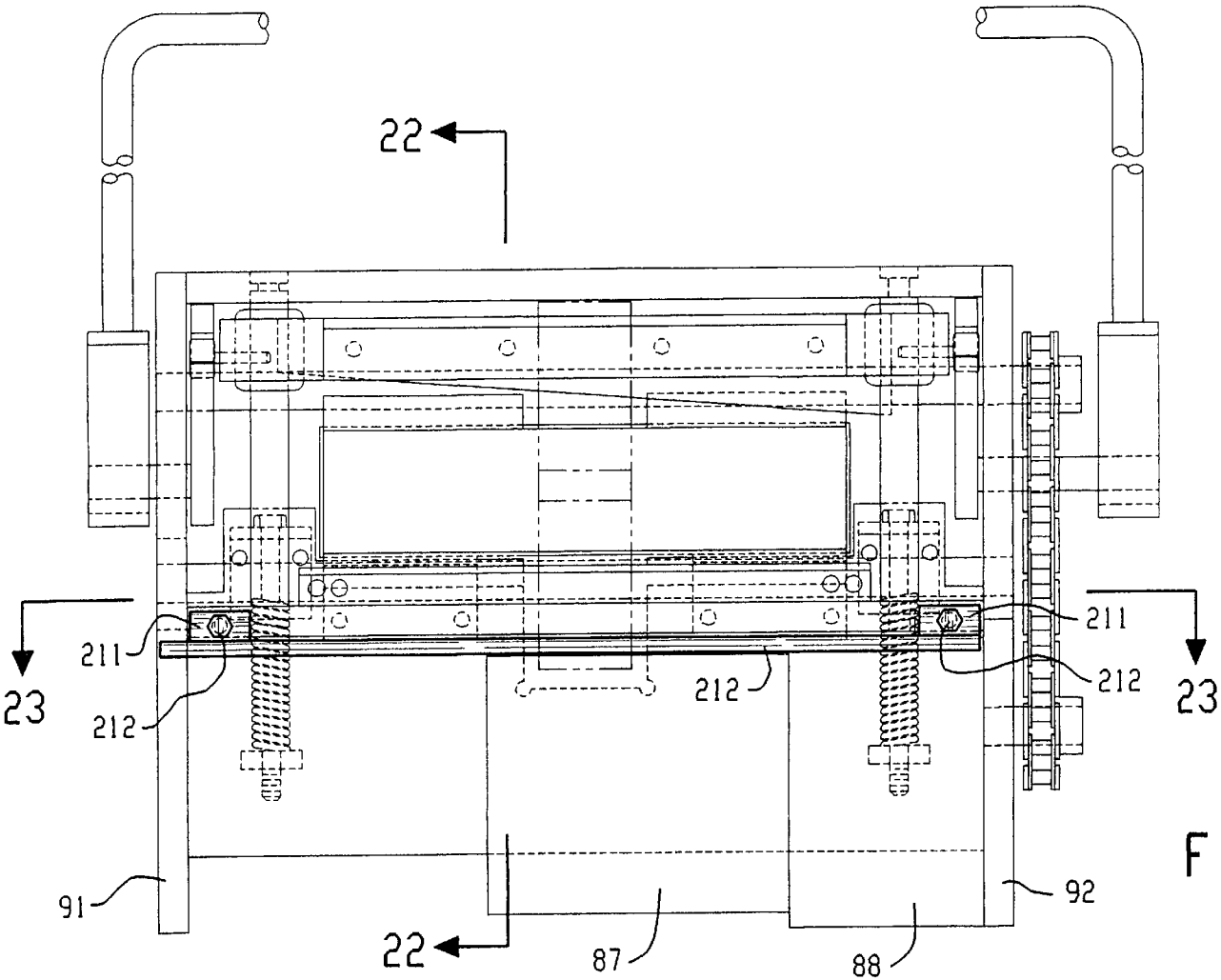
FIG. 21 is a view similar to FIG. 2, showing usage of a cover plate for protecting electrical components from debris.
Figure 22:
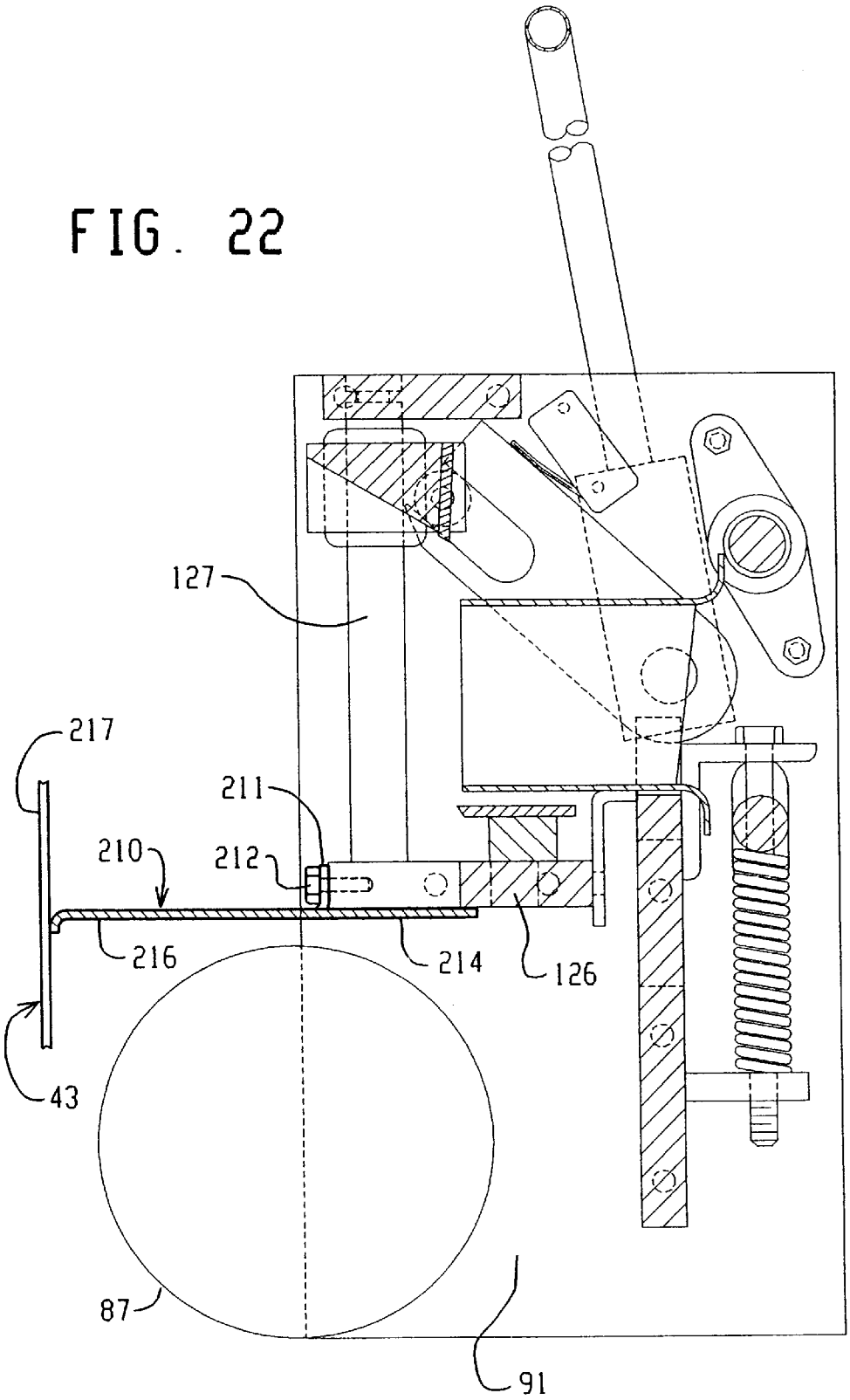
FIG. 22 is a cross-sectional view taken along the line 22—22 of FIG. 21, showing the manner in which the cover plate is mounted.
Figure 23:
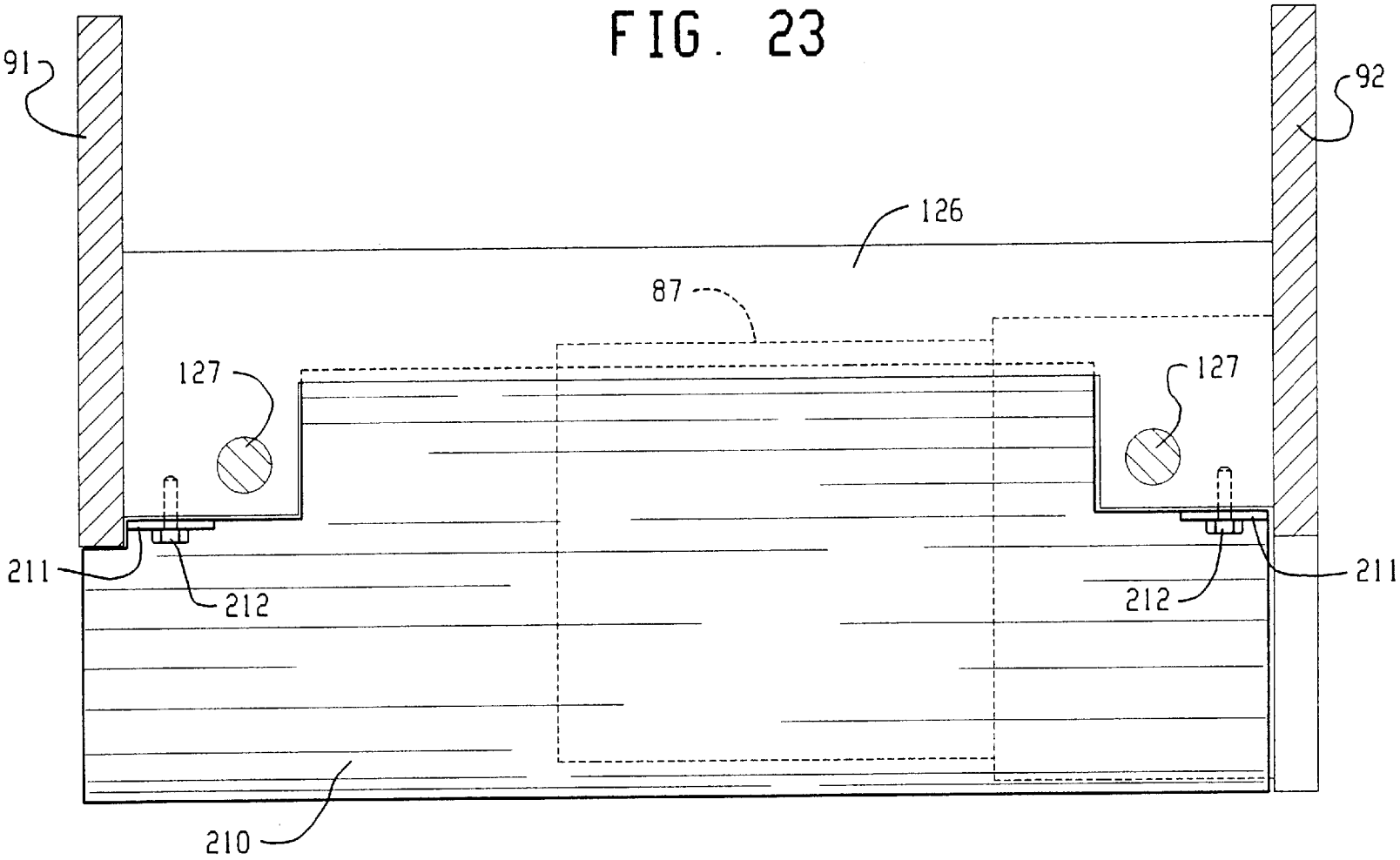
FIG. 23 is a cross-sectional view taken along the line 23—23 of FIG. 21, showing the cover plate in plan view.

Referring now to FIGS. 21–23, a cover plate 210 is provided for protecting the motor 87 and any associated electrical components from debris falling thereon, such as particles or pieces of paper that might be generated as a result of the paper being shaped, connected and cut in the above described manner. The cover plate 210 has at opposite ends thereof bent up ears 211 for attachment by fasteners 212 to the edge of the lower frame member 126. As best seen in FIGS. 22 and 23, the cover plate 210 has a rearwardly extending tab portion which extends beneath and engages the underside of the lower frame member 126. As also shown, the lower frame member 126 has a forwardly opening cut-out which is spanned and thus closed by the rearwardly extending tab portion 214 of the cover. The cover also has a portion 216 extending forwardly from the mounting ears 211 a distance sufficient to close the gap between the lower frame member 126 and the front wall of the housing 43. The cover plate 210 also extends transversely between the side frame members 91 and 92. In this manner, the opening defined by the side members 91 and 92, the front wall 217 of the housing 43 and the lower frame member 126 is substantially closed to prevent paper particles or pieces from falling from the path of the paper down onto the motor 87.

Figure 24:
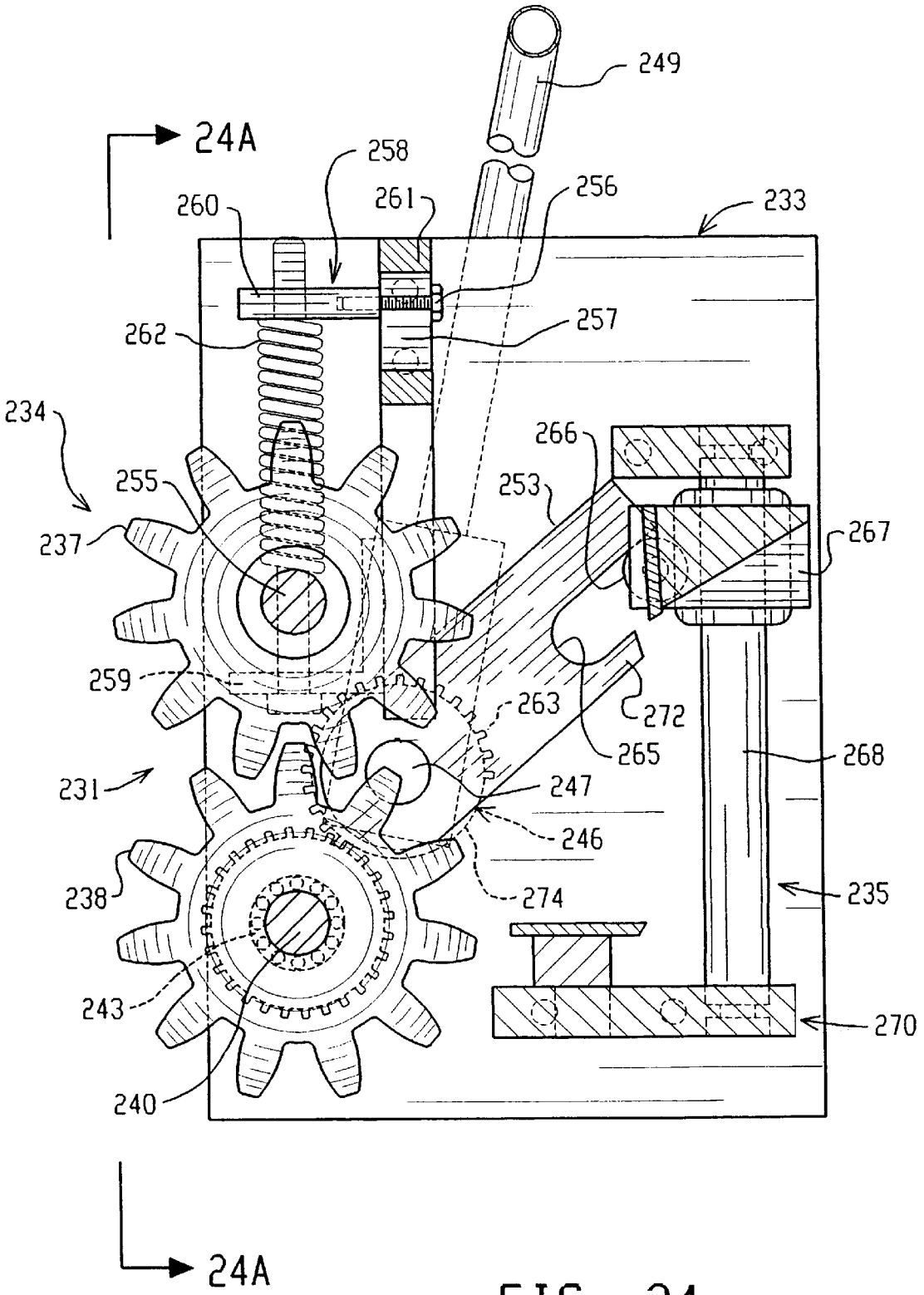
FIG. 24 is a longitudinal cross-sectional view through a manually powered front unit, with the operating handle thereof in a neutral position.
Figure 24A:
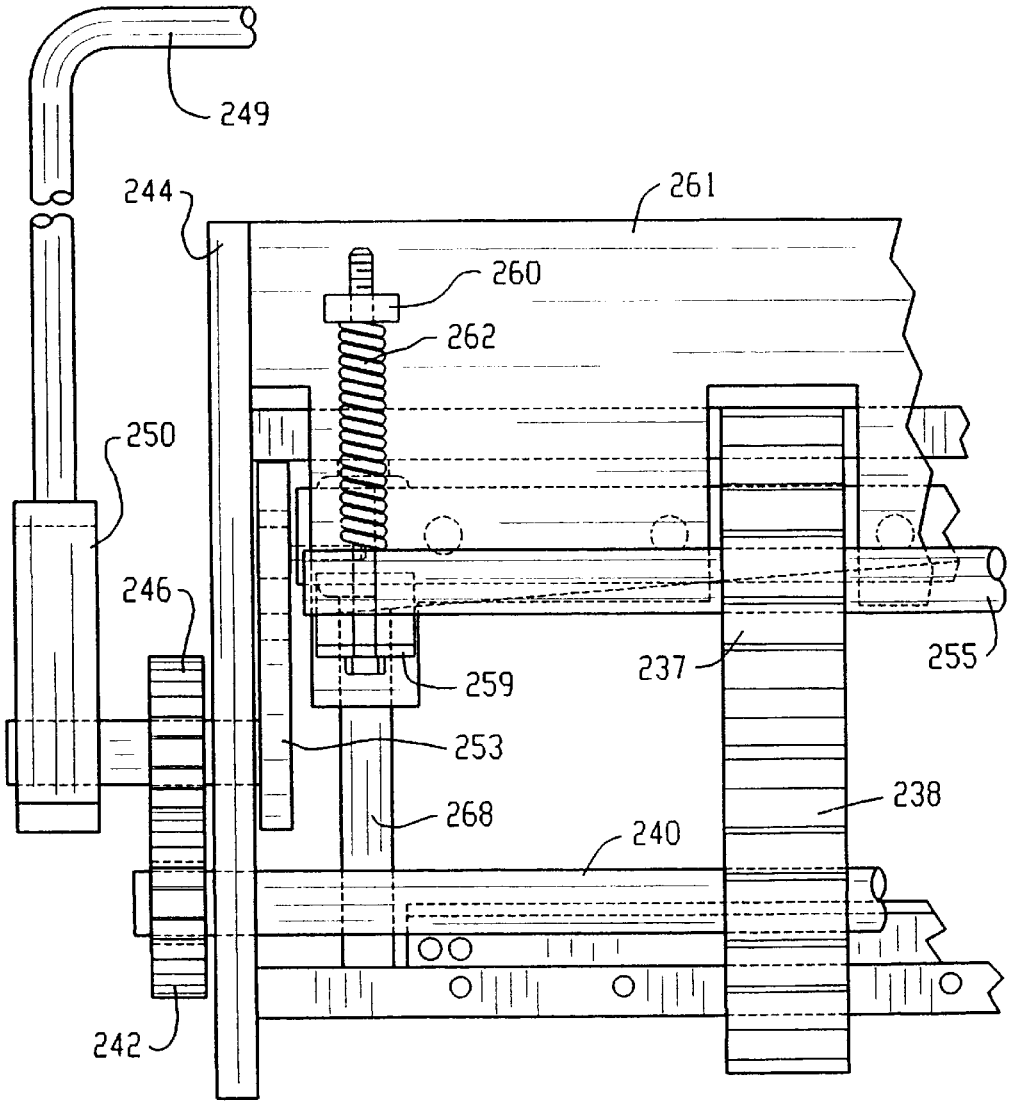
FIG. 24A is a transverse cross-sectional view through the front unit of FIG. 24, taken along the line 24A—24A thereof.

Referring now to FIGS. 24 and 24A, the pertinent interior components of a manually powered front unit 231 are illustrated. The front unit 231 is similar to the front unit 30 except for the manner in which the feed/stitching mechanism and cutting mechanism are powered. As will be seen, these mechanisms are manually powered which eliminates the motor 87 and associated drive components of the unit 30, or other powered devices such as a fluid motor and associated drive components. This results in a substantially lighter front unit, given that in the front unit 30 the motor 87 and speed reducer 88 account for a significant portion of the weight of the front unit. Also, the need for an electrical power source is eliminated.

As above mentioned, the front unit 231 is similar to the above described front unit 30 and, therefore, reference may be had to the above description of the front unit 30 for details of the front unit 231 that are not hereinafter described or shown in FIGS. 24 and 24A.

Like the front unit 30, the front unit 231 includes a frame 233 to which are mounted a feed/stitching mechanism 234 and a cutting mechanism 235. The cutting mechanism 235 is essentially identical to the above described cutting mechanism 81 in the front unit 30, although it can be seen in FIG. 24 that its positional relationship relative to the frame 233 has been varied while its positional relationship to the gear-like members 237 and 238 of the feed/stitching mechanism 234 has been maintained. It is noted that in FIG. 24 the stock material passes from left to right.

Like in the unit 30, the gear-like members are generally loosely meshed and operative to engage and move the product through the machine, pulling the stock material over the upstream forming frame and discharging the product out through an exit opening provided in the outer shell or casing of the front unit, as in the same manner above described in connection with the front unit 30. The gear-like members 237 and 238, however, are rotatably driven in a different manner then that above described in connection with the front unit 30. The gear-like member 238 is fixed to a drive shaft 240 that is rotatably mounted by suitable bearings in the frame 233. A gear 242 is coupled by an internal one-way clutch device 243 to an end of the drive shaft 240 that protrudes laterally outwardly of the relatively adjacent side frame member 244 of the frame 233. The gear 242 is intermittently engageable by a segment gear 246 that is keyed to the relatively adjacent one of the crank shafts 247 to which opposite ends of the handle member 249 are attached at the mounting blocks 250 thereof. Like in the front unit 30, each crank shaft 247 passes through and is rotatably supported by the relatively adjacent side frame member 244. Also, the inner end of each crank shaft has secured thereto a slotted crank 253.

The gear-like member 237 is supported for rotation on a shaft 255 arranged with each end thereof guided by the bolt of a respective spring biasing assembly. Each spring biasing assembly 258 is identical to the above described spring biasing assembly 102 except that the fixed support 259 may be conveniently mounted to the relatively adjacent transverse frame member 261 and the adjustable stop 260 is constrained for only vertical movement by a bolt that passes through a vertically elongated hole in the cross frame member 261. The shaft 255 is thus free to float, i.e., move towards and away from the shaft 240, to accommodate different thicknesses of stock material between the gear-like members while the spring 262 of each biasing assembly provides squeeze pressure to obtain a desired stitching or coining action. The squeeze pressure may be varied by adjusting the stop 260. The ends of the shaft 255 terminate short of the movement plane of the respective slotted cranks 253 so that slotted cranks can be swung past the shaft 240 to provide for a greater range of swinging movement for feeding of stock material.

The gear-like member 237 rotates when the gear-like member 238 is rotated. Rotation of the gear-like member 238 is effected by moving the handle 249 from its position shown in FIG. 24 towards its full feed position shown in FIG. 25. The segment gear 246 has a toothed segment 263 in mesh with the gear 242, whereby the gear 238 is rotated clockwise in FIGS. 24 and 25 as the handle is moved counterclockwise from its neutral position shown in FIG. 24 to its full feed position shown in FIG. 25. Such clockwise rotation of the gear 242 is transmitted through the one-way clutch 243 to the shaft 248 for rotating the gear-like member 238 clockwise in FIGS. 24 and 25. Such clockwise rotation of the gear-like member 238 and corresponding counterclockwise rotation of the gear-like member 237 will feed the product from left to right in FIGS. 24 and 25.

Figure 25:
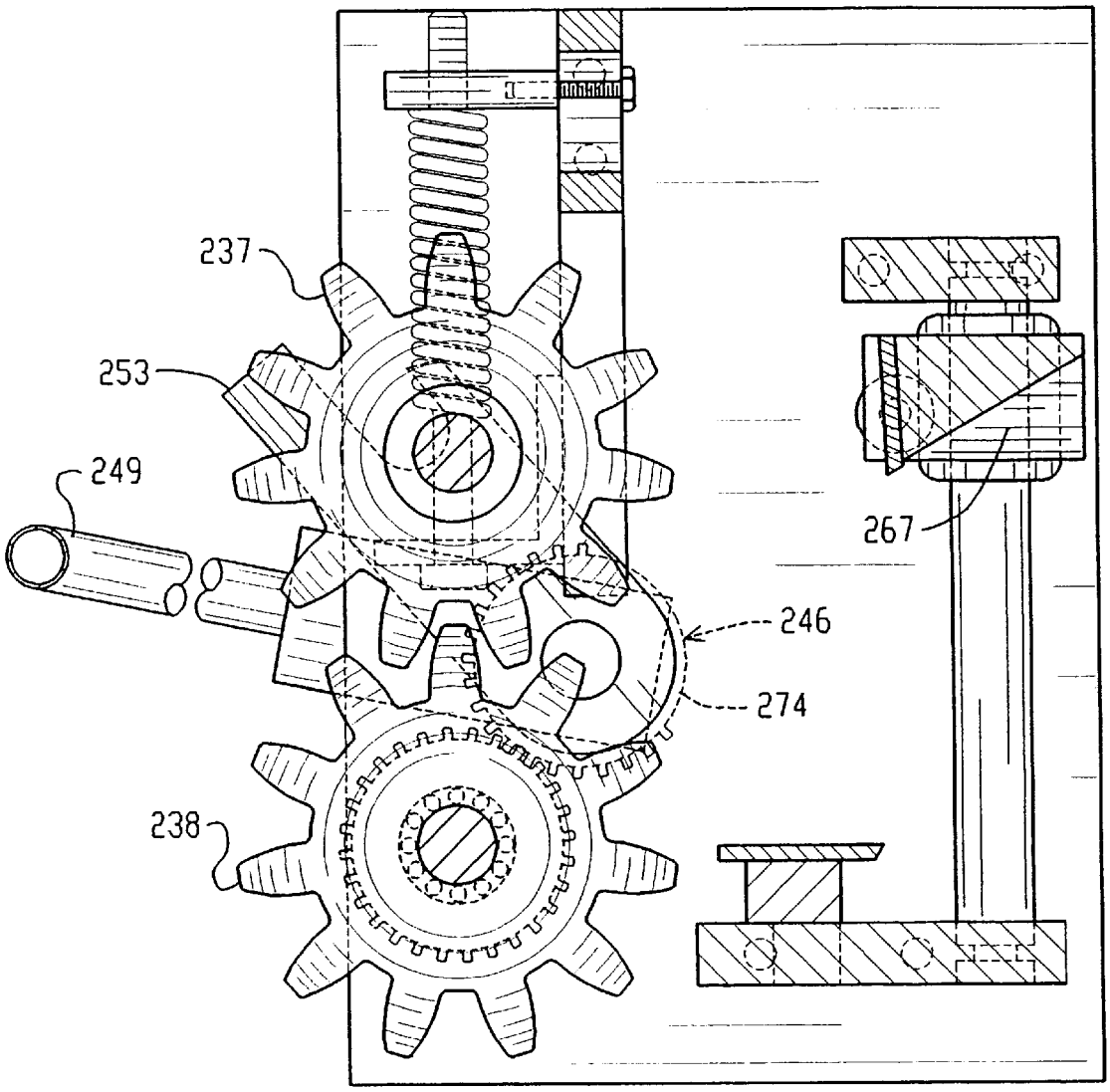
FIG. 25 is a longitudinal cross-sectional view similar to FIG. 24, showing the operating handle shifted rearwardly to feed product through the unit.

During return movement of the handle from its full feed position in FIG. 25 to its neutral position in FIG. 24, the gear-like members 237 and 238 will not be rotatably driven. Rather, the one-way clutch will allow the gear 242 to be rotated counterclockwise without any rotational movement being imparted to the shaft 240. Accordingly, the handle 249 may be reciprocally rotated back and forth between its neutral position of FIG. 24 and its full feed position of FIG. 25 to feed product from left to right in FIGS. 24 and 25, the stock material being pulled over the forming frame in the rear unit and the product being discharged out through the exit opening of the front unit. As will be appreciated, the U-shape handle member 249 may be conveniently grasped at its base portion extending transversely between the legs thereof and manually pushed and pulled back and forth to feed paper through the machine.

The handle 249 also is used to operate the cutting mechanism 235 in a manner similar to that described above in connection with the front unit 30. As above indicated, each crank shaft has secured thereto for common rotation a slotted crank 253. The slotted crank 253 has a slot 265 adapted to receive therein the cam pin 266 provided on the moving blade carriage 267. The slotted crank cooperates with the cam pin to transfer rotary motion of the crank to linear motion of the blade carriage 267 which is guided by the guide rods 268. The blade carriage, guide rods and other components of the blade assembly 270 are essentially identical to the corresponding components above described in connection with the blade assembly 119.

The slotted crank 253, however, differs slightly in that the side wall 272 of the slot that engages the cam pin during the return stroke of the moving blade is dimensioned radially to release and thus clear the cam pin after the moving blade carriage 267 has been fully retracted to its position shown in FIG. 24 (whereby opposite sides of the slot have different radial lengths). This allows the slotted crank to rotate from its position shown in FIG. 24 to its position shown in FIG. 25 during feeding of product through the conversion machine. After a desired length of product has been produced through back and forth movement of the handle between its neutral and full feed positions as above described, the handle can then be rotated from its neutral position shown in FIG. 24 to its full cut position shown in FIG. 26 to cut a strip of product, the cutting action being essentially the same as that described above in connection with the cutting assembly of the front unit 10.

Figure 26:
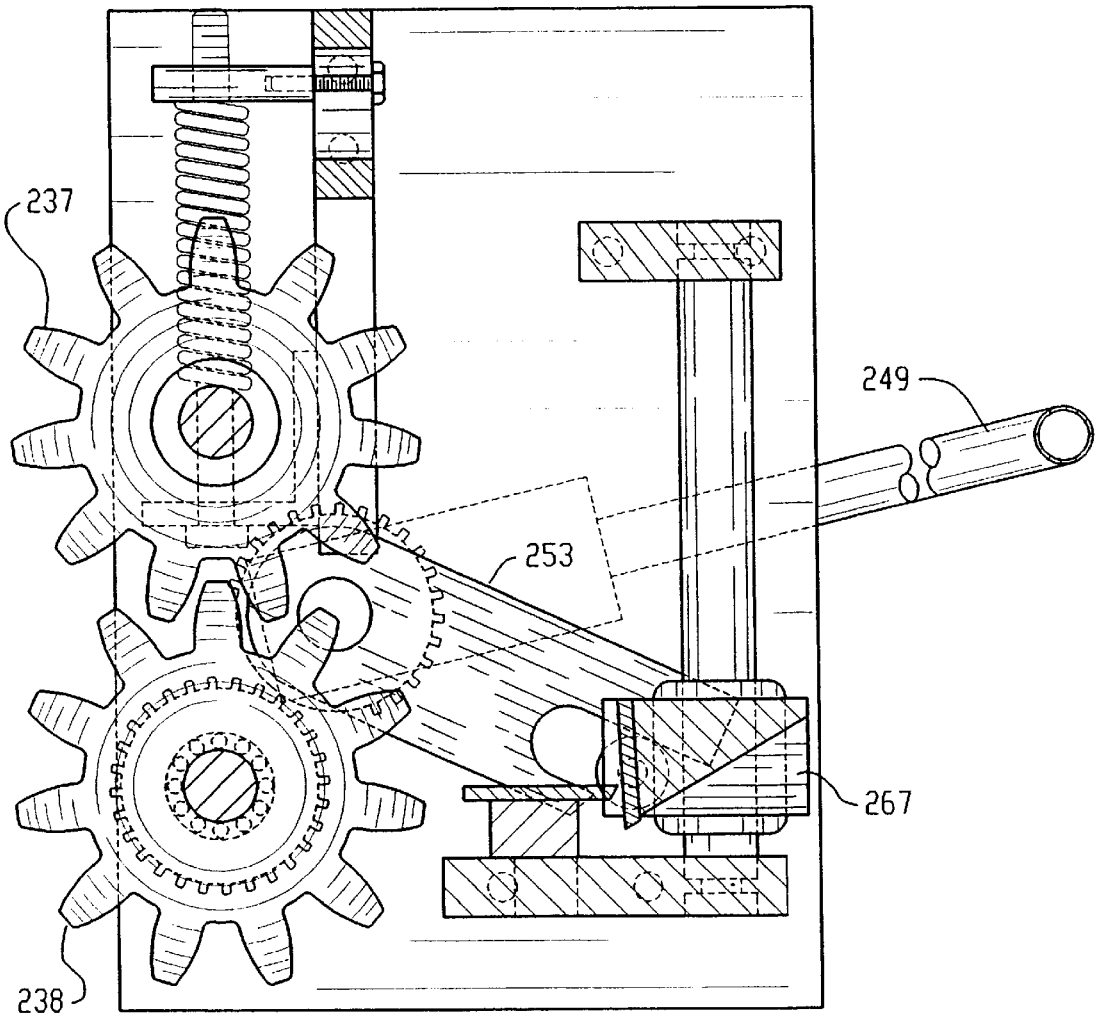
FIG. 26 is a cross-sectional view similar to FIG. 24, showing the operating handle shifted forwardly to sever a cut section of dunnage product from the strip thereof formed by the cushioning conversion machine.

As shown, the segment gear 246 has an untoothed segment 274 which passes over the teeth of the gear 242 when the handle is rotated from its neutral position shown in FIG. 24 to its full cut position shown in FIG. 26. Consequently, such rotation of the handle will not impart rotation to the gear 242 so that product will not be fed through the machine during the cutting operation.

In view of the foregoing, it can now be appreciated that there is provided a relatively lightweight simple product feed mechanism that may be used in place of the motor driven feed mechanism of the front unit 30. This is particularly advantageous in situations where users have relatively low volume requirements such that manual operation of the handle 249 will not be overly burdensome to the user. A machine equipped with the manually powered front unit 231 is particularly useful for more portable applications where electrical power is not available, such as in the back of a moving van.

Figure 27:
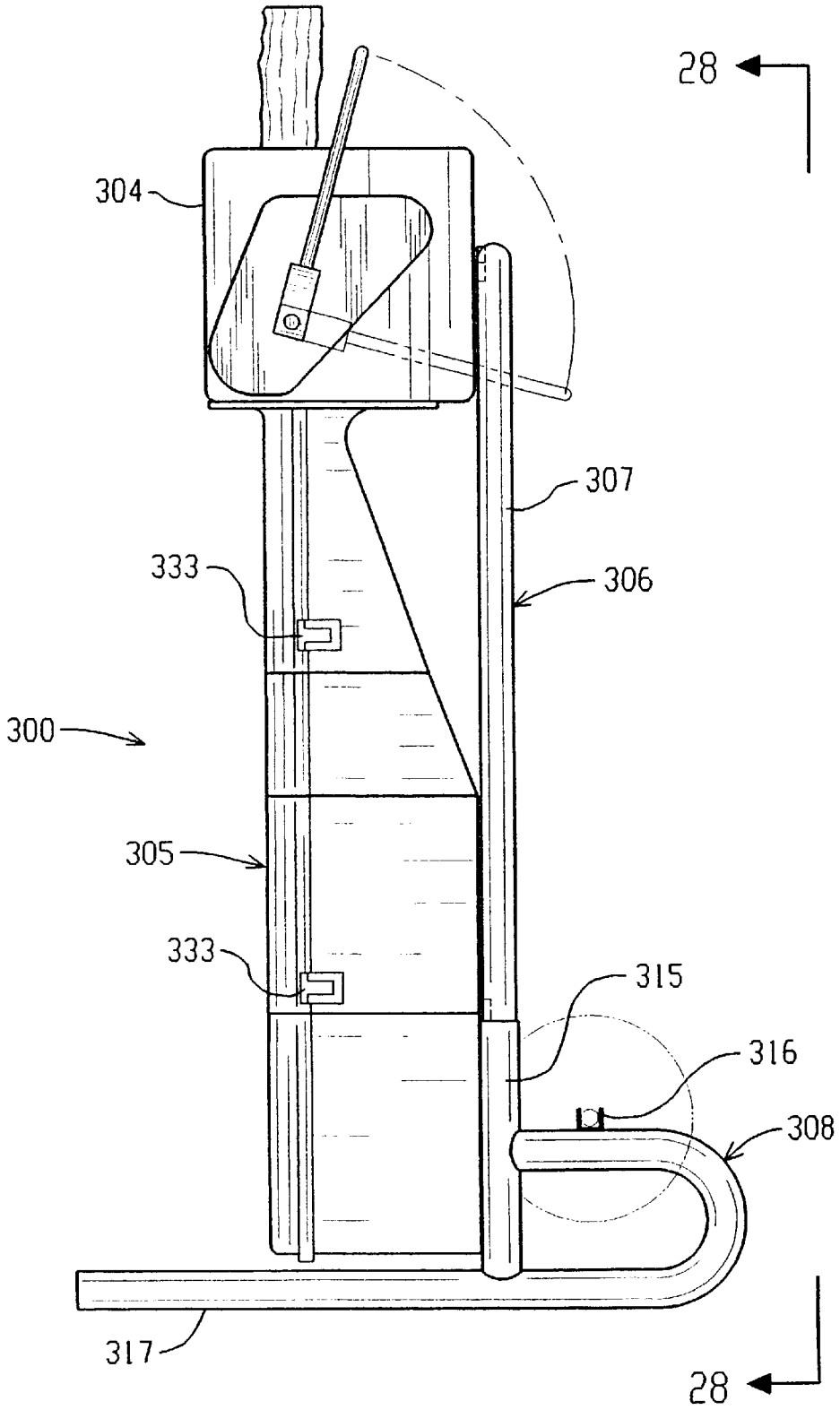
FIG. 27 is a side elevational view of another embodiment of cushioning conversion machine according to the invention supported by a stand in a vertical orientation.
Figure 28:
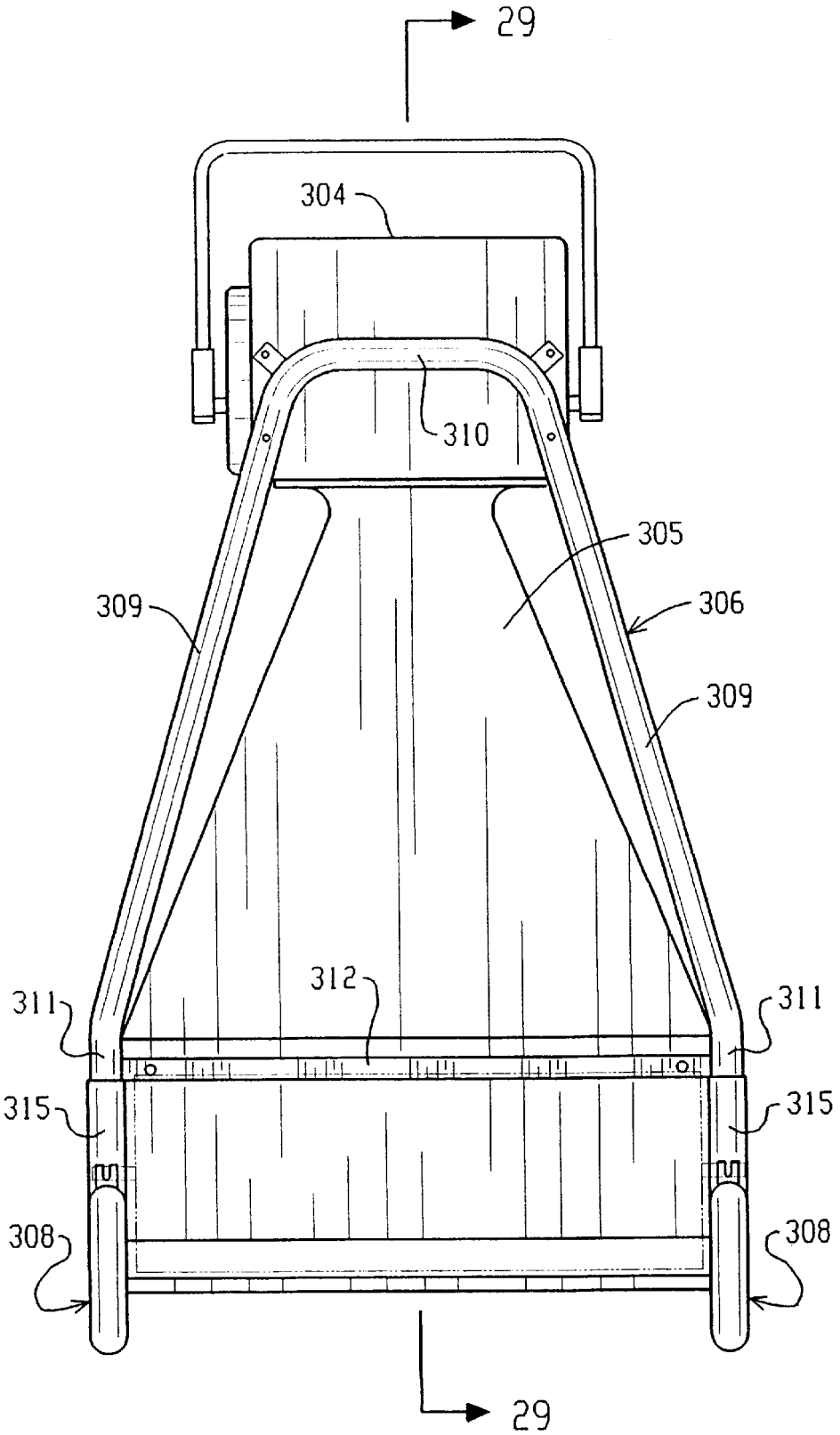
FIG. 28 is another elevational view of the conversion machine of FIG. 27, looking from the line 28—28 of FIG. 27.

Referring now to FIGS. 27 and 28, another embodiment of cushioning conversion machine according to the present invention is generally indicated by reference numeral 300. The machine 300 is for the most part the same as the above described machine 20 except for the provision of a shaping chute and forming member assembly generally indicated at 302 in FIG. 29. In addition, there are a few other differences which are hereinafter described. Otherwise, reference may be had to the description of the machine 20 for details of the machine 300 that are not hereinafter described or mentioned.

Accordingly, the machine 300 comprises a front unit 304 and a rear unit 305. The front and rear units are supported in a vertical orientation by a stand 306. In this orientation, the front unit may be referred to as a top unit and the rear unit as a bottom unit.

The stand 306 comprises an upper upright portion 307 and a bottom base portion formed by a pair of feet 308 configured for stable support atop a horizontal surface such as a floor surface. The upper portion 307 is of inverted U-shape having a pair of legs 309 extending downwardly from a bight or base portion 310. The front unit 304 is secured to the upper portion 307 at the base portion 310 which has a width dimension generally corresponding but preferably a little less than the width dimension of the front unit 304. From the bight portion 310 the depending legs 309 diverge away from one another to approximately the width of the rearwardmost portion of the rear unit 305 where the legs terminate at parallel end or post portions 311. The lower end portions of the legs are interconnected by a transversely extending frame member 312 to which the rear unit 305 is secured by suitable fastening means.

The parallel lower end portions 310 of the upper frame legs are telescoped into respective tubes 315 formed integrally in the feet 308. The end portions of the legs may be fixed in the tubes by suitable means such as by welding or they may be inserted with a slip fit such that the upper frame may be conveniently separated from the feet and, if desired, supported on a horizontal surface for use of the machine in a horizontal orientation, as in conjunction with a cart which positions the paper for proper entry into the rear unit 305. As shown in FIG. 28, the rear unit has an entry opening in the base wall thereof for passage of stock material into the interior of the rear unit. Each foot includes a respective one of a pair of cradles 316 for receiving the ends of a stock roller holder.

As will be appreciated, the feet may be removed from the upper frame portion to provide a more compact arrangement for shipping. Each foot 308 includes the upright tube 315 and a J-shape member 317. The upright tube is connected from a point intermediate the ends of the longer leg of the J and to the end of the shorter leg of the J at a point approximately midway along the length of the upright tube. The J-shape portion may be bent from a single piece of tubing or the like. The lower or longer leg of the J-shape member projects forwardly and rearwardly of the upright tube sufficiently to provide a stable support for the machine 300. If desired, each foot may be equipped with wheels such as casters for rolling on a floor.

Figure 29:
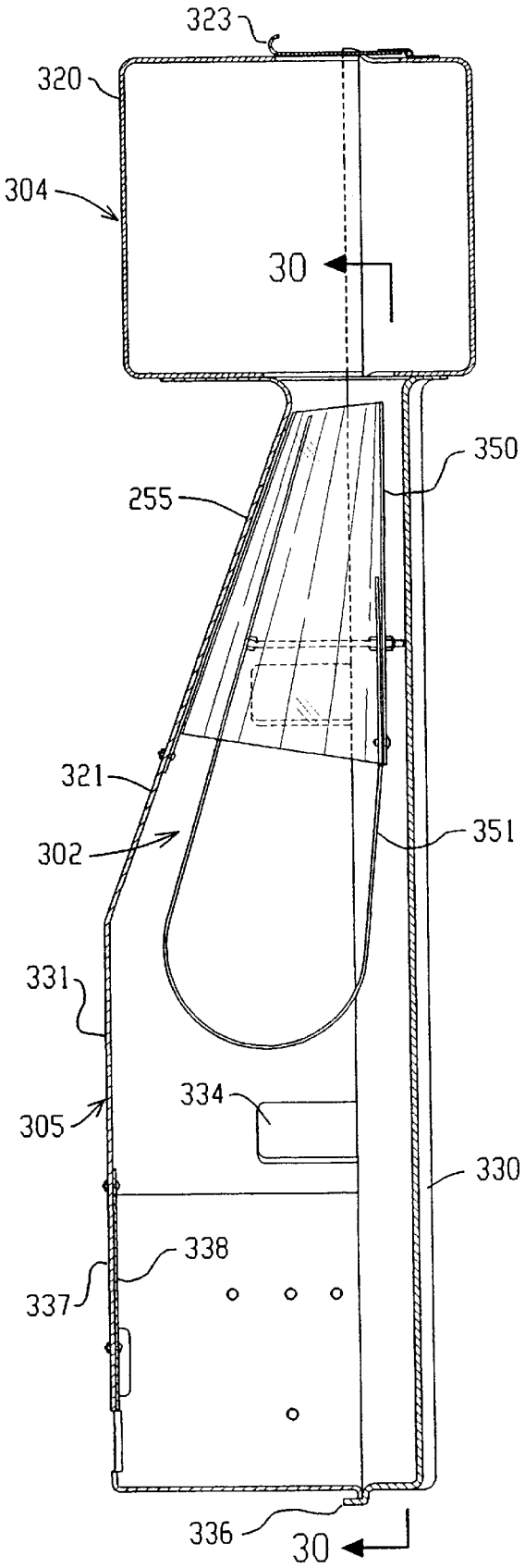
FIG. 29 is a longitudinal sectional view of the conversion machine of FIG. 27 separate from the stand and taken substantially along the line 29—29 of FIG. 28.

Referring now to FIG. 29, the front and rear units 304 and 305 are shown with the interior components thereof removed except for the shaping chute and forming member assembly 302. Aside from the shaping chute and forming member assembly 302 which is installed in place of the forming frame 56 of the machine 20, the other internal components of the front and rear units 304 and 305 are the same as described above in connection with the machine 20 and reference may be had thereto for details not discussed below. However, the outer shells 320 and 321 of the front and rear units, respectively, differ in a few respects.

Figure 42:
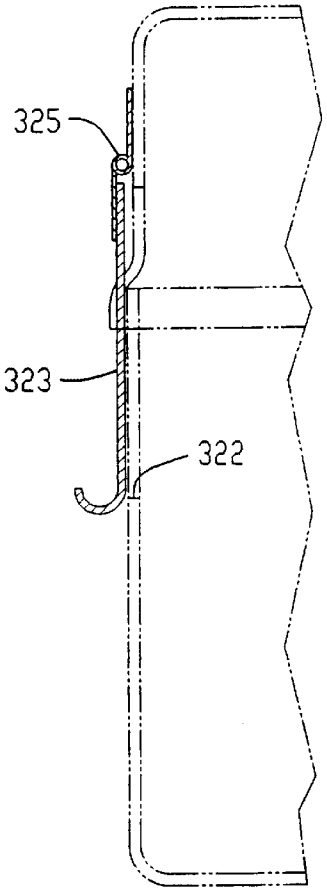
FIG. 42 is a cross-sectional view of the door of FIG. 41, taken along the line 42—42 thereof.
Figure 41:
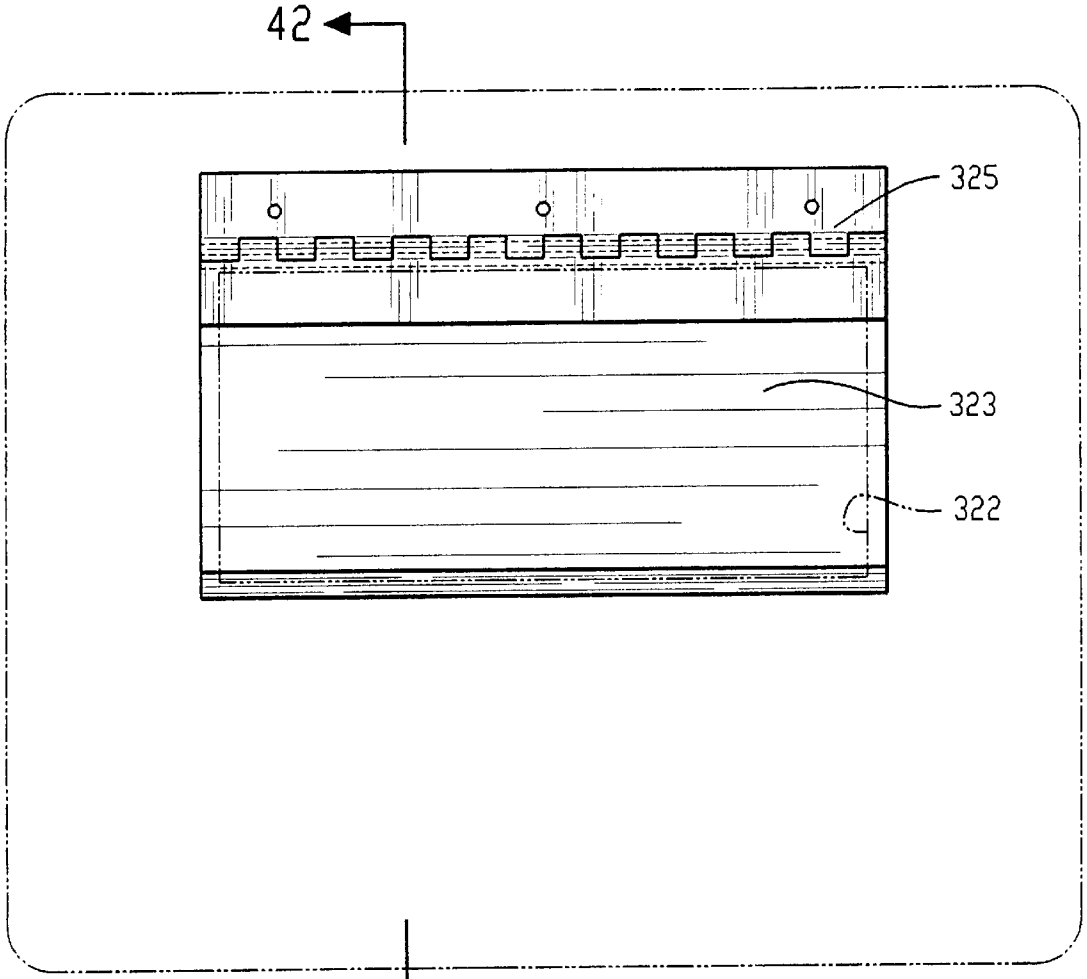
FIG. 41 is a plan view of a swing door covering the outlet opening of the front unit.

The outer shell 320 of the front unit 304 is provided with a one-way flapper door 323 which covers the outlet opening of the front unit. As further shown in FIGS. 41 and 42, the flapper door 323 is mounted by a hinge 325 to the front end wall of the outer shell 320 such that when in a closed position the flapper door spans and thus closes the outlet opening 322 to prevent foreign objects from entering through the opening 322 and interfering with the cutting mechanism located immediately inwardly of the opening 322. The hinge may be spring loaded or other means may be provided to bias the door 323 to its closed position illustrated in FIGS. 29, 41 and 42. Alternatively, reliance may be had on gravity to move the door to a closed position. Of course, the door will be pushed open as product advances through the outlet opening 322.

Again referring to FIG. 29, the cover 330 of the rear unit's shell 321 is not hinged to the base 31 of the shell as was the case in the machine 20. Instead, the cover is removably fastened to the base by one or more hinges 333. As shown in FIG. 29, the base may have recessed pockets 334 for housing the portion of the hinge attached to the base 331. As also shown in FIG. 29, the depending rear and side edge portions of the cover may be offset outwardly at their lower edges to form a peripheral lip 336 that overlaps the upper edge portions of the rear and side walls of the base 331. Also, the parting plane between the cover and base may be parallel to the top surface of the cover which, if desired may have formed therein longitudinally extending ribs in grooves for adding rigidity to the cover.

As further shown in FIG. 29, the bottom wall 337 of the base 331 may have secured thereto a metal plate 338 or other stiffening member. The stiffening member 338 preferably overlaps the cross frame member 312 of the upright 306 to provide for better securement of the rear unit to the cross member when fasteners such as screws or nuts and bolts are used. The metal plate also has application in the machine 20 for providing a stronger mounting structure for attachment of the stock roll support brackets 38. Of course, it will be appreciated that the machine 300 may be supported horizontally on a table in the same manner illustrated in FIG. 1 in connection with the machine 20, or the machine may otherwise be mounted in a variety of ways a few of which have been illustrated in FIGS. 15 through 20.

As shown in FIG. 29, the shaping chute and forming member assembly 302 comprises a longitudinally converging member or chute 350 and a forming member 351. In the conversion machine 20, the shaping chute is formed by the converging side walls of the outer shell 331 of the rear unit 305. However, it may be desirable as for fabricating purposes to form the shaping chute as a separate piece assembled interiorly of the outer shell of the rear unit. The funnel-like shaping chute may be formed of any suitable material such as, for example, a plastic which preferably is transparent to facilitate viewing of the product as might be desirable when the cover is removed to thread the stock material through the machine for start up.

With reference to FIGS. 29 through 34, the shaping chute 350 has secured to the bottom wall thereof a mounting plate 354 which has a widened rear end portion which extends axially to the rear of the chute for convenient attachment to the sloped bottom wall portion 355 of the rear unit's shell base. Suitable fastener means, such as bolts and screws, can be passed through holes in the rear end portion of the mounting plate 354 to fix the shaping chute in position within the tapering portion of the rear unit's shell just upstream from the exit end of the rear unit which is located immediately upstream of the feed/stitching mechanism (not shown) in the front unit 304. Although the feed/stitching mechanism is not illustrated in FIGS. 29 and 30, the relationship between the exit end of the rear unit and the interior components of the front unit is clearly illustrated in connection with the above described machine 20.

Figure 34:
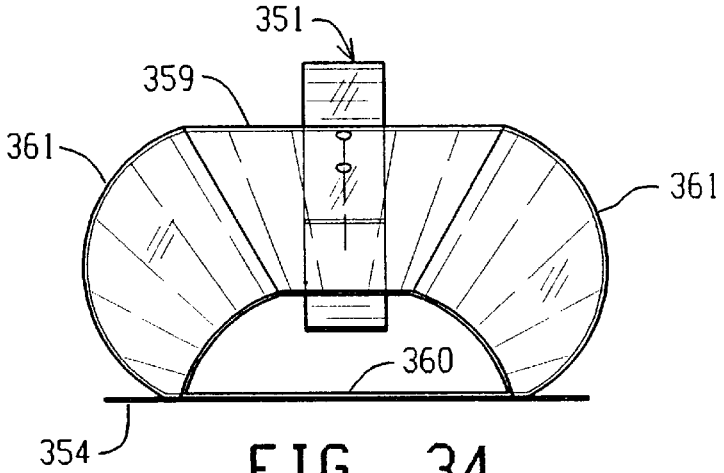
FIG. 34 is an end view of the forming chute and member assembly of FIG. 32.
Figure 35:
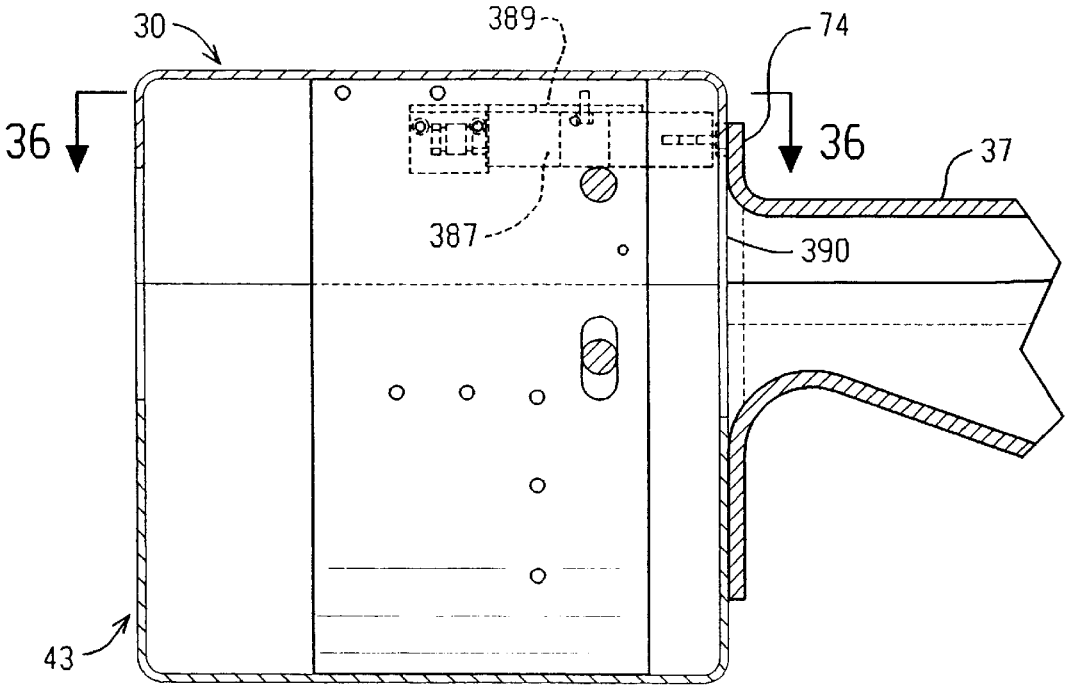
FIG. 35 is a fragmentary longitudinal cross-sectional view through the machine of FIG. 27, showing an interlock mechanism in accordance with the invention.
Figure 36:
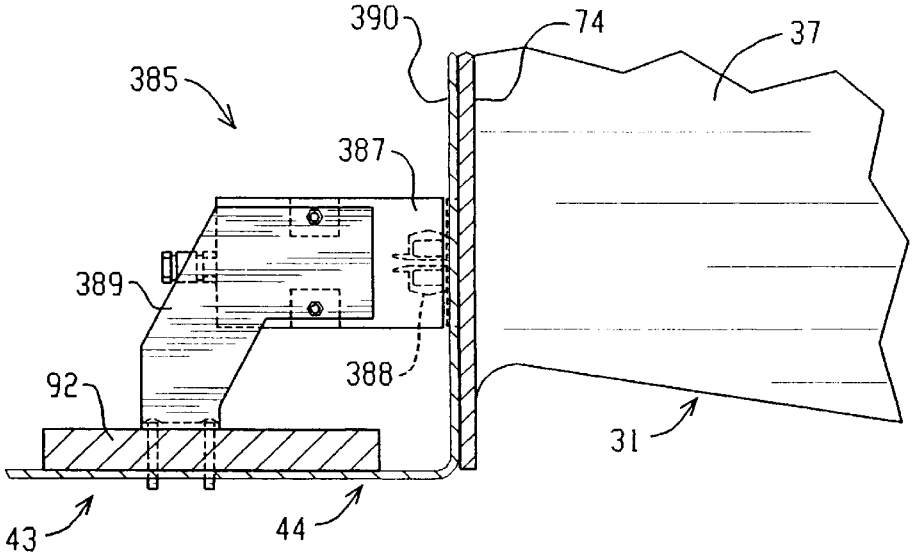
FIG. 36 is an enlarged fragmentary cross-sectional view taken along the line 36—36 of FIG. 35.
Figure 37:
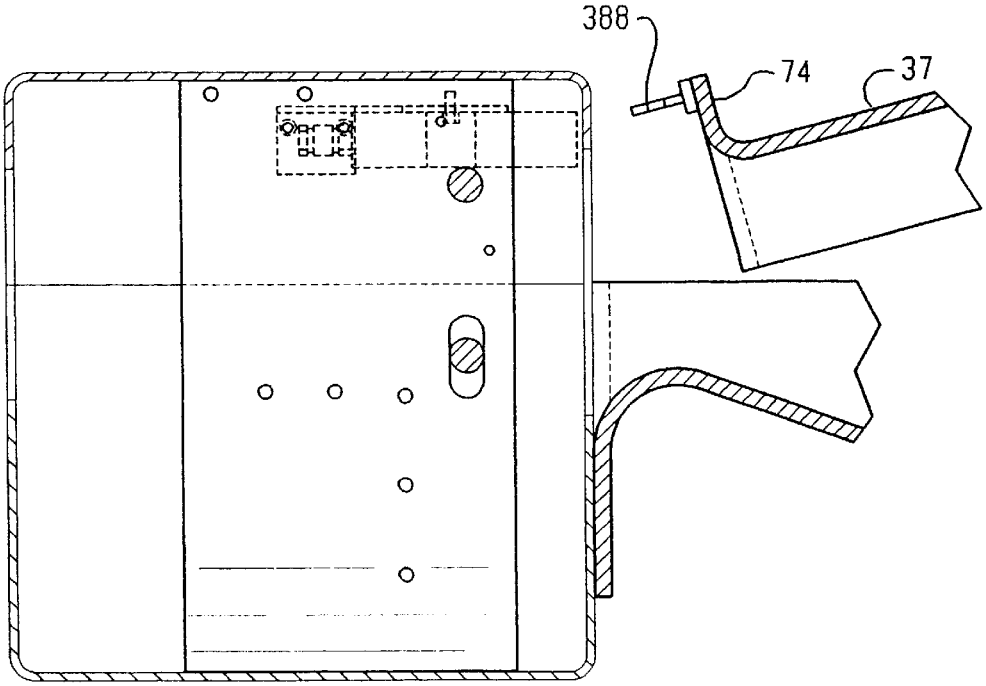
FIG. 37 is a view similar to FIG. 35, but showing the cover of the rear unit shell removed and the interlock mechanism disengaged.
Figure 38:
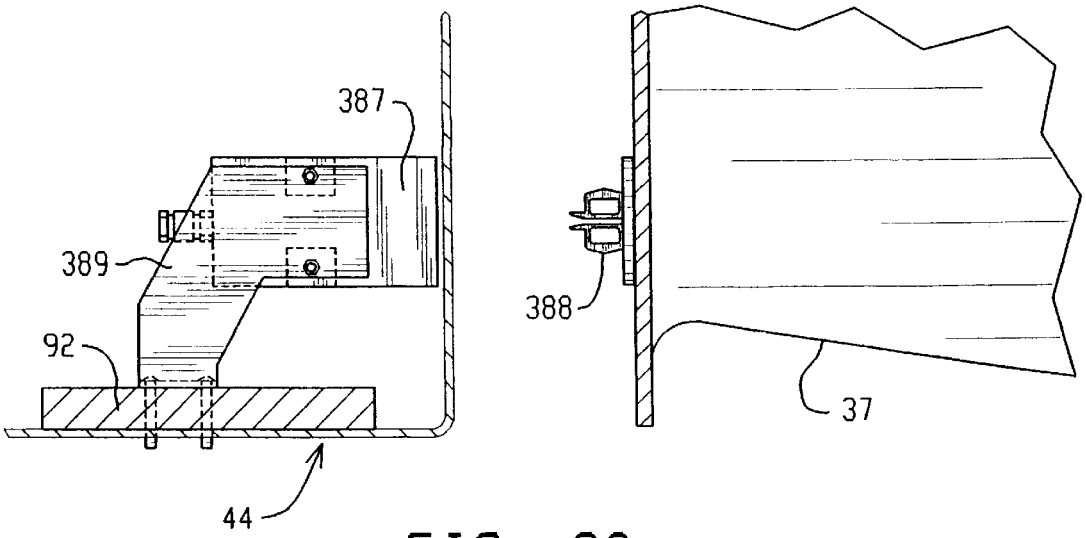
FIG. 38 is a view similar to FIG. 36, but showing the cover of the shell removed and the interlock mechanism disengaged.

The shaping chute 350 comprises a widened generally O-shaped entrance mouth 358 formed or defined by the rear edges of generally flat top and bottom walls 359 and 360 are arcuate side walls 361. The top wall is of generally trapezoidal shape while the bottom wall is generally rectangular in shape, with such walls converging toward one another to define the exit opening 363 of the shaping chute. The exit opening 365 is of generally semi-oval configuration in elevation as shown in FIG. 34, the half oval being taken along the major as opposed to minor axis of the oval.

As the sheet-like material is passed through the shaping chute 350, the side edges of the stock are rolled inwardly into generally spiral form and are urged inwardly toward one another so that the inwardly rolled edges form resilient pillow-like portions of stock material disposed in lateral abutting relationship as they emerge from the exit end of the shaping chute, and are adapted to be joined together by the feed/stitching mechanism. The shaping chute may be formed of any suitable material, and may be conveniently be formed of a suitable plastic material such as, for instance, fiber glass.

The forming member 351 coacts with the shaping chute 350 to ensure proper shaping and forming of the paper, the forming member being operative to guide the central portion of the stock material along the bottom wall of the shaping chute 360 for controlled inward rolling of the side edge portions of the stock material. The forming member projects rearwardly of the entry end of the shaping chute for proper guiding of the stock material into the shaping chute. The forming member also extends into the shaping chute with its forward most end disposed relatively close to the underlying bottom wall of the shaping chute adjacent the exit end of the shaping chute.

The forming member 351 has a pinched U-shape that generally corresponds in appearance to a bobby pin. The bight or base portion 370 of the forming member is rounded and preferably of semi-circular shape. The forming member preferably is made of a suitable material such as plastic which has sufficient flexibility such that the rounded bight portion of the forming member functions as a living hinge permitting adjustment of its lower leg 372 towards and away from the bottom wall 360 of the shaping chute, as discussed further below.

The legs of the U-shape forming member are generally straight and converge towards one another to give the U its pinched U or bobby pin shape. The upper leg 374 is attached to the top wall 359 of the shaping chute along the center plane thereof by suitable fastening means such as rivets, screws, bolts, cement or other adhesive, and the like. The upper leg may be bent, for example, at the exit end of the shaping chute to shift the bight portion of the U downwardly to provide a desired gap between the rearward end of the forming member and the bottom wall of the shell base for proper guiding of the separated plies of sheet material into the entry end of the shaping chute.

Figure 29A:
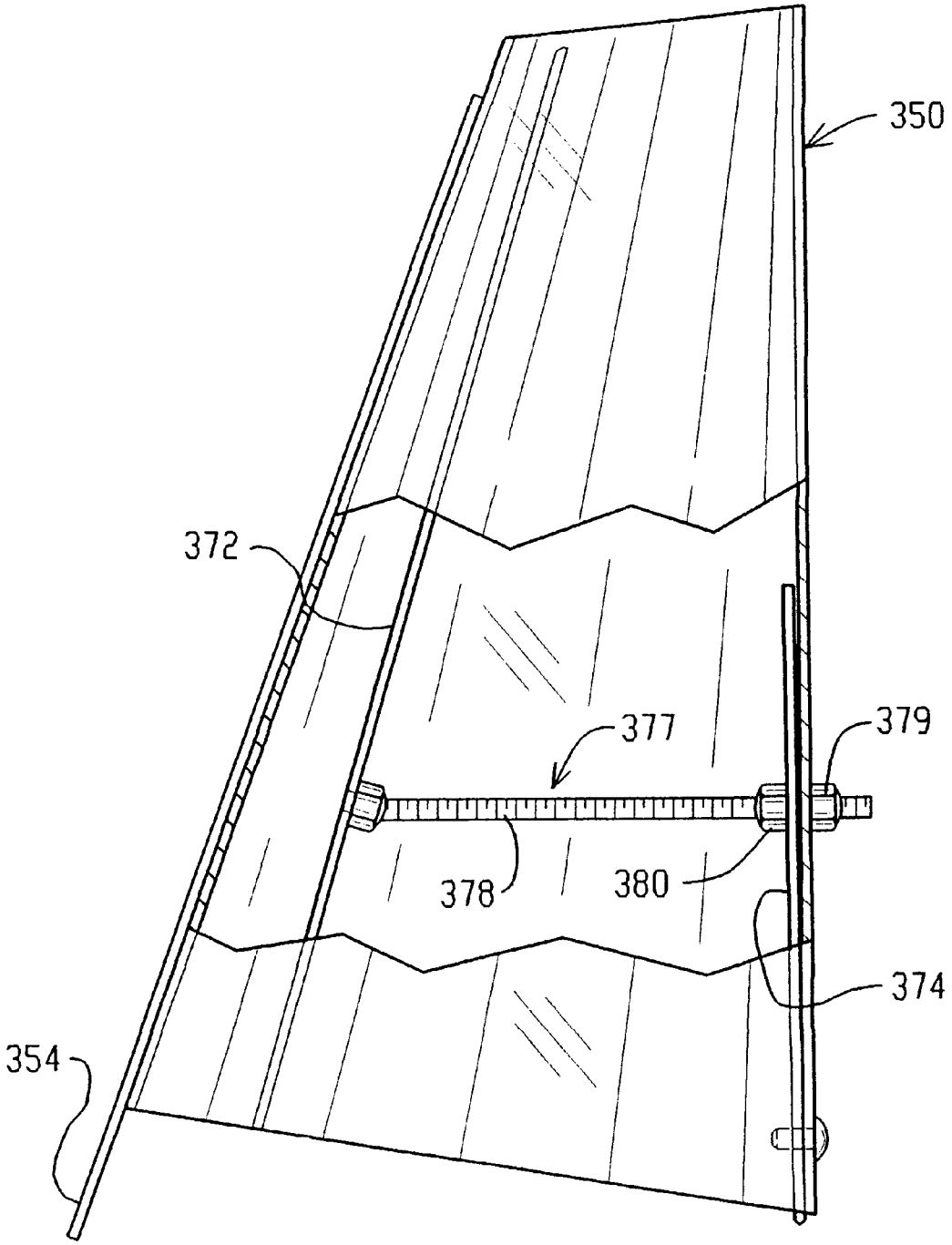
FIG. 29A is an enlarged portion of FIG. 29, with part thereof broken away to illustrate an adjustment device.
Figure 30:
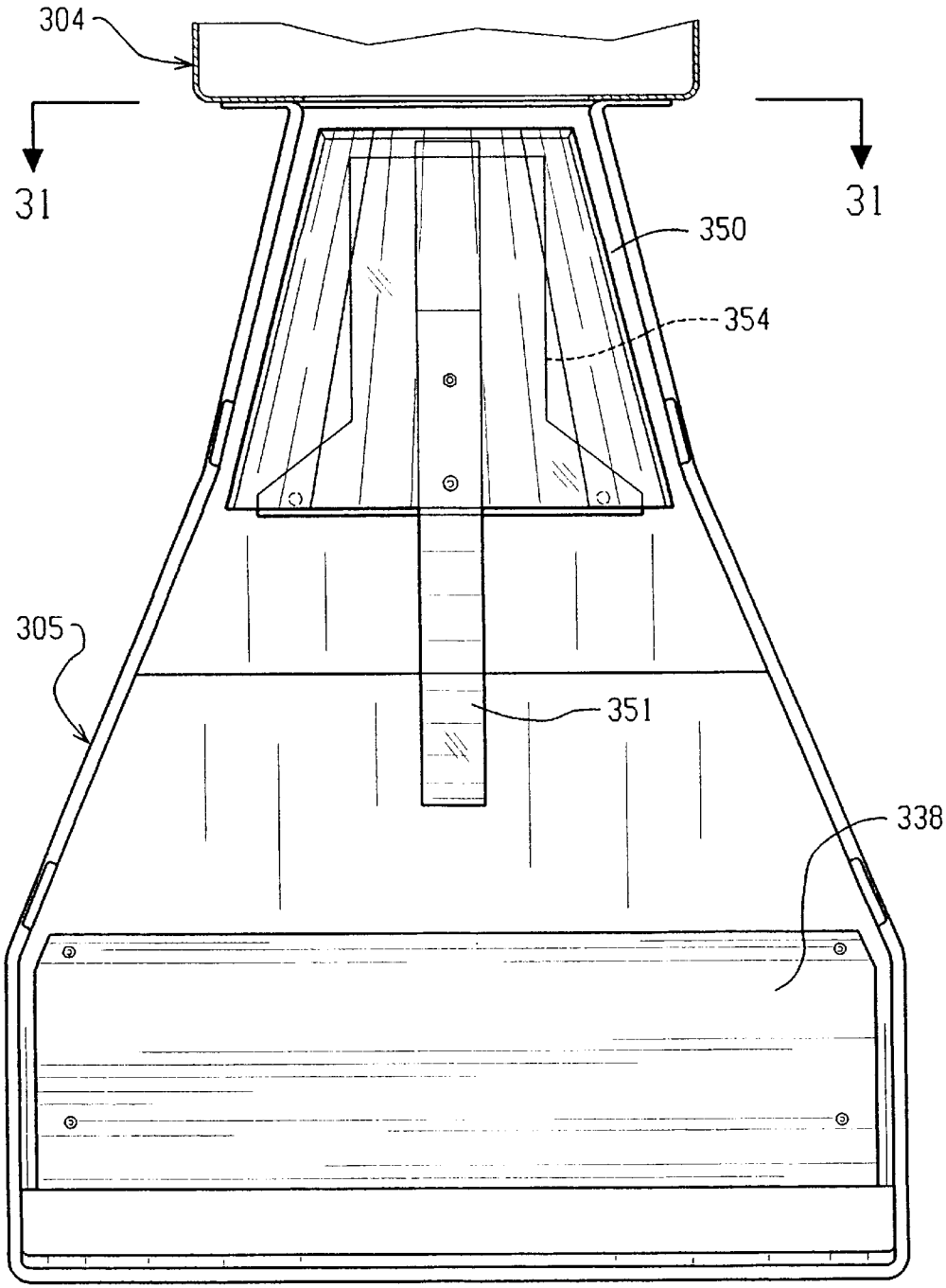
FIG. 30 is a longitudinal sectional view taken substantially along the line 30—30 of FIG. 29.
Figure 31:
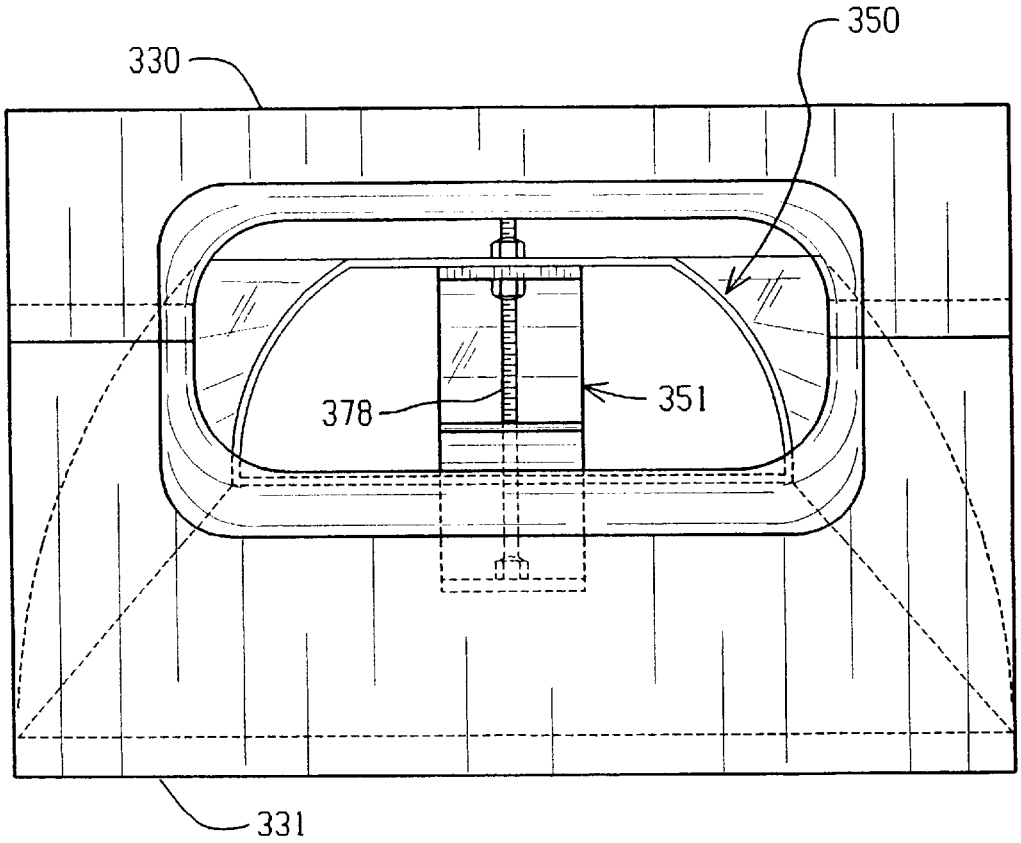
FIG. 31 is a transverse cross-sectional view taken substantially along the line 31—31 of FIG. 29.

The lower leg 372 of the forming member 351 extends generally parallel to the bottom wall 360 of the shaping chute and consequently the sloped wall portion 355 of the bottom wall of the shell base 331. However, the relative inclination and spacing between the lower leg of the forming member and bottom wall of the shaping chute may be adjusted as needed to obtain proper shaping and forming of the lateral edges of the stock material into the relatively low density pillow like portions with the inner edges being overlapped for connection by the feed/stitching mechanism in the front unit. Such adjustment may be effected and then maintained by an adjustment device 377 which, as best shown in FIG. 29A, extends between the legs of the forming member at a point midway along the length of the lower leg, it being noted that the upper leg may be shorter as only sufficient length is needed to provide for attachment to the top wall of the shaping chute. The adjustment device in the illustrated embodiment consists of a threaded screw 378 having a bent lower end threaded into a tap bore in the lower leg 372 of the forming member and locked in place by a lock nut. The upper end of the adjustment rod extends through a hole in the top wall of the shaping chute as well as through a hole in the upper leg of the forming member and is held in place by opposed adjustment nuts 379 and 380 threaded on the rod on opposite sides of the top wall of the forming chute. The nuts may be loosened, the rod shifted axially and then the nuts retightened to adjust the gap between the lower leg of the forming member and the bottom wall of the shaping chute.

As is preferred, the lower leg 372 of the forming member 351 extends to a point approximately coterminous with the exit end of the shaping chute 350. The rearward portion of the forming member preferably projects rearwardly of the entry end of the shaping chute by approximately one-half its overall length. Also, the radius of the rounded base or bight portion 370 of the forming member preferably is approximately one-half the height of the mouth of the shaping chute. This provides for a smooth transition from the separating members of the separating device to the forming member and then into the shaping chute.

The forming member 351 is of relatively uniform width. The forming member may be formed, for example, by bending an elongate elastic strip to the shape illustrated in FIG. 33. In the illustrated embodiment, the width of the strip is approximately one quarter the width of the exit opening of the shaping chute which in turn is approximately two-thirds of the entry mouth of the shaping chute. The forming member may be otherwise configured. For example, the rearward end portion may be wider than the forward end portion. Moreover, the transition from the narrow forward portion to the wide rear end portion may be progressive such that the lower leg of the forming member has a triangular shape. Similarly, the top leg may have a triangular shape while the rounded bight portion of the forming member may be relatively uniform in width or of reverse hour-glass shape.

Figure 32:
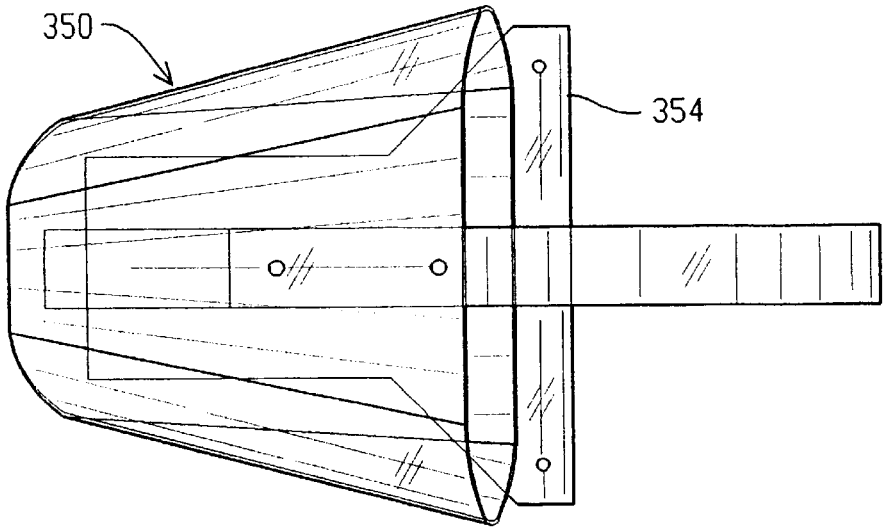
FIG. 32 is an enlarged plan view of the forming chute and member assembly employed in the conversion machine of FIG. 27.
Figure 33:
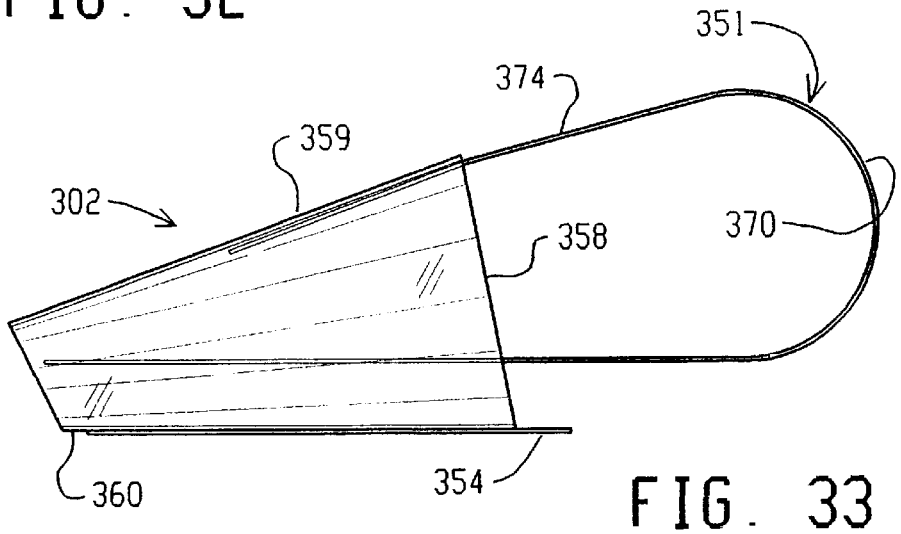
FIG. 33 is a side elevational view of the forming chute and member assembly of FIG. 32.

As will be appreciated by those skilled in the art, the shaping chute and forming member assembly 302 shown in FIGS. 32 through 34 may have general application in cushioning conversion machines such as in the cushioning conversion machines shown in U.S. Pat. Nos. 4,968,291 and 5,123,889.

Referring now to FIGS. 35–38, an interlock mechanism is indicated generally at 385. This interlock mechanism is particularly useful in the conversion machine 20 as protection against feeding of the stock material if the cover 37 of the rear unit 31 has been removed or is not properly secured in place. To this end, an interlock switch 387 and actuating plunger 388 are respectively secured to the housing 43 of the front unit 30 and the cover 37 of the rear unit 31. The interlock switch may be mounted, for example, by a bracket 389 to one of the side frame members 92 of the housing with its plunger receiving end opening rearwardly generally flush with the rear wall 390 of the front unit shell 44. The actuating plunger 388 is mounted to the flange 74 at the front end of the cover of the rear unit at a location corresponding to the actuating switch such that when the cover is secured to the base of the rear unit the actuating plunger actuates the interlock switch to close a circuit which enables operation of the feed/stitching mechanism. More particularly, the interlock switch may be connected in series with the motor or, as an alternative, the interlock switch may control a relay connected in series with the motor such that the relay must be closed to enable operation of the motor. Of course, other electrical schemes or devices may be employed to effect the interlock in response to mating engagement of the interlock switch and actuating plunger when the cover is properly secured in place, or other mating key and lock devices.

Figure 39:
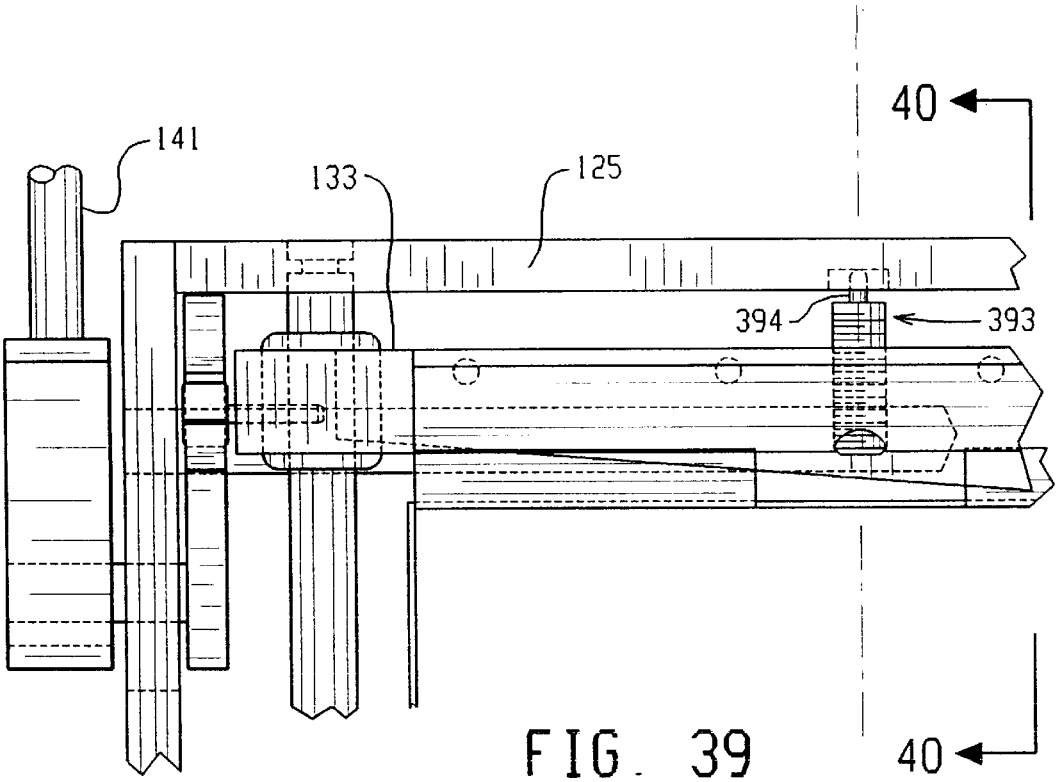
FIG. 39 is a fragmentary sectional view of the front unit showing use of a spring plunger mechanism in accordance with the invention.
Figure 40:
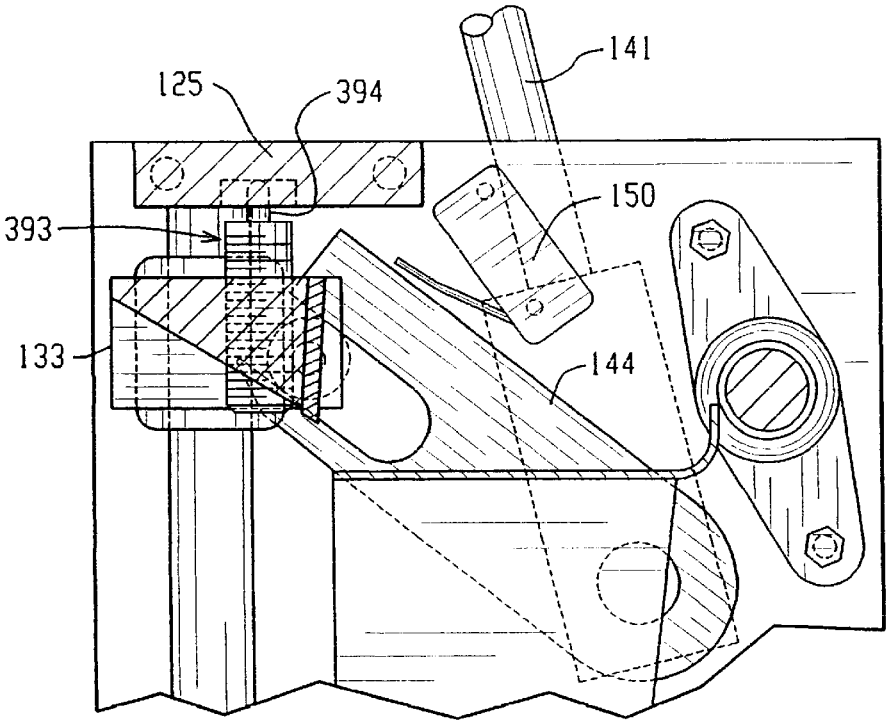
FIG. 40 is a fragmentary cross-sectional view taken along the line 40—40 of FIG. 39.

Referring now to FIGS. 39 and 40, a still further feature of the invention is illustrated in relation to the conversion machine 20. As shown, a spring loaded detent mechanism 393 is mounted to the moving blade carriage 133 preferably midway along the length thereof. The detent mechanism is orientated such that the plunger 394 thereof will be engaged and depressed by the transverse frame member when the moving blade carriage is moved to its uppermost position corresponding to when the slotted crank is rotated sufficiently to actuate the switch 150 for energizing the feed motor. The plunger 394 has a stroke sufficient to urge the blade carriage away from the transverse frame member a distance sufficient to cause the slotted crank 144 to move away from the switch 150 so that the switch is no longer actuated as best shown in FIG. 40. This is desirable as it avoids inadvertent feeding of product because it keeps the switch from being actuated when the machine is idle and no one is operating the handle. Thus, if the handle 141 is swung into its feed position and released, as might occur after a strip of product has been produced, additional product will not continue to be dispensed from the machine while the handle remains unattended. Rather, the detent mechanism will cause the handle to move out of its feed position thereby avoiding the possibility of any inadvertent or unattended feeding of product.

As will be appreciated, the detent mechanism 393 could be otherwise positioned in the machine to accomplish the same result, such as by positioning the detent mechanism such that it acts directly on the slotted crank. Another possibility is to select a switch that has return spring element capable of moving the slotted crank away sufficiently to deactuate the switch. Still other arrangements too numerous to mention may be employed to attain in a variety of ways the desired function of preventing actuation of the switch when the handle or machine is unattended.

Figure 43:
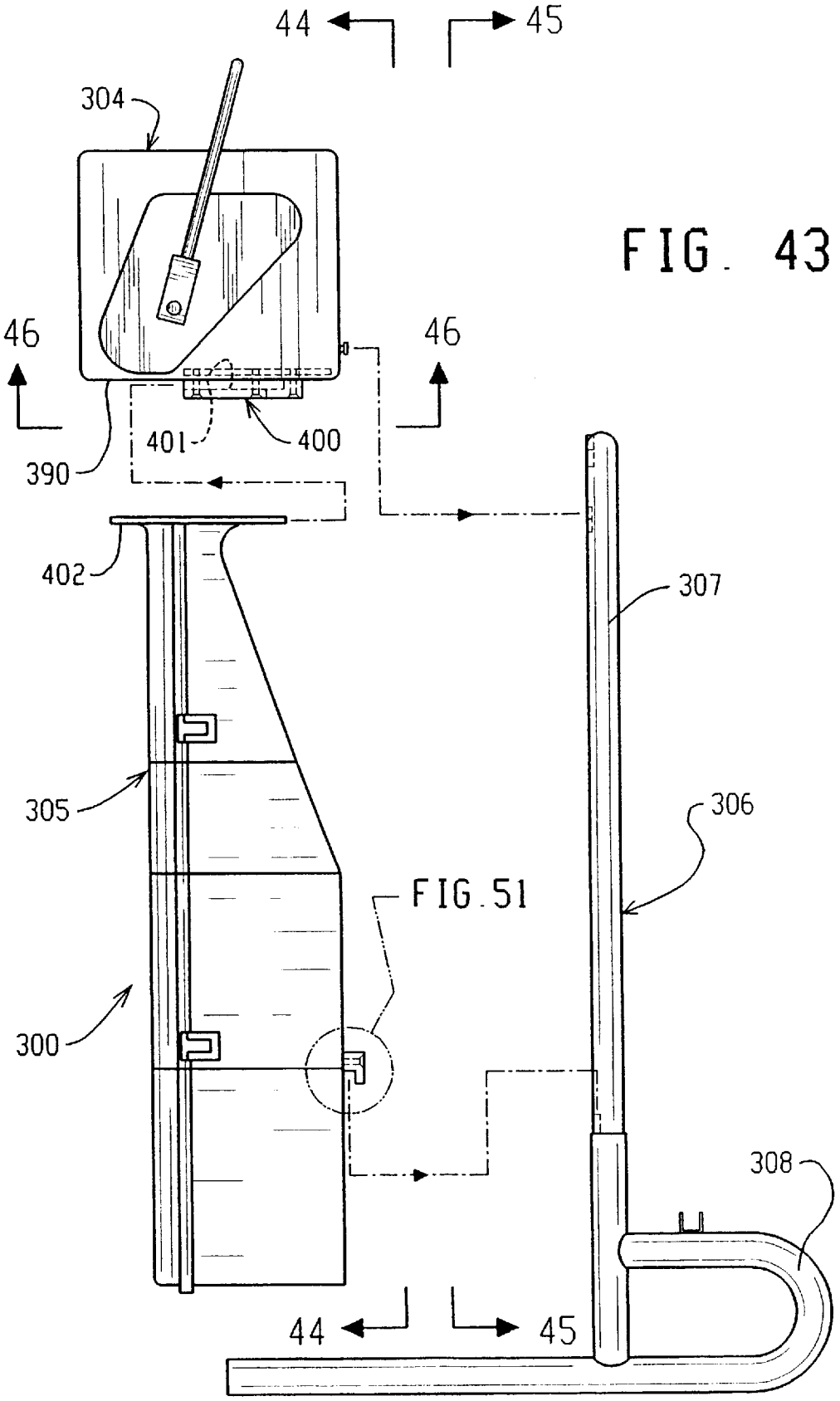
FIG. 43 is an exploded side elevational view of the cushioning conversion machine and support stand of FIG. 27, as modified to provide for quick manual attachment of the machine to the stand without the need for tools.
Figure 44:
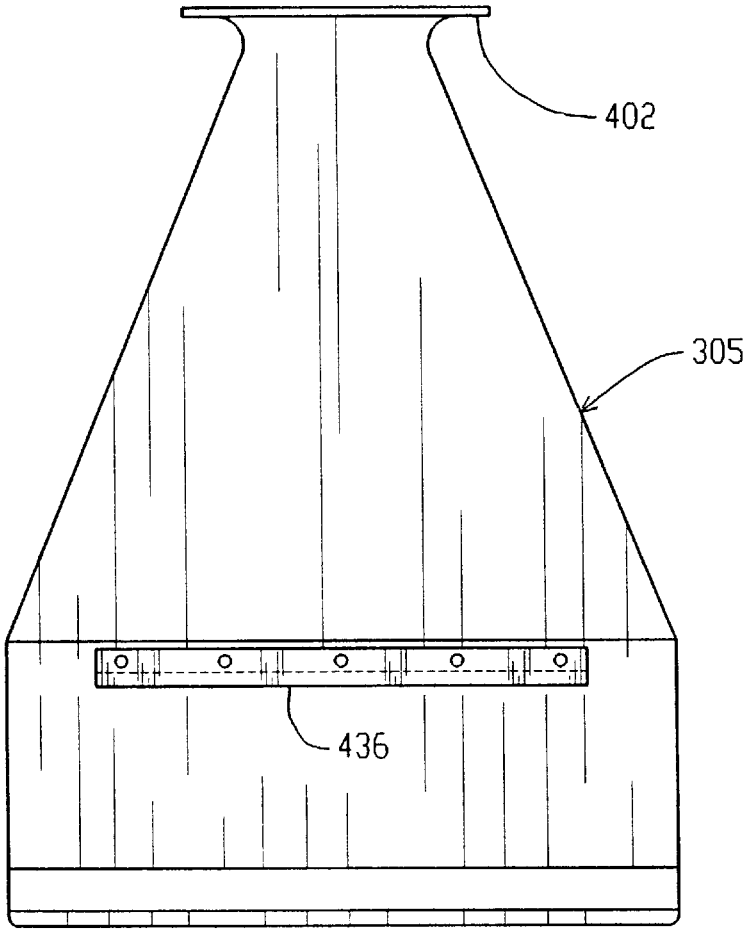
FIG. 44 is another exploded elevational view of the modified conversion machine, looking from the line 44—44 of FIG. 43.
Figure 45:
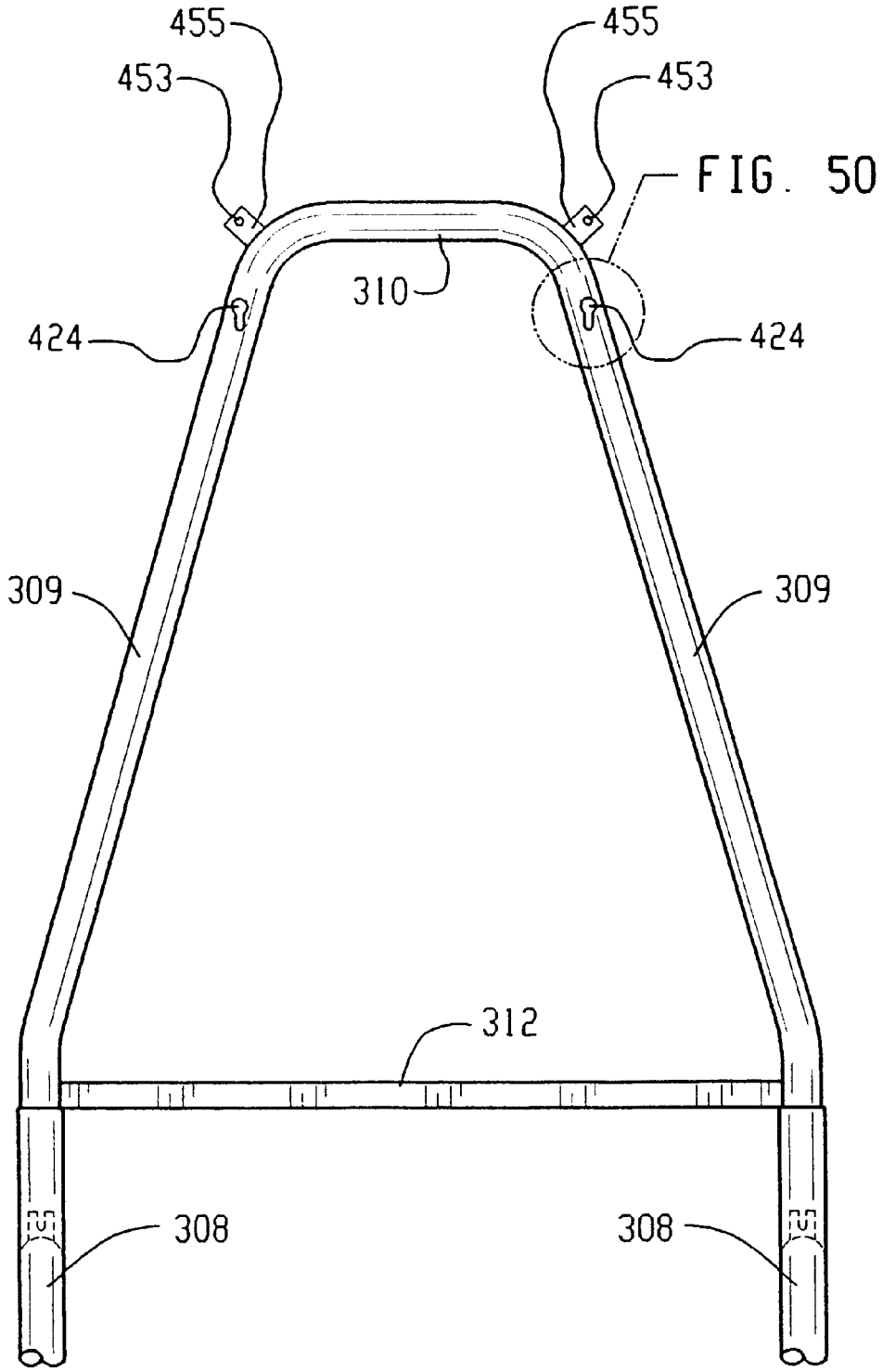
FIG. 45 is another elevational view of the modified stand, looking from the line 45—45 of FIG. 43.

Referring now to FIGS. 43–45, the cushioning conversion machine 300 and support stand 306 are shown as modified in accordance with the present invention to provide for quick and easy assembly of the front and rear units 304 and 305 and their attachment to the stand without the need for tools. As shown, the front unit 304 of the machine has at the rear wall 390 thereof a pocket structure 400 which forms a slot 401 for slidably receiving the flange 402 at the forward end of the rear unit 305. The flange 402 is slidable into and out of the slot in a direction perpendicular to the longitudinal axis of the machine. The pocket structure 400 and the flange 402 cooperate to hold the front and rear units together against separation in a direction parallel to the longitudinal axis of the machine.

Figure 46:
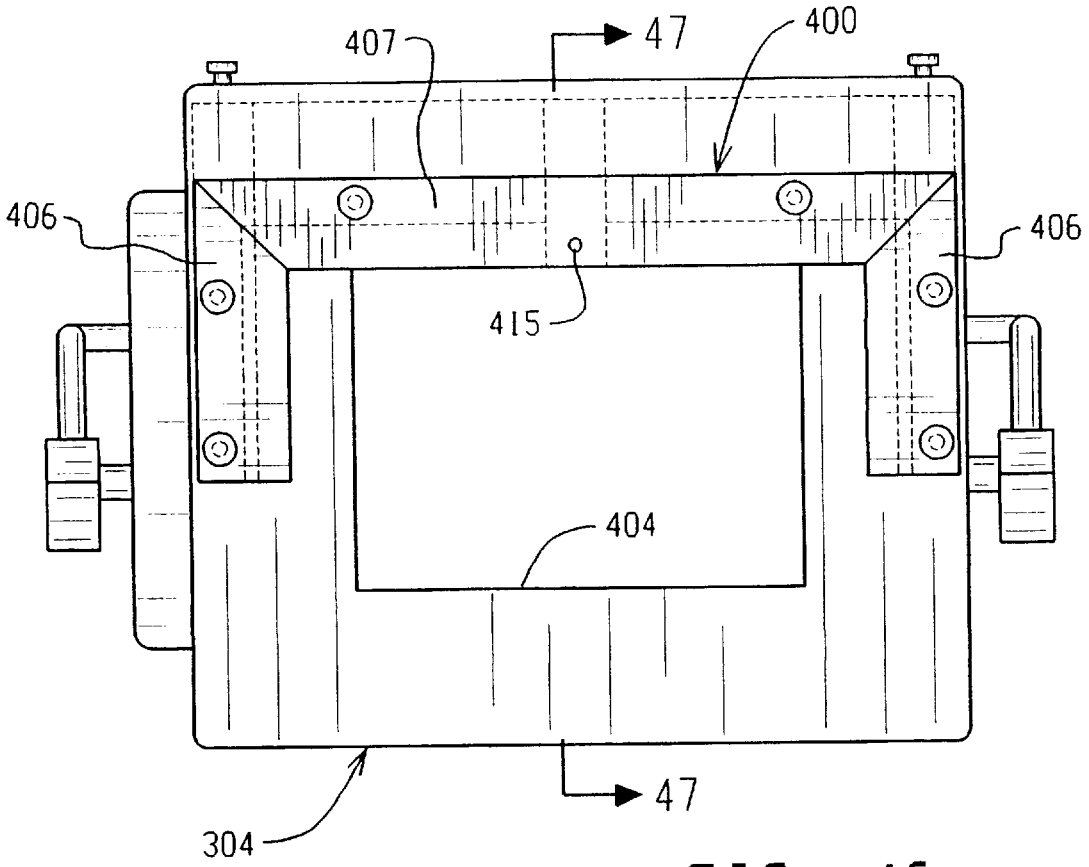
FIG. 46 is an enlarged bottom plan view of the front unit of the conversion machine, looking from the line 46—46 of FIG. 43.
Figure 47:
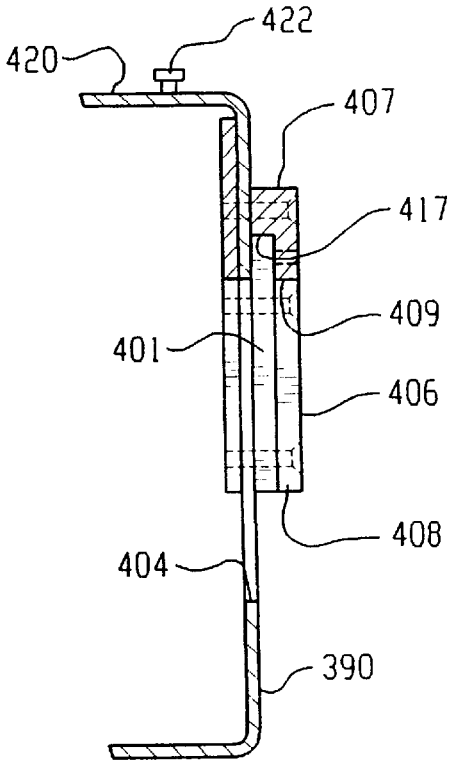
FIG. 47 is a fragmentary cross-sectional view through the front unit taken along the line 47—47.
Figure 48:
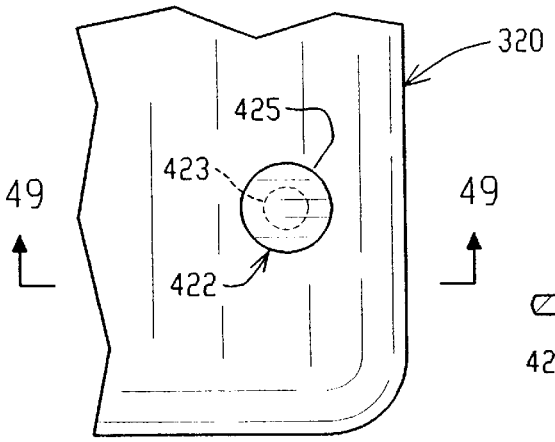

As best shown in FIGS. 46 and 47, the pocket structure 400 forms with the rear wall 390 of the front unit 304 a U-shape pocket with the bight of the U being generally coextensive with the inlet opening 404 of the front unit. The pocket structure 400 generally comprises a pair of laterally spaced apart side members 406 and an end member 407 extending between the side members 406. The side and end members 406 and 407, which may be made of metal, plastic or other suitable material, are generally L-shape in cross-section, with one leg of the L being secured to the rear wall 390 by suitable fasteners (or other suitable means) and the other lip forming a rail or lip 408, 409 spaced from the rear wall 390 to form respective sides of the slot 401. The slot 401 preferably opens in a direction away from the side of the front unit that is attached to the stand 306 in the hereinafter described manner. As is preferred, a backing plate made of metal or other stiff material may be used to stiffen the rear wall 390 and further to provide an anchor for fasteners such as bolts or screws used to secure the side and end members to the rear wall, with the bottom wall being sandwiched between the side and end members and the backing plate as shown.

As shown in FIGS. 46 and 47, the end member 407 is provided with a threaded hole 415 in the lip thereof for receiving a thumb screw (not shown in FIGS. 46 and 47). The flange 402 of the rear unit 305 has a hole 416 therein which aligns with the hole 415 when the flange is fully inserted into the slot 401 against the back wall 417 of the slot 401, whereby the thumb screw may be threaded into the aligned holes to lock the flange against withdrawal from the slot. As preferred, a thumb screw is used to avoid the need for tools, although it will be appreciated that other types of screws or fasteners may be used, including those that may need a tool for use although less desirable. By way of further specific example, one or more manually operated latches may be used to hold the flange of the rear unit to the front unit. As a further alternative, the thumb screw that is threaded into the aligned openings in the flange and end member 407 may be replaced by a spring biased plunger that may be retracted against the spring bias to permit sliding of the flange into or out of the slot and extended to pass through the openings when aligned thereby to lock the flange in the slot.

Accordingly, the front unit 304 may be assembled with respect to the rear unit 305 in an easy and simple manner without the need for tools.

Figure 48:
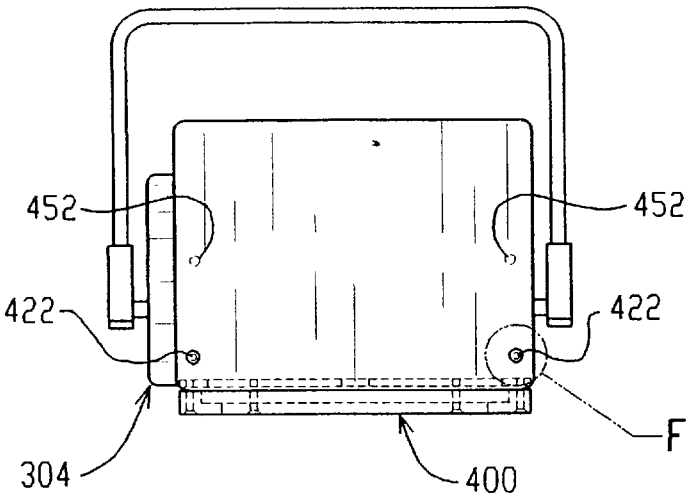
FIG. 48 is an enlarged fragmentary portion of FIG. 44.
Figure 49:
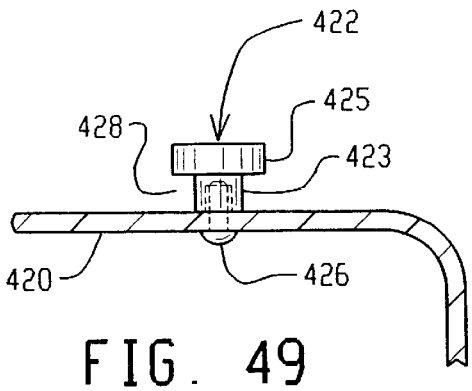
FIG. 49 is a fragmentary cross-sectional view taken along the line 49—49 of FIG. 48.

In addition, the front and rear units of the machine 300 may be easily and quickly attached to the upright or frame portion 307 of the stand 306 again without the need for tools. As shown in FIGS. 43, 44 and 47–49, the front unit 304 is provided at its bottom or base wall 420 with catches 422 that engage in keyholes 424 in the frame portion 307 of the stand 306. As illustrated in FIGS. 48 and 49, each catch 422 may be in the form of a peg having a stem 423 and an enlarged head 425. The stem portion has a threaded hole in the end thereof opposite the head portion for receiving a fastener 426 whereby the peg may be secured to the bottom wall 420 of the front unit shell 320 as illustrated in FIGS. 48 and 49. The stem spaces the head away from the bottom wall to form an annular hook bight 428 for engaging in the keyhole slot 424.

Figure 50:
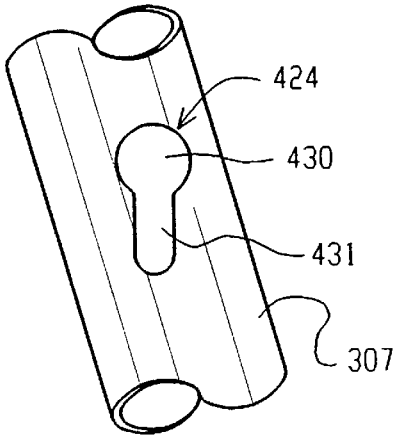
FIG. 50 is an enlarged portion of FIG. 45.

As best shown in FIG. 50, each keyhole 424 is formed in the wall of the tube bent to form the frame 307. Each keyhole has an enlarged circular upper portion 430 sized to receive therein the head of the respective peg and a relatively narrow lower slot portion 431. The lower slot portion 431 is sufficiently wide to receive the stem of the respective peg but is too narrow to permit passage therethrough of the head of the peg. As shown in FIG. 45, the stand is provided with two such keyholes symmetrically disposed with respect to the longitudinal axis of the stand for receiving respective correspondingly aligned pegs 422 on the front unit.

Figure 51:
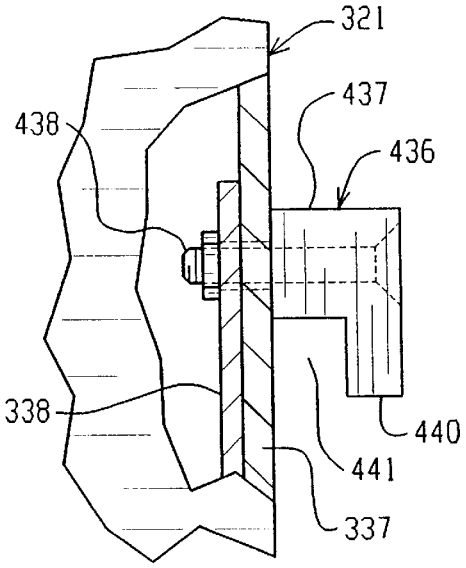
FIG. 51 is an enlarged portion of FIG. 43, partly broken away in cross-section.

Provision is also made for hanging the rear unit 305 on the frame portion 307 of the stand 306. As shown in FIGS. 43, 44 and 51, the rear unit is provided with a transversely extending hook member 436 secured to the bottom wall 337 of the rear unit shell 321. The transversely extending member is in the form of a bar of L-shape cross section having an upper leg 437 attached by a plurality of fasteners 438 (or other suitable means) to the bottom wall 337. As shown in FIG. 51, the fasteners 438 extend through the bottom wall 337 and also through the stiffening member 338, it being noted that the shell may be made of plastic of a thickness that may not have sufficient strength to preclude bending thereof when the rear unit is supported on the stand. The transverse hook member also has a lower leg or lip 440 spaced from the bottom wall 337 of the rear unit shell to form the bight 441 of a hook in which the transverse cross frame member 312 of the stand may be engaged. In this manner the rear unit may be hung from the cross frame member 312 of the stand, which cross frame member functions as a catch for the hook member.

Figure 52:
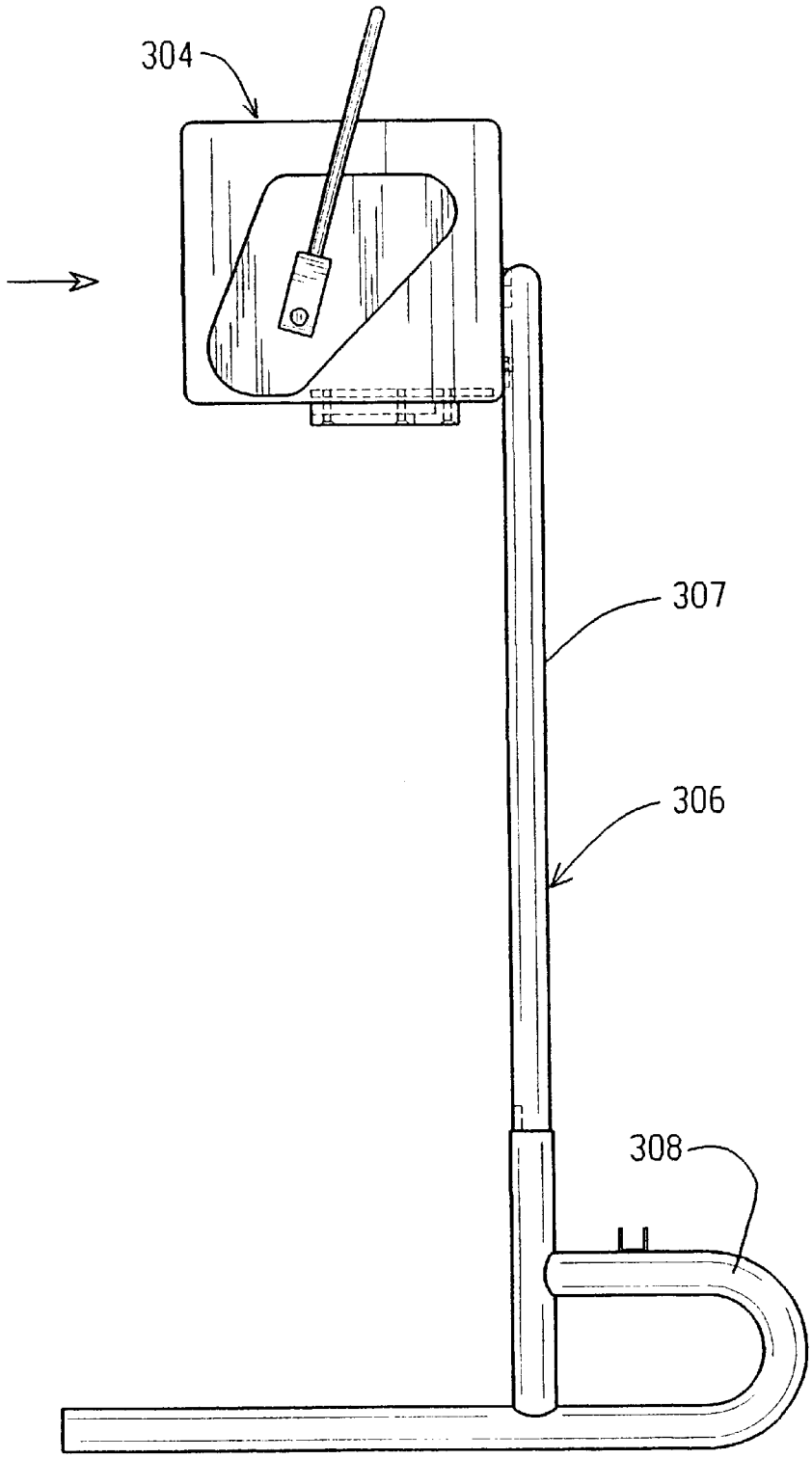
Figure 53:
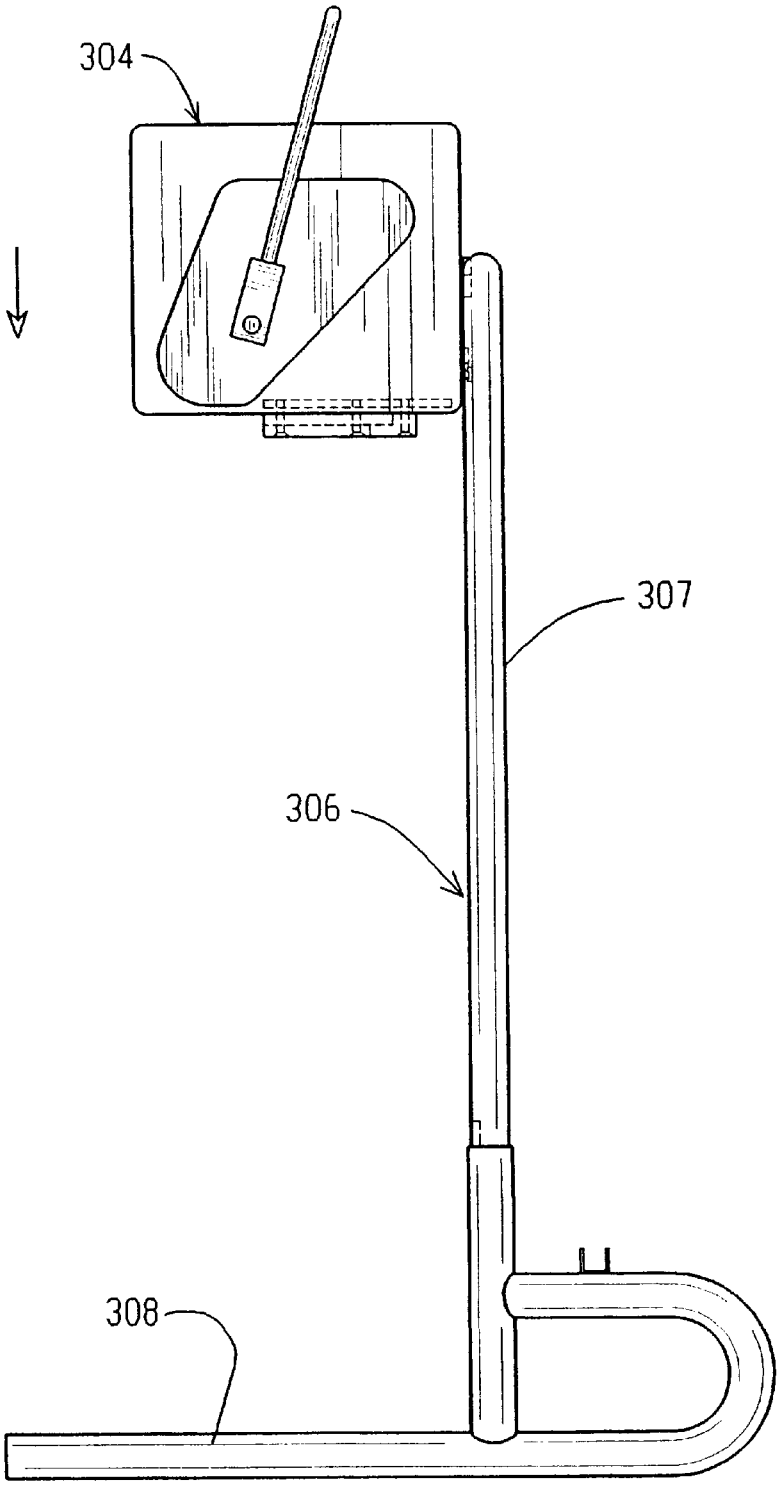

Turning now to FIGS. 52 through 60, the method of assembling the machine 300 on the stand 306 is illustrated. As shown in FIG. 52, the front unit 304 is initially attached to the stand 306. This is done by positioning the front unit 304 adjacent the stand 306 with the enlarged heads of the pegs 422 being aligned with and then inserted into the upper portions of the keyholes. Then, the front unit is lowered as shown in FIG. 53 whereupon it will be supported by the stand.

Figure 54:
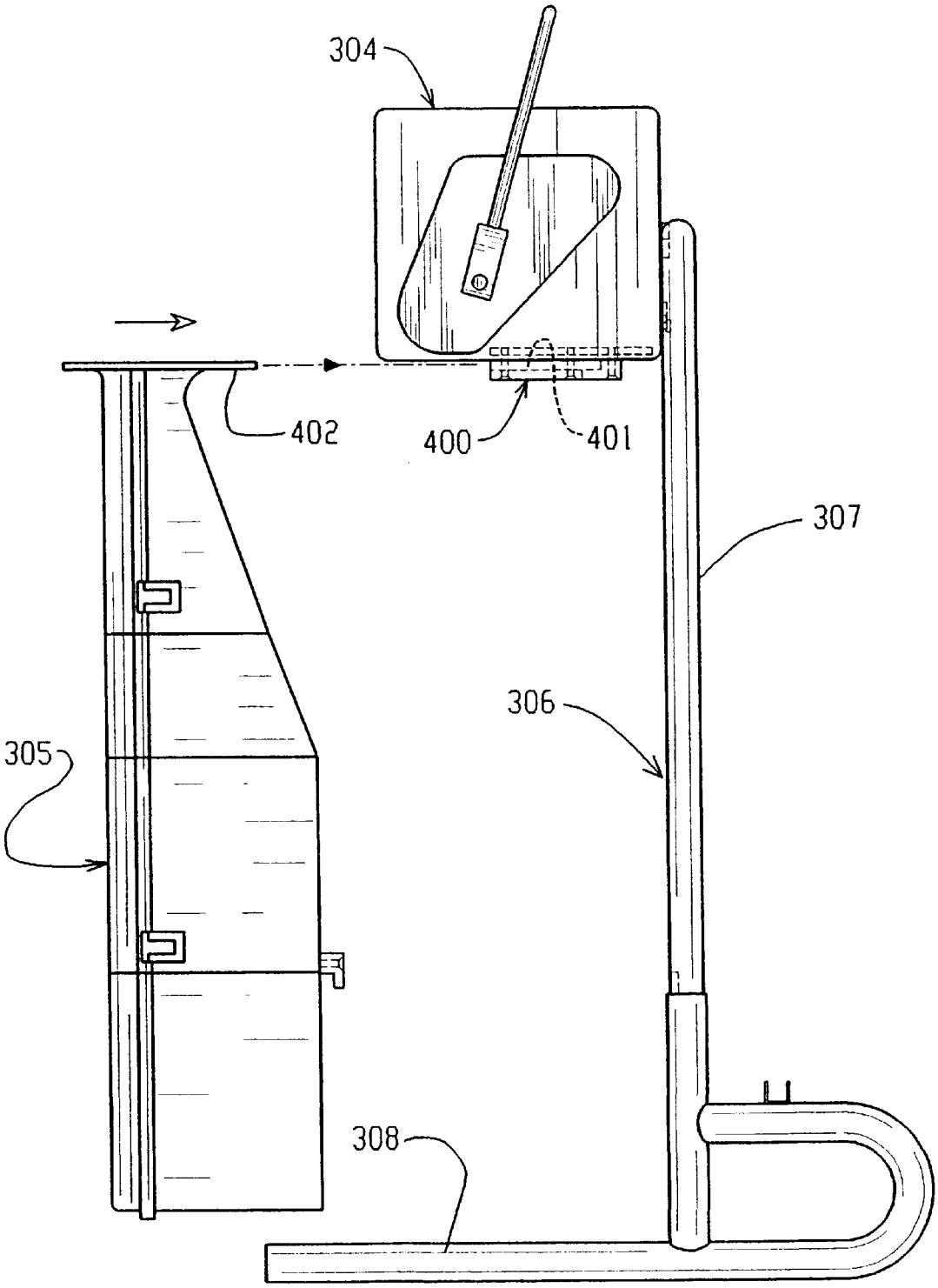
Figure 59:
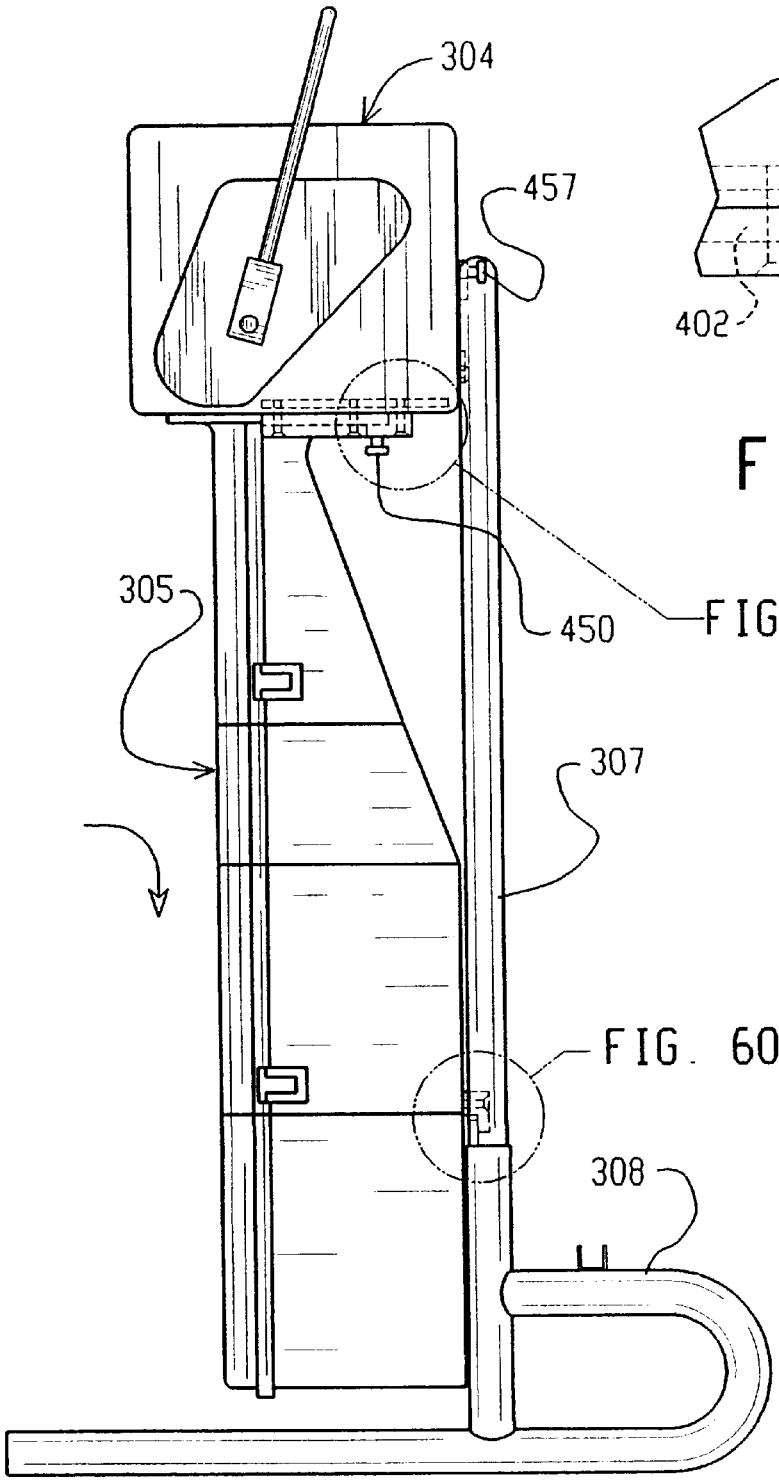
Figure 59A:
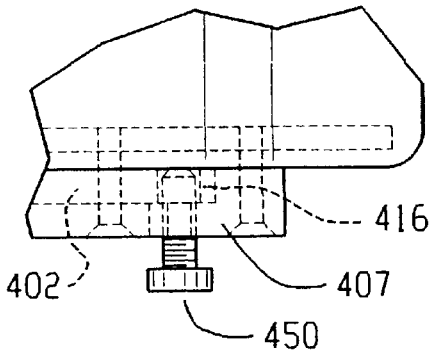
Figure 60:
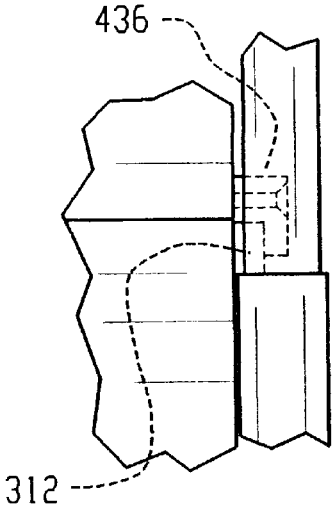

Next, the flange 402 of the rear unit 305 is horizontally aligned with the slot 401 in the front unit 304 and then moved towards the stand 306 with the flange sliding into the slot as depicted in FIG. 54. When the flange has almost been fully inserted into the slot at the rear wall of the front unit, the hook member 436 on the rear unit will be butted against the transverse cross frame member 312 of the support stand frame 307, as shown in FIGS. 55 and 56. At this point, the front and rear units are shifted upwardly sufficiently to raise the hook member above the transverse frame member as shown in FIGS. 57 and 58 so that the rear unit can then be shifted toward the frame portion of the stand and then lowered to engage the hook on the transverse frame member as shown in FIGS. 59 and 60. Then, as shown in FIG. 59A, a thumb screw 450 is screwed into the then aligned hole 415 in the flange 402 and hole 416 in the pocket structure 400 of the front unit to prevent the flange from being withdrawn from the slot during use. Also, to prevent the machine from accidently being lifted off of the frame portion 307 support stand 306, the front unit is provided with threaded holes 452 (FIG. 48) that are aligned with holes 453 (FIG. 45) in attachment ears 455 provided on the support stand as shown in FIG. 45. Thumb screws 457 may be passed through the attachment ears and secured in the threaded holes 452 in the front unit to lock the front unit against longitudinal movement relative to the frame portion of the support stand.

Figure 61:
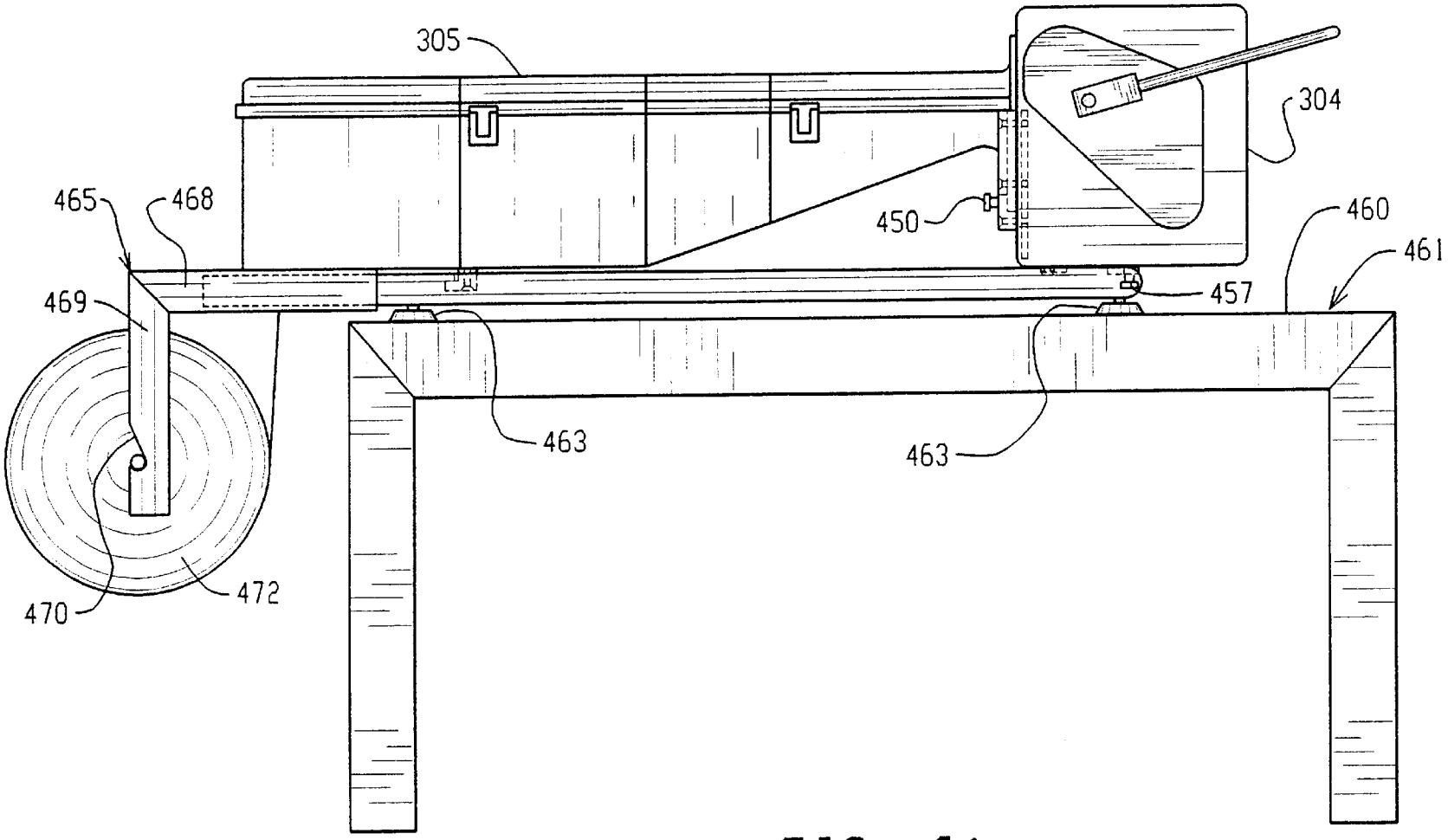
FIG. 61 is a side elevational view showing the conversion machine and stand in a horizontal orientation supported atop a table with the feet of the stand replaced by roll hanger members.

Referring now to FIG. 61, it will be seen that the machine 300 assembled to the frame portion 307 of the stand 306 as above described may be used other than in a vertical orientation. As shown in FIG. 61, the machine 300 and frame portion 307 may be supported on the top surface 460 of a table 461 preferably by suction cups or similar holding devices which prevent shifting of the machine across the top of the table. In this arrangement, the feet 308 (FIG. 43), normally used to hold the frame portion 307 upright, are replaced by stock roll holding members 465. As shown, the stock roll holding members are generally L-shape with each holding member being attached to a respective leg of the frame portion of the stand in place of the foot 308. As shown, one leg 468 of the L-shape holding member is formed by a tubular piece that may be telescoped over the respective leg of the frame member. The other leg 469 is provided with a cradle forming slot 470 for receiving the end of a roll holder such as an axle extending through the core of the stock roll 472 supported thereon. As will be appreciated, the stock roll is supported in cantilever fashion at the side of the table with its weight counterbalanced by the weight of the front unit supported on the table.

Referring now to FIGS. 62–66, another embodiment of cushioning conversion machine is generally indicated by reference numeral 500. The machine 500 is for the most part the same as the above described machine 300 except for the differences that are hereinafter described. Otherwise, reference may be had to the description of the machine 300 (and consequently the above description of machine 20) for details of the machine 500 that are not hereinafter described or mentioned.

Accordingly, the machine 500 comprises a rear or former unit 504 and a front or head unit 505. The former and head units are coupled together by quick connect/disconnect structure 507 which provides a strong union between the former and head. As may be desired, the machine thus coupled may be supported atop a table or other horizontal (or even inclined) surface without the frame described above in connection with FIG. 61. As shown, the then bottom wall 508 of the outer shell 509 of the head unit 505 is equipped with rubber or plastic feet 510, or other anti-skid devices, to prevent shifting of the machine across the top of a table. The lower or base portion of the shell of former unit 504, which is more completely shown in FIG. 64, may be similarly equipped with anti-skid devices such as rubber or plastic feet 511, these feet being provided on the bottom wall 512 of the former's shell base which is coplanar with the bottom wall of the head's shell base when the former and head are assembled together.

The quick connect/disconnect structure 507 includes a flange 514 at the forward end of the base portion 515 of the external shell 516 of the former unit 504. The flange 514 is transversely slidable into and out of an upwardly opening, laterally extending slot or pocket 518 in the head unit 505. The pocket 518 is formed between an outwardly offset rim portion 519 of the back wall 520 of the shell 509 of the head unit and a laterally extending back plate 522. The back plate 522 extends between and is secured at its ends to the side plates 523 and 524 of the frame 525 of the head unit 505. The width and thickness of the pocket closely corresponds to the width and thickness of the flange 514 to provide a slip fit with a minimum of clearance for precise positioning and axial aligning of the former unit with respect to the head unit. Although not shown, one or more fasteners or other means may be used to fasten the back wall 520 to the back plate 522. Also provided is a fastener 527 having a knob for locking the flange in the pocket in essentially the same manner as described above in connection with the fastener 450, the threaded shank of the fastener being screwed into a threaded hole in the back plate that is aligned with holes in the flange 514 and rim portion 519.

Figure 62:
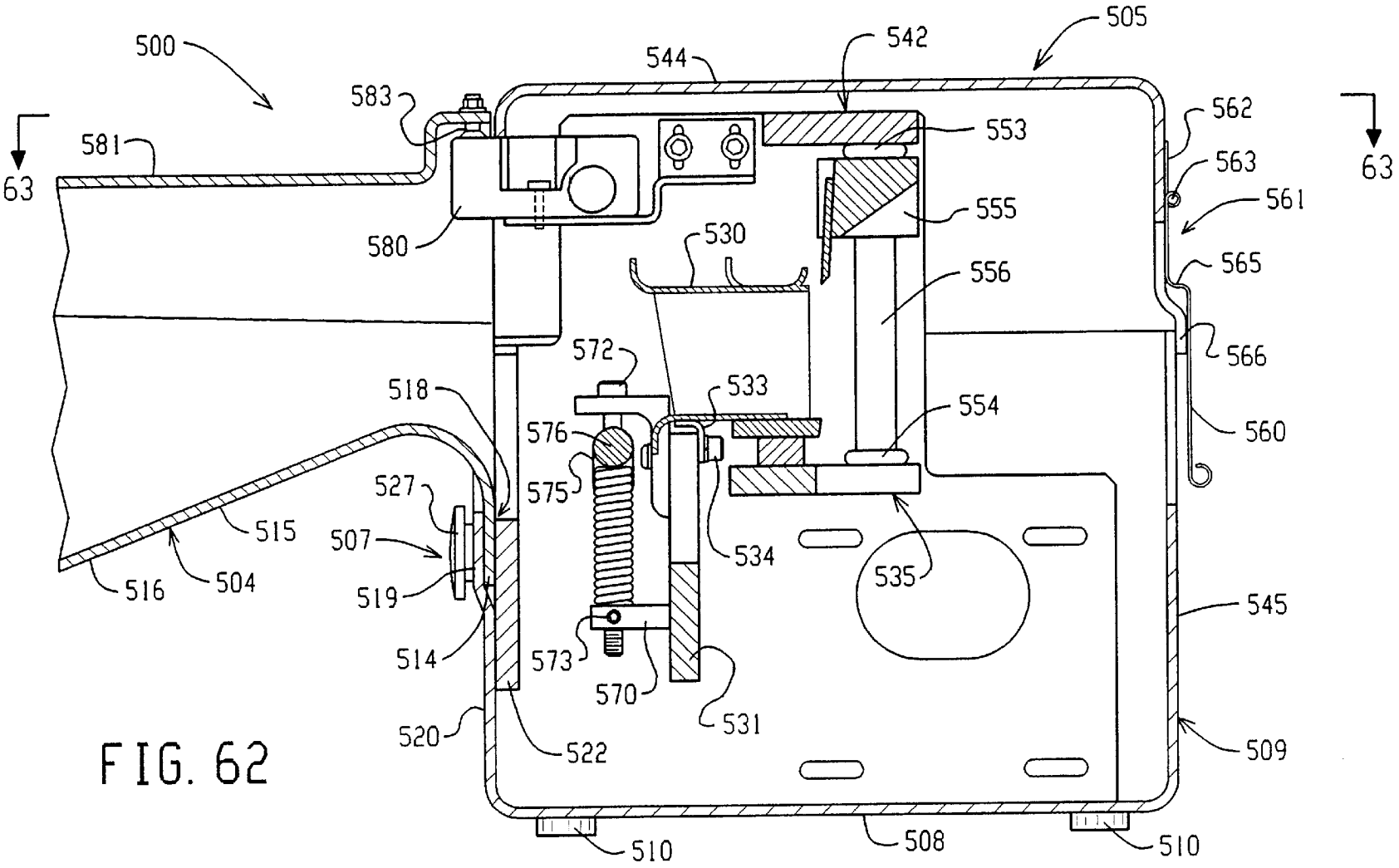
FIG. 62 is a fragmentary cross-sectional view of another embodiment of cushioning conversion machine including a shaper or former unit and a feed or head unit, with parts thereof removed to facilitate illustration of various modifications of the machine.
Figure 63:
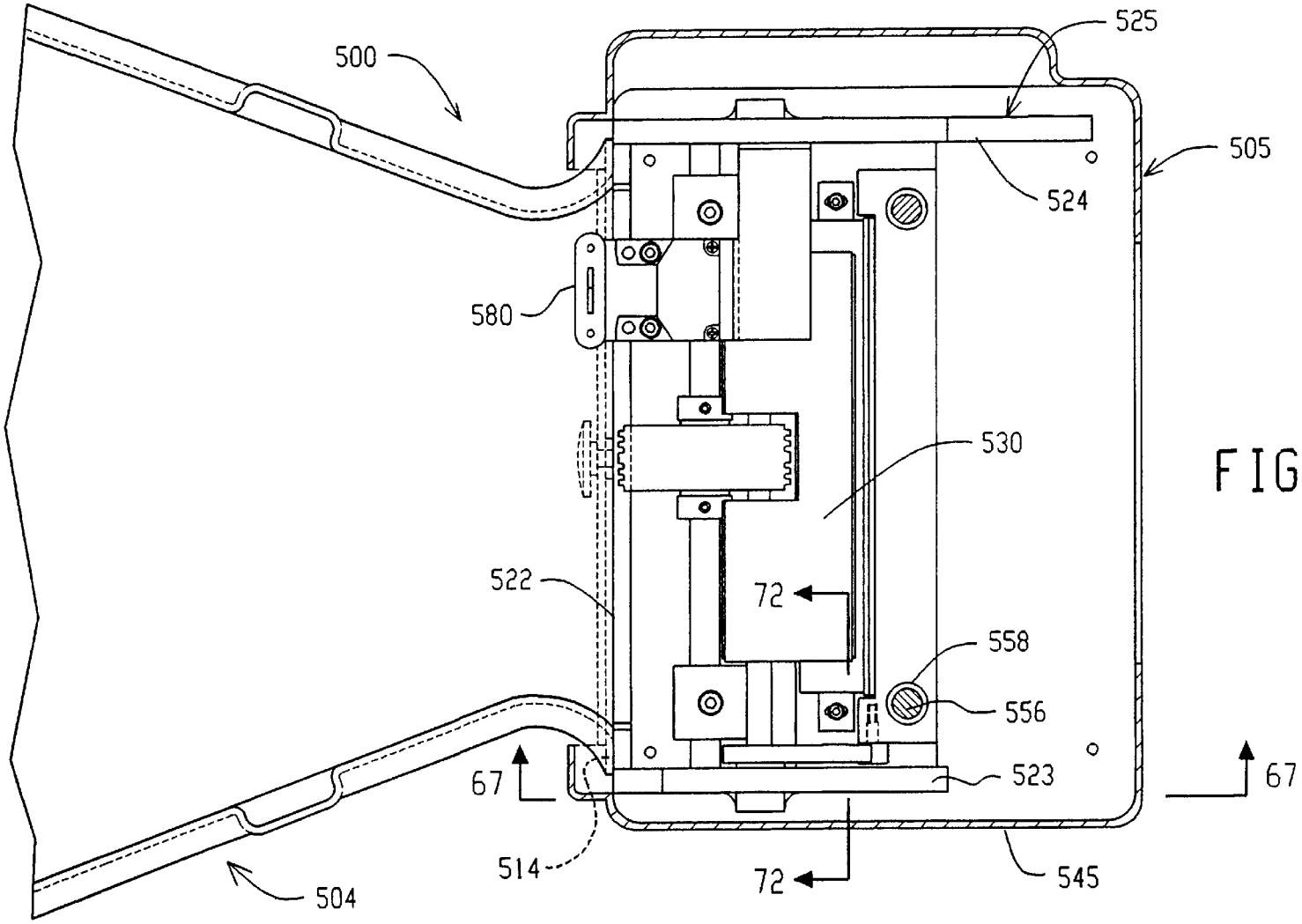
FIG. 63 is a plan view of the cushioning conversion machine of FIG. 62 looking from the line 63—63 and with the covers of the former and head units removed.

Several other modifications are illustrated in FIGS. 62 and 63. As shown, the guide chute 530, also referred to as a coining chute, may be attached to the cross frame member 531 by a bracket or brackets 533 and fasteners 534, as opposed to being included in the separately removable blade assembly 535 as was the case in the previously described embodiments.

Figure 67:
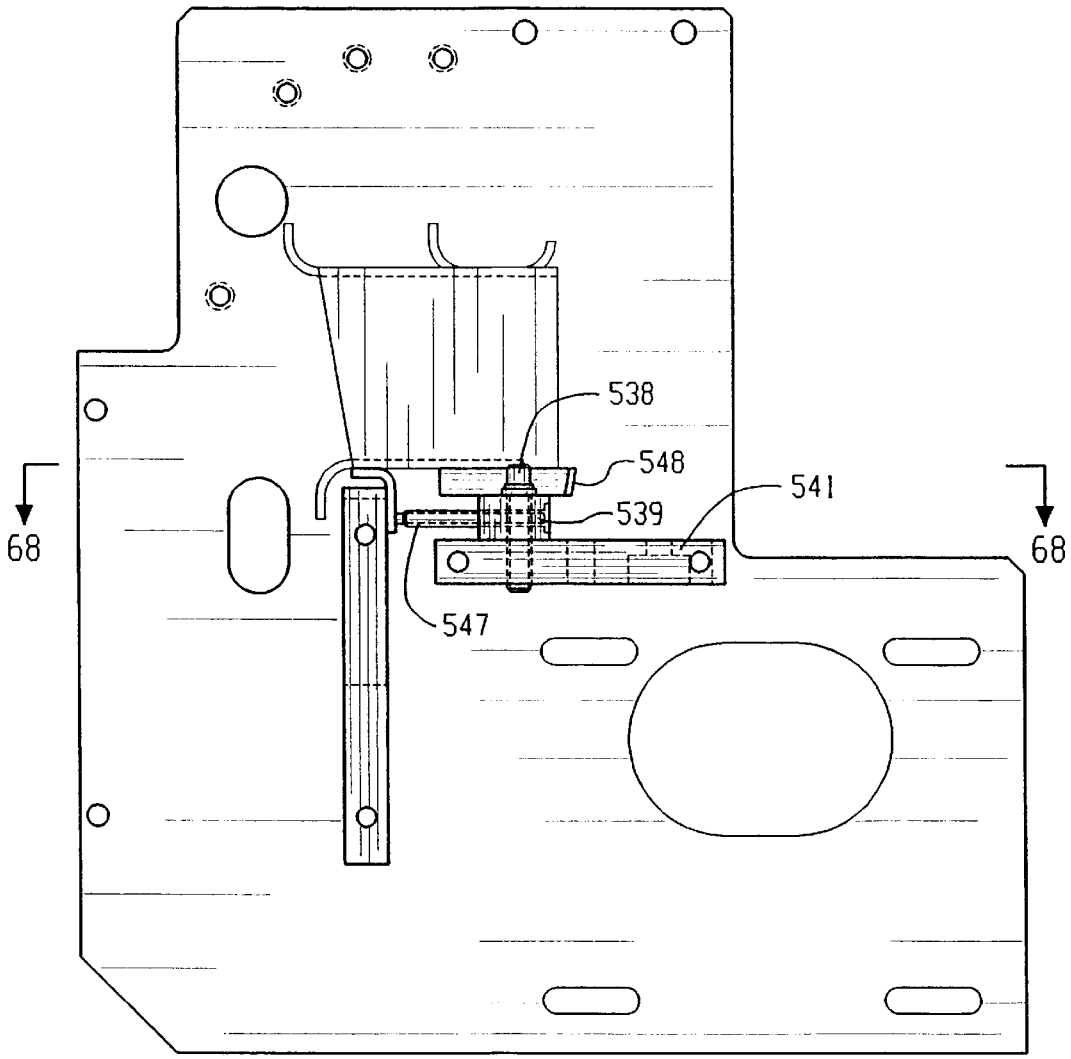
FIG. 67 is a cross-sectional view of the head unit of the machine of FIG. 62, taken along the line 67—67 of FIG. 63 and with parts removed for illustration purposes.
Figure 68:
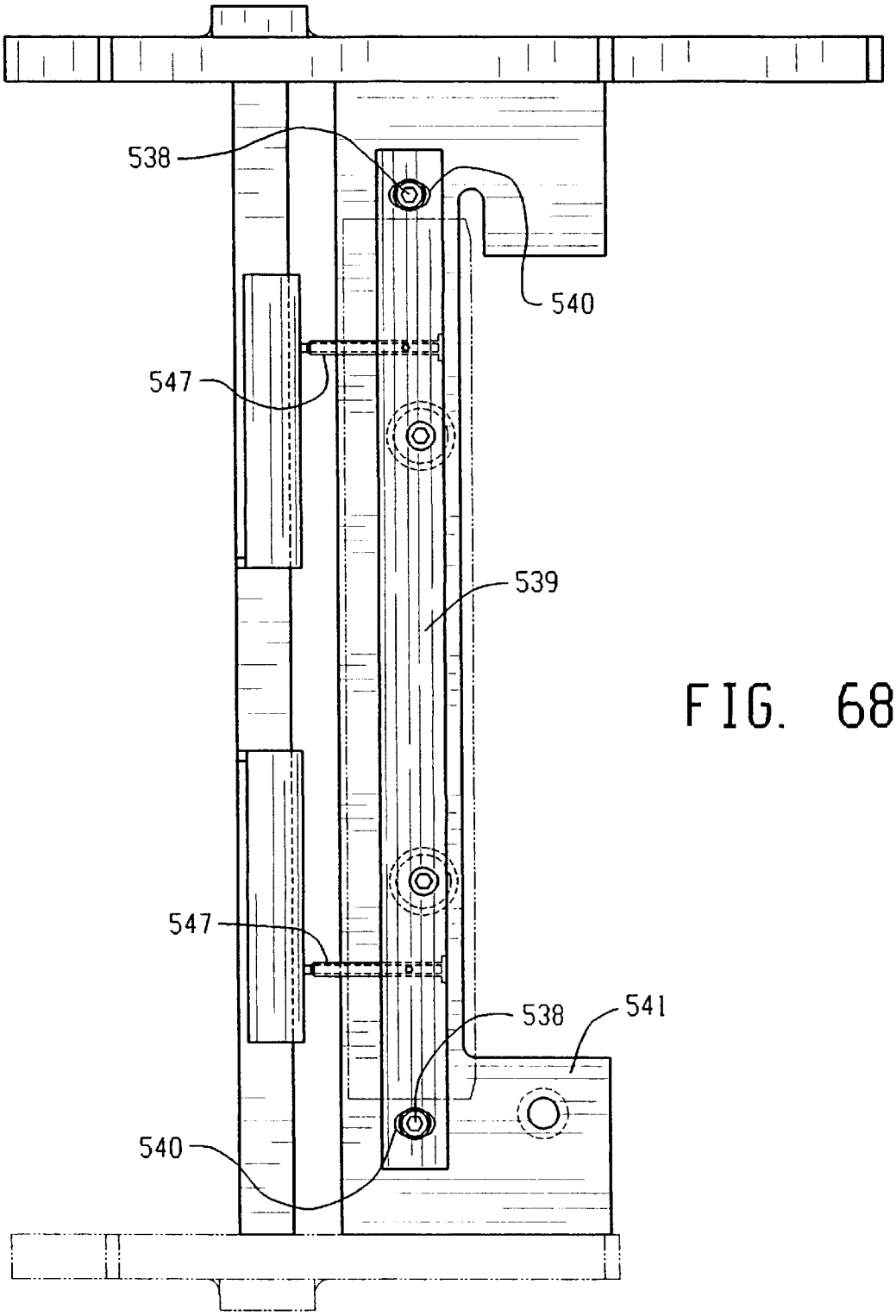
FIG. 68 is a cross-sectional view taken substantially along the line 68—68 of FIG. 67.

Regarding the blade assembly 535 and as further shown in FIGS. 67 and 68, mounting screws 538 for the blade clamp block 539 may be inserted from the top (as oriented in FIG. 62) through holes 540 in the ends of the stationary blade clamp block for securing the blade clamp block to the lower frame member 541 of the guide frame 542 (FIG. 62). This enables the mounting screws to be conveniently tightened or loosened from the top of the head unit after the head housing top cover (upper shell portion) 544 (FIG. 62) has been removed from the shell base 545. When the mounting screws 538 are loosened, adjustment screws 547 may be adjusted in or out to adjust the position and alignment of the stationary lower blade 548. To this end the holes 540 are elongated to permit forward or rearward adjustment of each end of the blade clamp block. Once adjusted, the mounting screws 538 may be tightened to secure the stationary blade in place. As will be appreciated, the adjustment screws 547 may be accessed from the front of the head unit. Also, the adjustment and mounting screws may be provided with Nylok nylon patches or other suitable means to lock the screws against loosening due to vibrations.

Another modification illustrated in FIG. 62 is the provision of shock absorbing bumpers 553 and 554 at respective ends of the stroke of the moving blade carriage 555. The bumpers may be O-rings made of a suitable elastomeric or other resilient or cushioning material. As shown, the O-rings are fitted on the ends of the guide posts 556. In FIG. 63, it can be seen that the blade carriage 555 may include sleeve bearings 558 that slide on the guide posts. Back in FIG. 62, it can be seen that the flapper door 560, also referred to as a chute cover, may be a single piece with and thus form one leaf of a hinge 561. The other leaf 562 of the hinge is attached to the head housing top cover 544 by suitable means and is connected to the chute cover/wing 560 by a hinge pin 563 or plural axially aligned hinge pins. As shown, the chute cover may be stepped at 565 to accommodate the outwardly offset peripheral lip 566 of the head housing top cover. The hinge connection is configured such that the chute cover cannot open beyond 90° from its closed position. This prevents the chute cover from being swung overcenter when the machine is supported in a vertical orientation with the head at the top, whereby gravity will always act to bias the chute cover to its closed position. As an alternative, the chute cover may be otherwise biased to its closed position, as by a spring or the like.

As shown in FIG. 62, the stop 570 (also referred to as a tension block) on each floating shaft adjustment screw 572 (above referred to as a tie member), may be provided with a nylon tipped set screw 573 that intersects the threaded bore in the tension block 570 for the tension adjustment screw. The nylon portion of the set screw 573 may be tightened into the threads of the tension adjustment screw to provide an anti-vibration lock. Also, the end of the slot 575 in each side frame member for the floating shaft 576 may be located such that it stops movement of the floating shaft towards the other shaft before the gear-like member of the floating shaft fully meshes with the other gear-like member. This prevents or minimizes wearing of the gear-like members when the gear-like members are rotated with no sheet-like stock material therebetween, as during loading of the machine or when a supply of stock material runs out.

FIGS. 62 and 63 also show a different mounting arrangement for the interlock switch 580, which is adapted to accommodate downward placement of the former housing cover 581 onto the former housing base 515. In this arrangement, the switch is oriented to receive and be actuated by a vertically oriented key 583 which is mounted to the former housing cover as illustrated.

Figure 69:
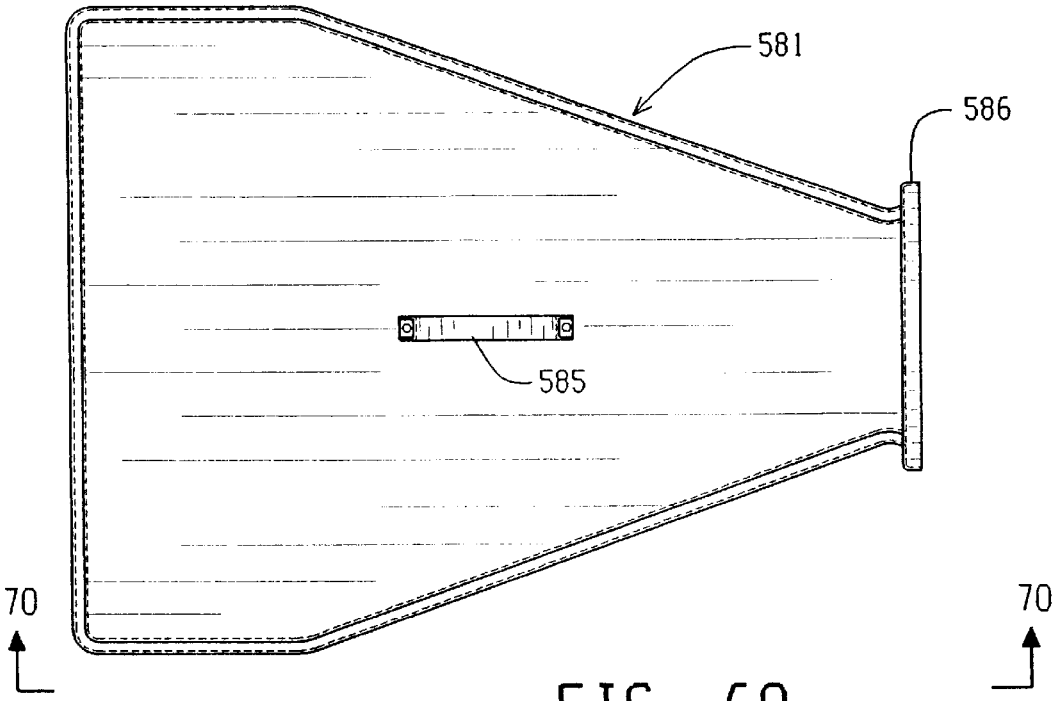
FIG. 69 is a top plan view of the cover of the former unit of the machine of FIG. 62.
Figure 70:
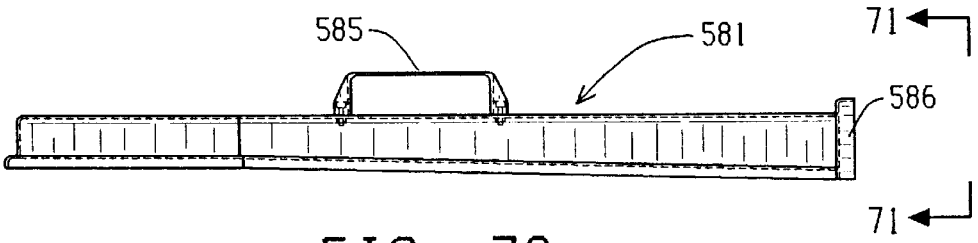
FIG. 70 is a side elevational view of the cover of FIG. 69 looking from the line 70—70.
Figure 71:
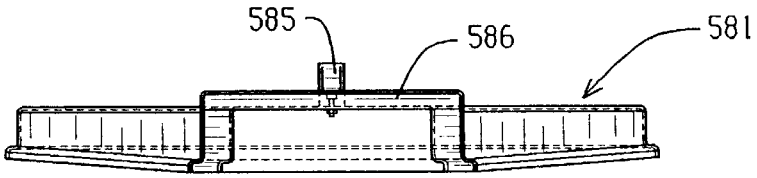
FIG. 71 is an end view of the cover of FIG. 69 looking from the line 71—71 of FIG. 70.

The former housing cover 581 is more fully shown in FIGS. 69–71. As illustrated, the former housing cover may be provided with a generally centrally located handle 585 to facilitate lifting of the cover. The cover also has a belled forward edge portion 586 which aligns with a continuation thereof at the rear of the head housing base 545 (FIG. 63).

Figure 64:
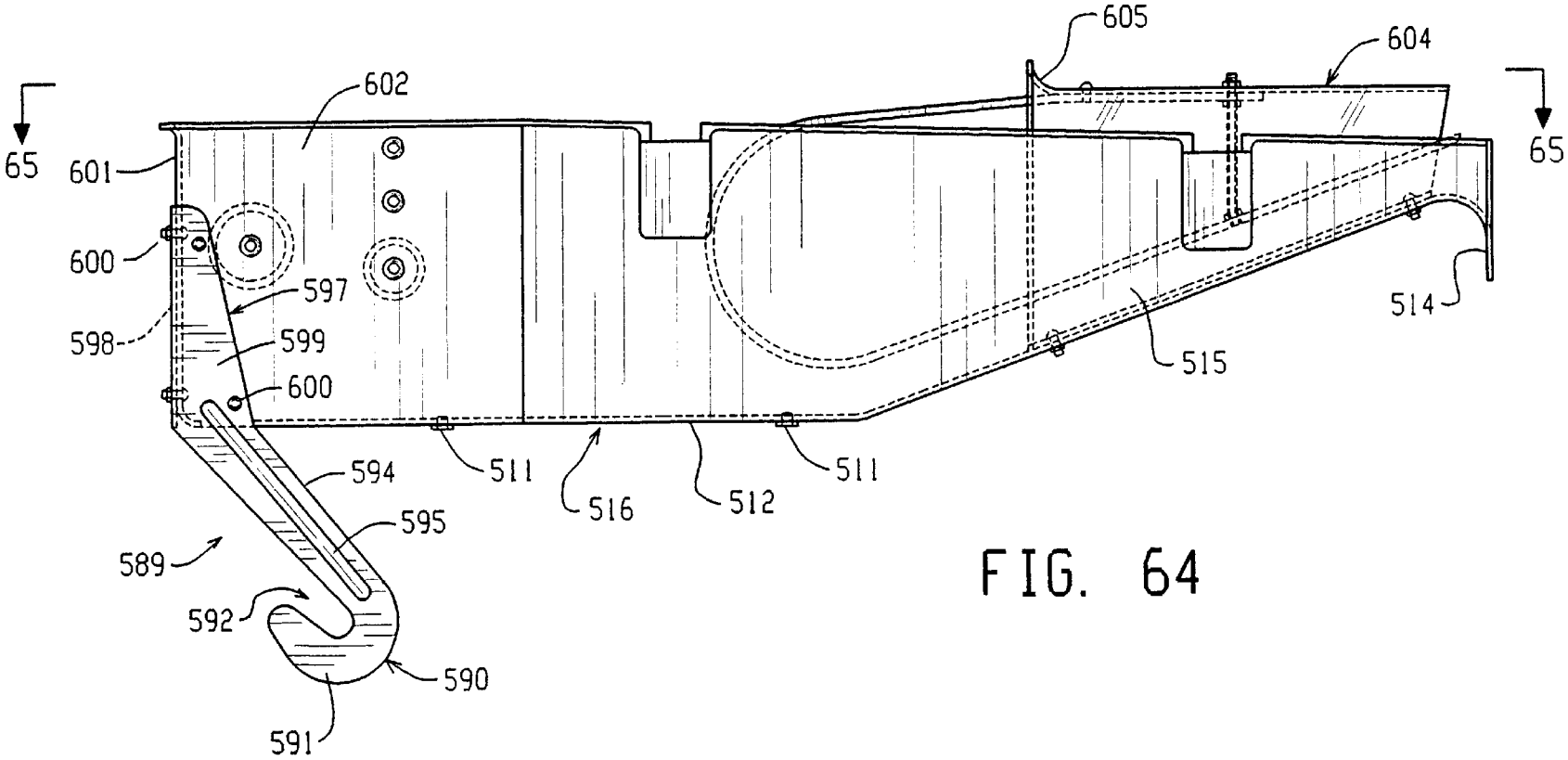
FIG. 64 is a side elevational view of the former unit of the machine of FIG. 62, with the cover removed.
Figure 65:
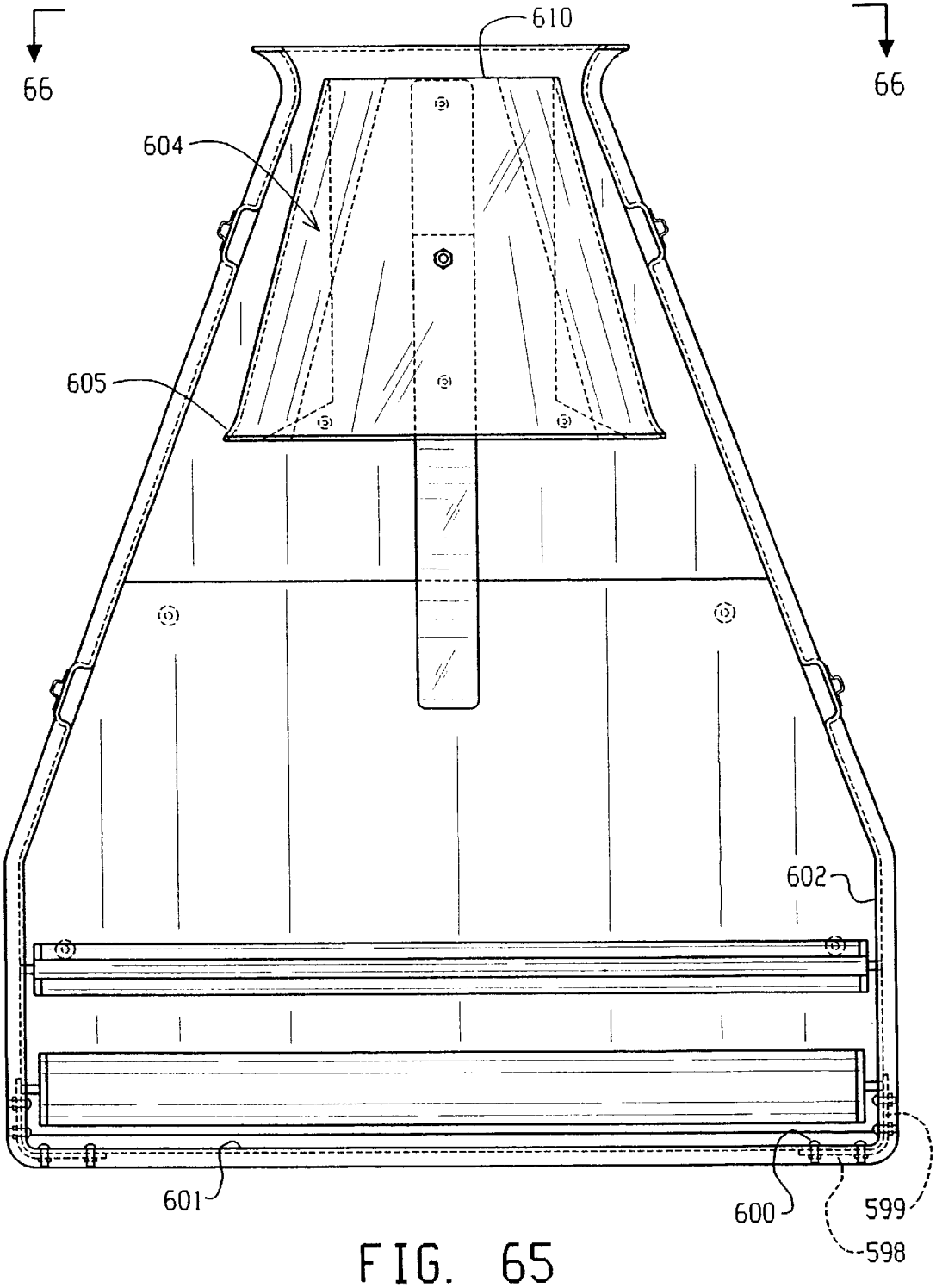
FIG. 65 is a plan view of the former unit, cover removed, looking from the line 65—65 of FIG. 64.
Figure 66:
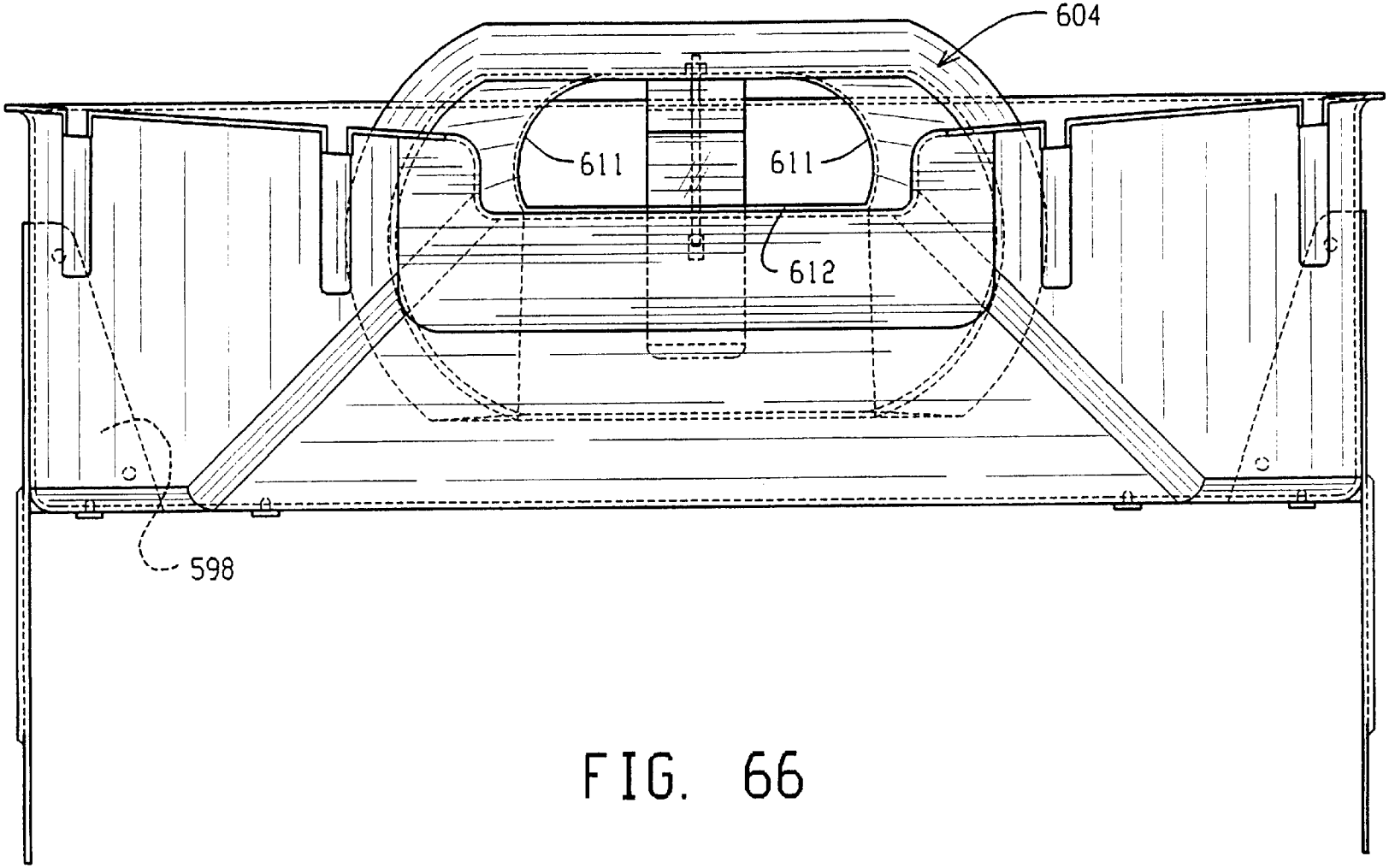
FIG. 66 is an end view of the former unit, cover removed, looking from the line 66—66 of FIG. 65.

Referring to FIGS. 64–65, a modified stock roll holder arrangement is illustrated at 589. The stock roll holder arrangement includes a pair of laterally spaced apart mounts 590 in the form of brackets for supporting the stock roll. The brackets each have a J-shape lower end portion 591 that forms an upwardly opening, preferably inclined, slot 592 for nested receipt of the ends of a stock roll holder (such as a bar or a holder as described in copending application Ser. No. 08/267,960 filed Jun. 29, 1994) on which a stock roll may be centrally supported for rotation so that the stock material may be payed off of the stock roll for passage through the machine. The stem 594 of the J-shape lower end portion of each bracket may be provided with a longitudinally extending rib or boss 595 for added rigidity against lateral flexure.

The upper portion 597 of each stock roll bracket 590 is generally L-shape and configured for attachment to the former shell base 515 at a respective corner thereof preferably in wrap-around fashion. The legs 598 and 599 of the L are secured by suitable means such as fasteners 600 respectively to the back wall 601 and respective side wall 602 of the former shell base. As will be appreciated, the L-shape upper portions of the brackets rigidify and strengthen or reinforce the corners of the former shell base for supporting the weight of a stock roll supported therefrom, as well as any shock or other forces that may occur during loading of stock roll onto the brackets. As above indicated, the former shell may be made of plastic, and the brackets enable the plastic shell to carry loads greater than what it may otherwise be able to carry.

FIGS. 64 and 65 illustrate another modification. As is preferred, the inlet end of the shaping or forming chute 604 is outwardly flared in trumpet-like fashion at 605. This facilitates the passage of the sheet-like stock material into the shaping chute. It also prevents any tears along the edge of the sheet-like stock material from catching against the leading edge of the shaping chute, as might otherwise result in further tearing of the stock material. As further seen in FIGS. 65 and 66, the exit end 610 of the shaping chute may have the side walls 611 thereof rounded inwardly at their junction with the bottom wall 612 of the shaping chute.

Referring now to FIGS. 72–75, it will be seen that a blade stop assembly 620 may be provided to lock the moving blade carriage 555 in its raised or open position, as may be desired during transport or otherwise. The blade stop assembly includes a stop member 622, here in the form of a stop pin that is movable between (i) an enabling position which permits movement of the moving blade from its feed position to its cutting position and (ii) a disabling position which prevents such movement.

In the illustrated embodiment, the stop pin 622 is guided for longitudinal movement by a pin housing 624 secured to the side frame plate 523 at an opening therein outwardly adjacent the movement path of the relatively adjacent crank 625, also referred to as lift lever. At its inner end the stop pin is provided with a transversely extending latch pin 627. The latch pin is selectively engageable in either one of two slots 628 and 629 provided in the inner end of the housing. The slots, which intersect at right angles, have different axial depths to define two axially displaced positions of the stop pin respectively corresponding to the enabling and disabling positions of the stop pin.

At its outer end the stop pin 622 has a knob 632 or other suitable device for facilitating manipulation of the stop pin between its enabling and disabling positions. Interposed between the knob and the housing is a spring 633 or other biasing element for biasing the stop pin axially outwardly. The axially outermost position, and thus the enabling position, of the stop pin is determined by engagement of the latch pin 627 in the deeper slot 628 in the end of the housing 624, whereas the axially innermost position, and thus the disabling position, of the stop pin is determined by engagement of the latch pin in the shallower slot 629 in the end of the housing. The stop pin may be moved from one position to the other by pushing the knob 632 inwardly against the spring biasing force sufficiently to move the latch pin axially out of the slot in which it previously was engaged, after which the knob may then be turned 90° to align the latch pin with the other slot. The knob may then be released to allow the biasing force of the spring 633 to move the stop pin outwardly until the latch pin engages the bottom of the other slot.

Figure 72:
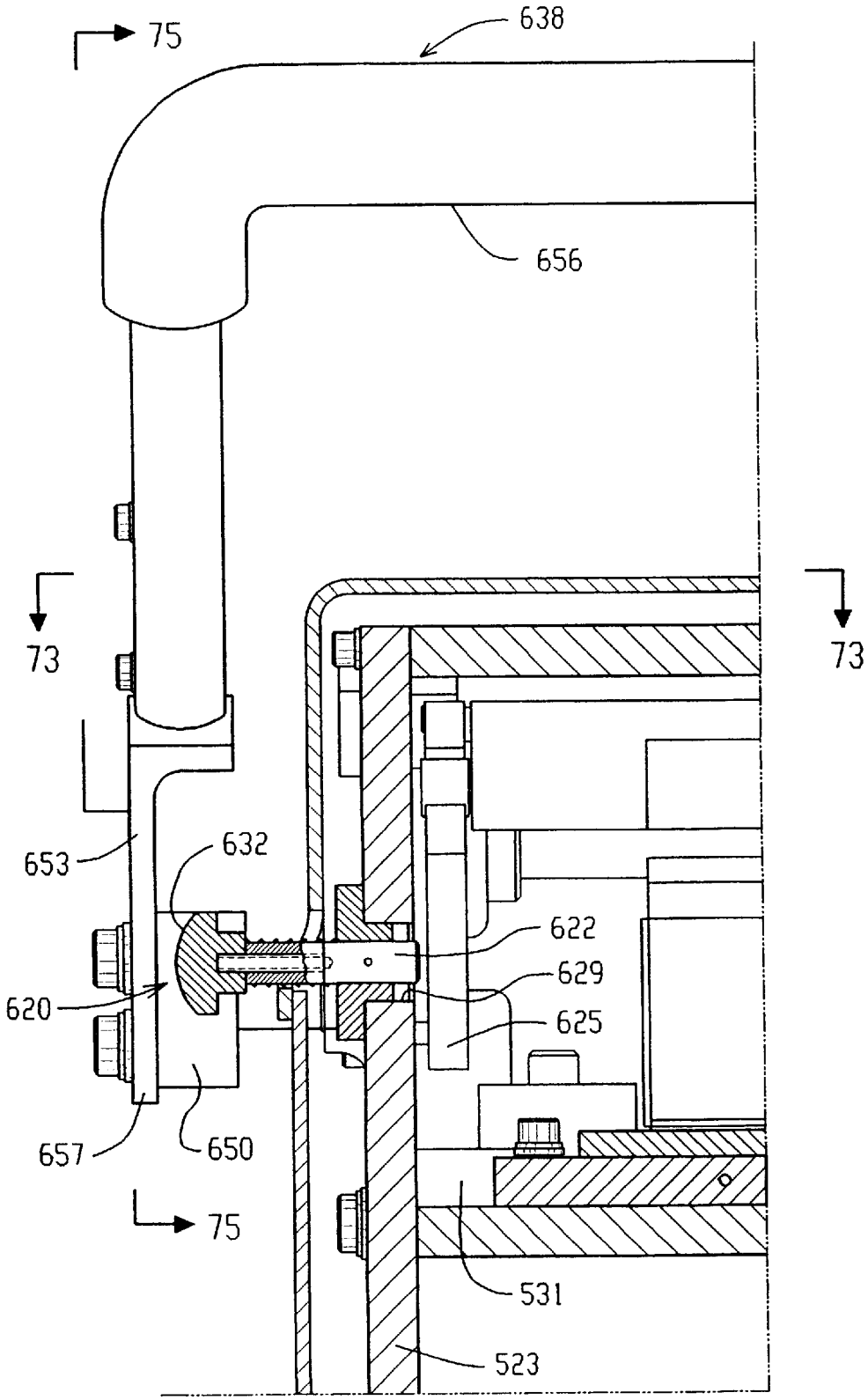
FIG. 72 is a fragmentary cross-sectional view of the head unit of the machine of FIG. 62, taken substantially along the line 72—72 of FIG. 63 and with further parts of the head unit being illustrated.
Figure 73:
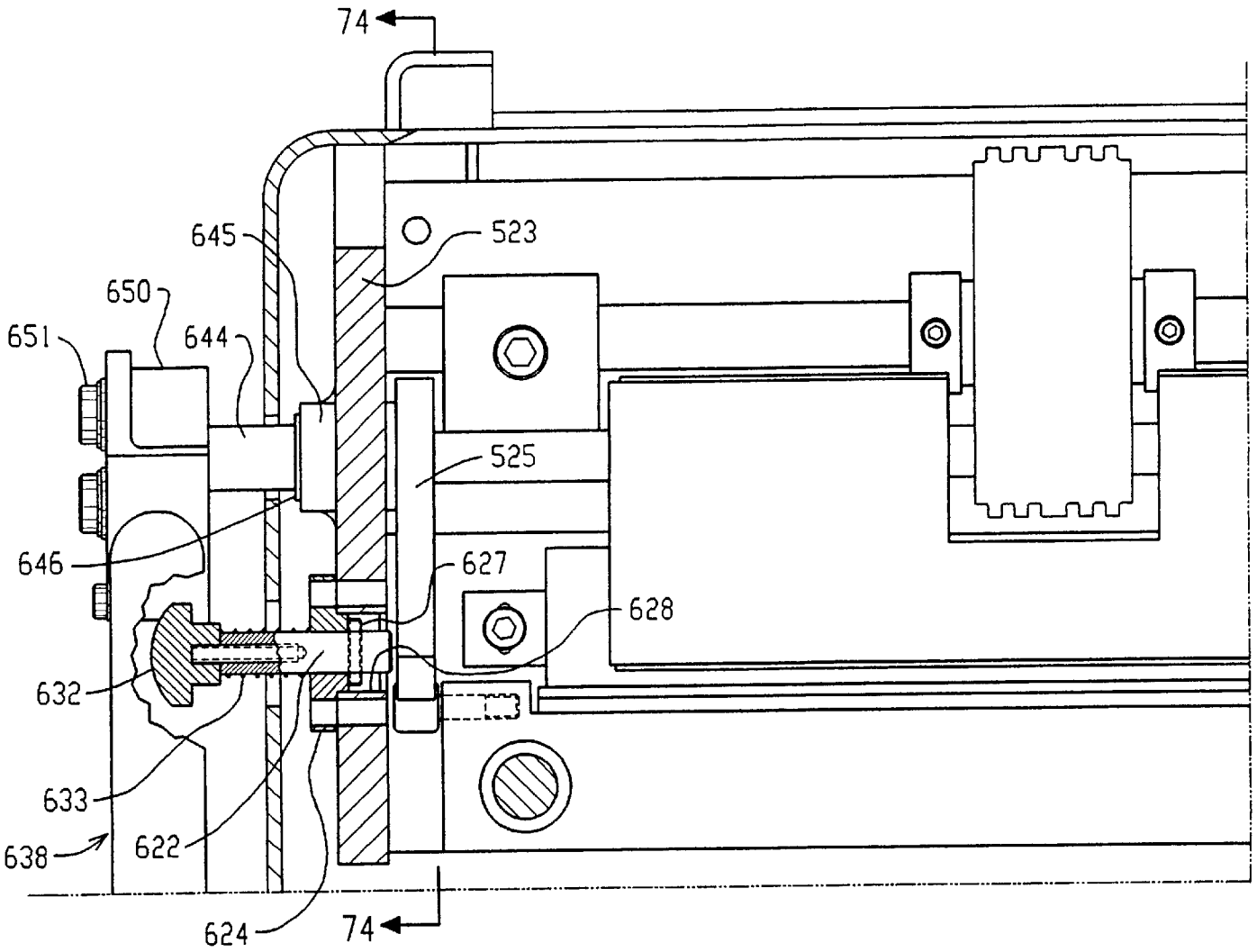
FIG. 73 is a fragmentary view taken substantially along the line 73—73 of FIG. 72, with parts broken away and shown in cross-section.

When the stop pin 622 is in its enabling (or ambush) position as shown, the inner end of the stop pin will be to one side of the movement path of the relatively adjacent lift lever 625 as shown in FIGS. 72 and 73. Consequently, the lift lever is free to move between its feed and cutting positions for normal operation of the machine. However, when the stop pin is in its disabling (or blocking) position, the inner end of the stop pin will be located in the movement path of the lift lever and thus will block movement of the lift lever towards its cutting position. Preferably, the stop pin is positioned such that the lift lever will be held in the intermediate position to which it is urged by the above described spring loaded detent mechanism 393 (FIG. 39) so that the actuating switch will not be held in an energized position. In the illustrated embodiment the stop pin is so positioned that it may also be used alternatively to hold the blade assembly in its closed or cutting position. That is, the handle may be moved to close the blade assembly and then the stop pin engaged behind (instead of in front of) the lift lever to prevent its moving back to its open position.

As will be appreciated, the blade stop assembly 620 may be otherwise positioned in the machine to accomplish the same result, such as by positioning the stop assembly such that it acts on the moving blade carriage 555, the handle 638 or other moving member of the cutting assembly or operating assembly therefor. Also, other arrangements may be used, for example, to provide plural stop surfaces spaced apart along the axis of the stop pin or other member, and to provide the pin with a transaxially extending abutment surface selectively engageable with the stop surfaces for defining plural axially displaced positions of the pin, with at least one of the positions corresponding to the enabling position of said stop pin (or other member) and another of the positions corresponding to the disabling position of the stop pin.

In FIGS. 72 and 73, a further modification is illustrated. As shown, the cross frame member 531 may be configured and positioned to allow the lift levers 625 and pivot or crank shafts 644 to which they are attached to be axially withdrawn inwardly and clear of the shaft bushings or bearings 645 therefor in the side frame members 523, 524. This is desirable to facilitate repair or replacement of the lift levers. Also, the frame components do not have to be disassembled to remove the lift levers, so that the parallelism of the side plates will not be destroyed by repairs in the field. When assembled to the side frame members, the lift levers and attached crank shafts are held axially in place by snap rings 646. The ends of the crank shafts extend outwardly and through an opening in the side wall of the outer shell of the head unit for attachment thereto of the handle 638.

Figure 75:
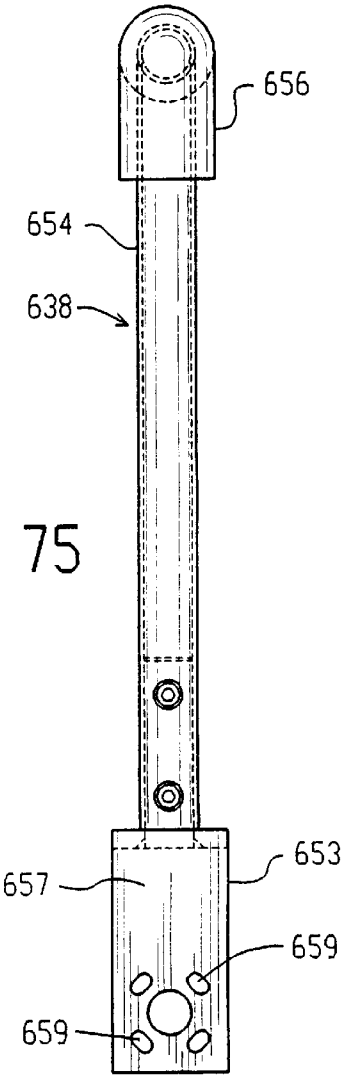
FIG. 75 is a side elevational view of the operating handle of the machine looking from the line 75—75 of FIG. 72.
Figure 74:
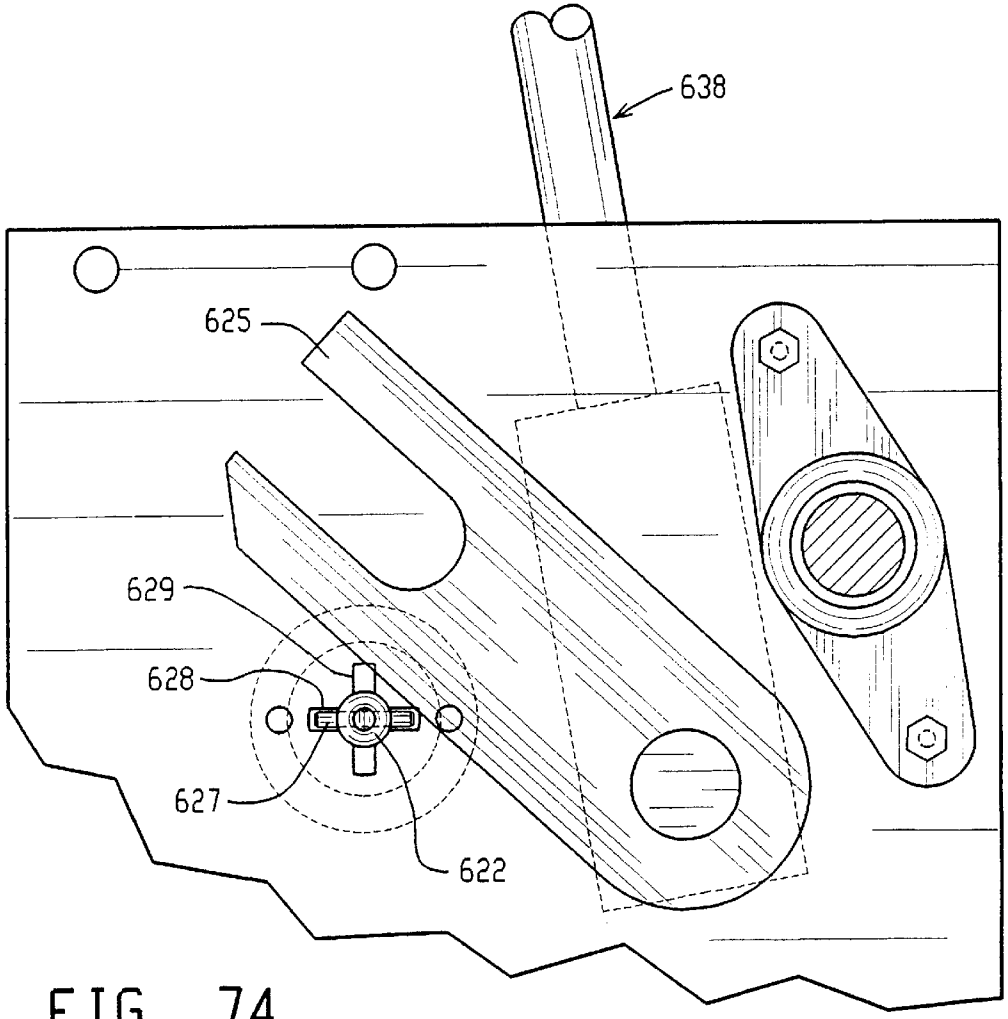
FIG. 74 is a fragmentary cross-sectional view taken substantially along the line 74—74 of FIG. 73.

For mounting the ends of the handle 638 to the crank shafts 644, mounting blocks 650 are keyed and/or pinned to the outer ends of the crank shafts. The mounting blocks each have a symmetric arrangement of threaded holes for receiving respective screw fasteners 651 used to secure a respective handle mount 653 at an end of the handle to the mounting block. In the illustrated embodiment, the handle includes a U-shape tubular member 654 which has the base or bight portion thereof surrounded by a tubular handle grip 656 of foam rubber or the like. Telescoped into the ends of the tubular member are the cylindrical ends of the handle mounts 653. The other ends of the handle mounts form flat mounting ears or lugs 657 that are provided with apertures 659 (FIG. 75) corresponding to the holes in the mounting blocks. Preferably, provision is made for rotational adjustment of the handle ends relative to the respective lift levers to adjust for manufacturing tolerances so that the lift livers may be brought into precise parallel alignment. To this end, the apertures 659 are circumferentially elongated as shown in FIG. 75 to provide for such rotational adjustment.

During assembly, the handle 638 may be assembled to the mounting blocks 650 by the fasteners 651. The lift levers 625 may then be precisely positioned in parallel relationship with the circumferentially elongated apertures 659 allowing for rotational adjustment of the lift levers relative to the handle ends. Once adjusted, the fasteners 651 may be tightened to secure the adjusted relationship between the lift levers and handle.

Figure 77:
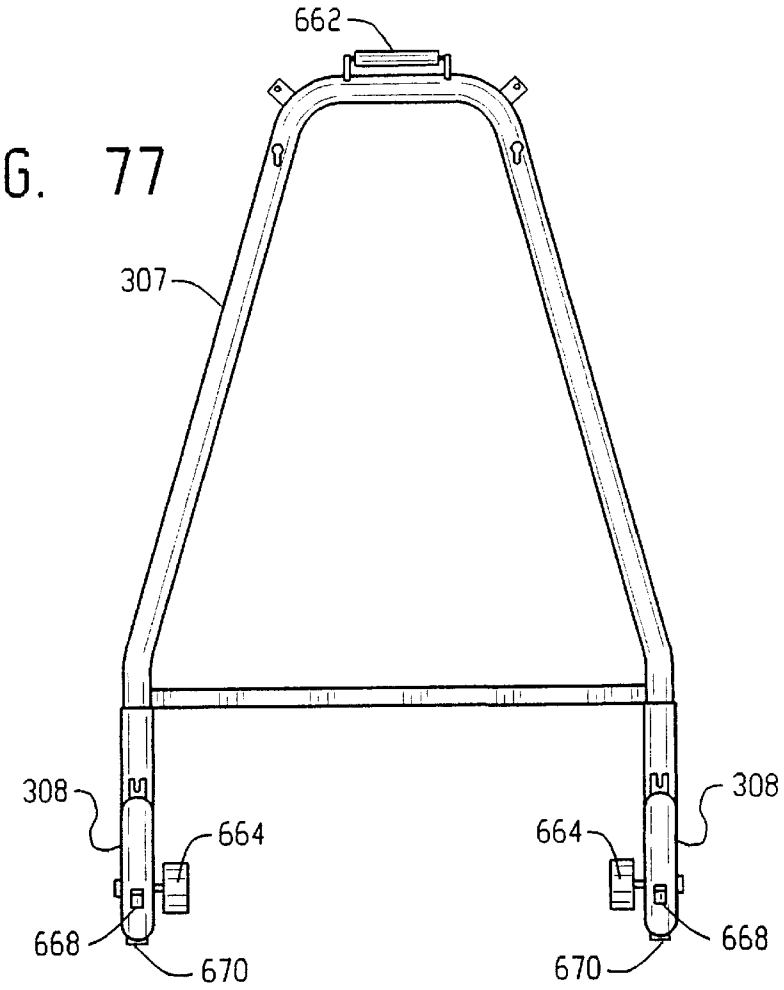
FIG. 77 is an elevational view of the stand alone looking from the line 77—77 of FIG. 76.
Figure 76:
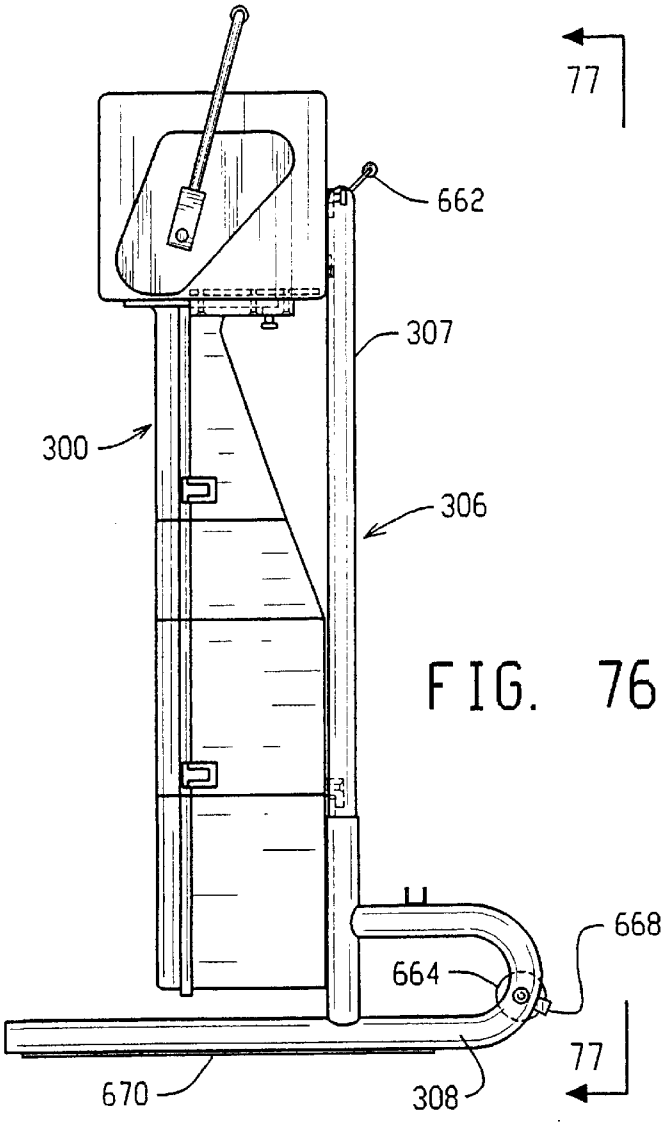
FIG. 76 is a side elevational view showing the machine assembled to a modified stand.

Referring now to FIGS. 76 and 77, additions to the stand 306 for the cushioning conversion machine 300 are illustrated. As shown, the stand 306 may be provided at its upper end with a handle 662 and at its lower end with one or more rollers or wheels 664 to facilitate movement of the machine from place to place. As will be appreciated, the handle, which is attached to the upper end of the stand's upright frame 307, may be grasped and pulled to the right in FIG. 76 to rock the machine and stand clockwise with the rounded end of the stand's feet 308 functioning as a fulcrum with the floor or other horizontal surface on which the stand is supported. As is preferred, the rollers 664 are upwardly and horizontally offset from the bottom surface of the stand such that they will engage the floor when the machine has been rotated preferably through about 30° to about 35° from vertical. In addition, it is desirable that at such point of engagement the center of gravity of the machine and stand will not have rotated more than about 20° beyond a vertical plane intersecting the fulcrum point and more preferably not beyond 10°, whereby upon engagement of the roller with the horizontal surface the machine and stand may be easily rolled along the horizontal surface. This arrangement minimizes the amount of weight that must be supported at the handle during movement as the machine is rolled from place to place.

There may also be provided a stop bumper 668 to limit tilting of the machine to a prescribed amount. For example, the stop bumper may be positioned to prevent the center of gravity of the machine and stand from moving overcenter with respect to the rollers 664 or to limit overcenter tilting with respect to the roller axis to within 20°, more preferably within 10° and still more preferably within 5°. Moreover, the stop bumper should be positioned such that it will engage the floor and thus stop further rotation prior to the center of gravity of the machine and stand having moved through a vertical plane intersecting the point of engagement of the stop bumper with the floor, thereby to prevent the machine and stand from falling over once the bumper has engaged the floor, even if the stand handle 662 is released by the attendant. The feet of the stand may also have anti-skid devices, such as rubber strips 670, provided on the undersides thereof.

Figure 79:
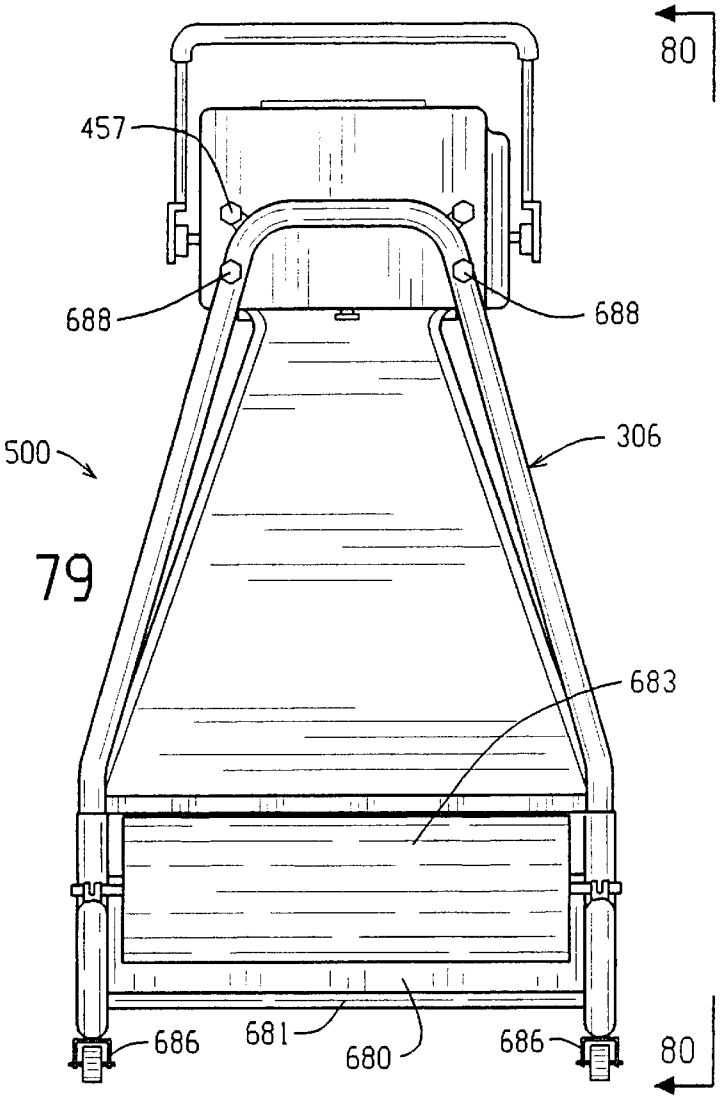
FIG. 79 is an elevational view of the machine of FIG. 78 looking from the line 79—79.
Figure 78:
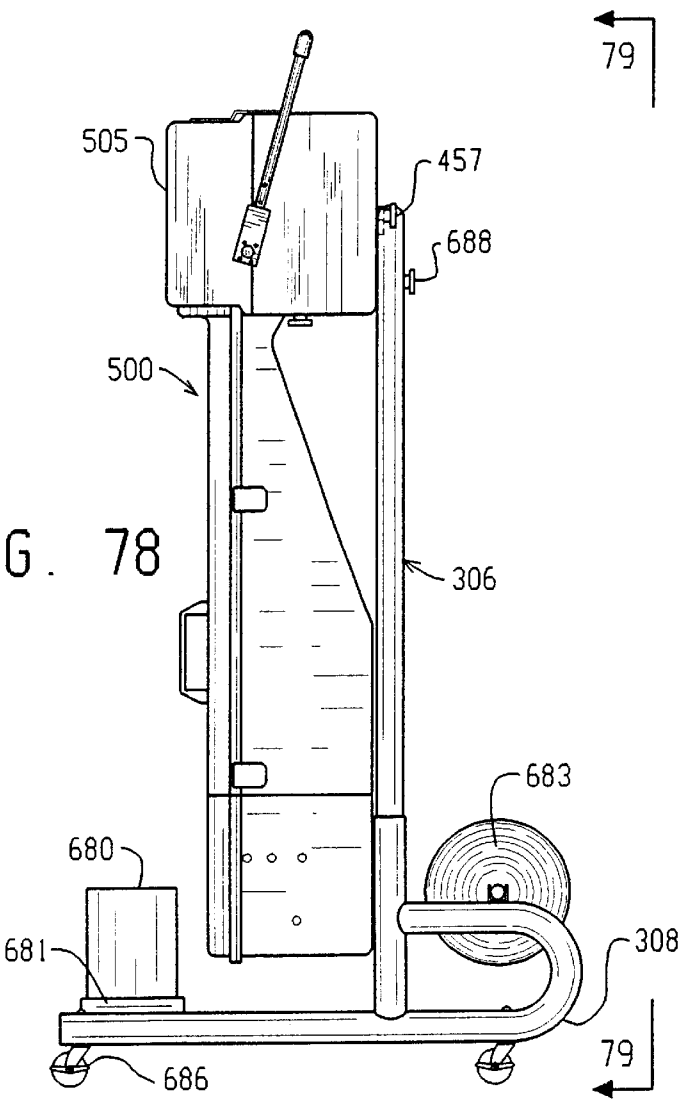
FIG. 78 is a side elevational view of yet another embodiment of cushioning conversion machine supported by a stand in a vertical orientation.
Figure 80:
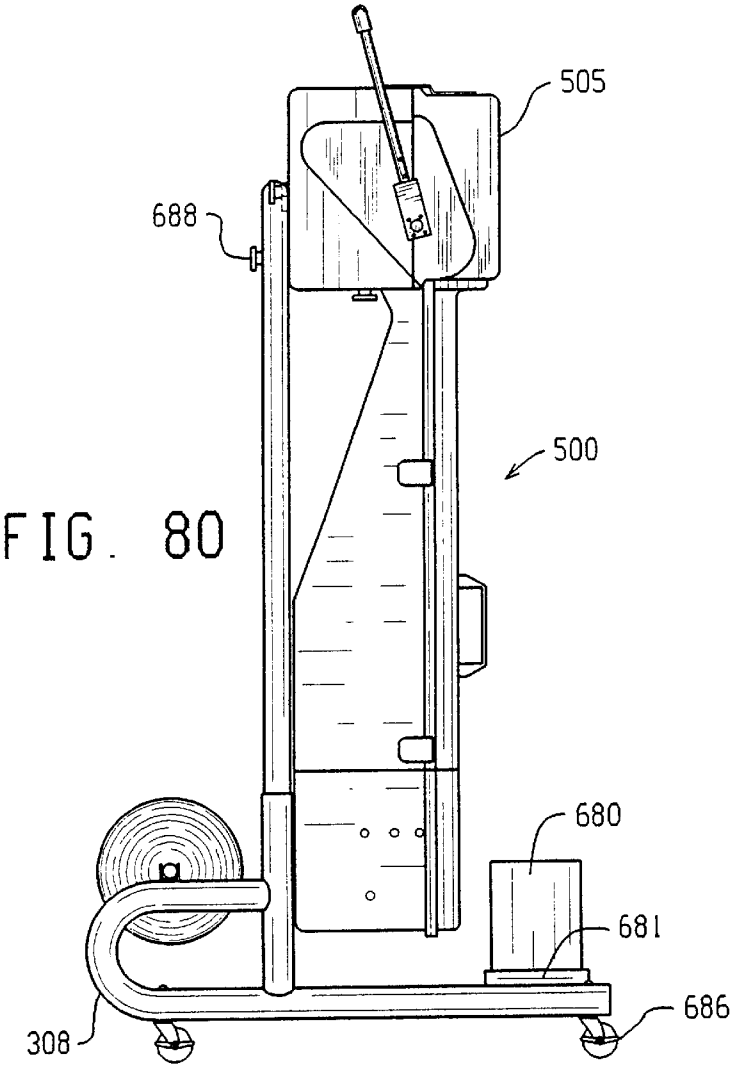
FIG. 80 is an elevational view of the machine of FIG. 78 looking from the line 80—80 of FIG. 79.

Referring now FIGS. 78–80, further modifications of a cushioning conversion machine according to the invention are illustrated. For usage of the machine 500 where it cannot be readily connected to an external source of electrical power, the normally used AC motor may be replaced by a DC motor that may be powered by a battery 680 housed in or carried by the machine, or provided as a separate battery pack that may be positioned adjacent the machine. In the particular embodiment shown in FIGS. 78–80, the battery 680 (which for example may be a bank of one or more rechargeable lead-acid batteries) is supported on a battery holder 681. The illustrated battery holder is a tray that spans and has the ends thereof supported on the portions of the feet 308 of the stand 306 that project beyond the machine opposite the end of the feet that support the stock roll 683. The battery may be connected by suitable wiring (not shown) to the motor in the head unit 505, as by a wiring harness running along the outside or through the tubular components from which the stand is formed. A harness connector may be provided at the separation point between the upright portion of the stand and either or both of the feet depending on the wiring route to facilitate assembly and disassembly of the stand in the aforedescribed manner. The ends of the wiring harness may also terminate at electrical connectors for quick connection to a connector to which the motor leads are connected and to a connector to which the battery leads are connected. The machine assembly may also be provided with a battery charger that may be conveniently supported on the battery tray along with the battery or batteries. It also is noted that other types of motors may be used to drive the gear-like members, such as, by way of further example, a fluid motor. For a fluid motor, a power storage device may include a compressed air tank instead of the battery. The compressed air tank may be easily mounted on the feet of the stand at the location of the illustrated battery holder. Also, other transportable power sources for the motor may be used. For example, the machine may be powered by a vehicle's battery and/or electrical system. The battery's may also have associated therewith a solar panel or panels for recharging the battery.

As shown in FIGS. 78–80, the stand 306 may be supported for rolling on a floor surface by casters 686 or the like, and preferably by locking casters. As illustrated, each foot has a caster 686 attached to the toe and heel thereof for four-point rolling support of the stand and the machine supported thereon. As a further modification, the above described catches 422 and keyholes 424 may be replaced by thumb screws 688 that pass through holes in the frame portion of the support stand for securement in threaded holes in the front unit, as in a manner similar to the thumb screws 457 which extend through the attachment ears on the support stand.

Figure 81:
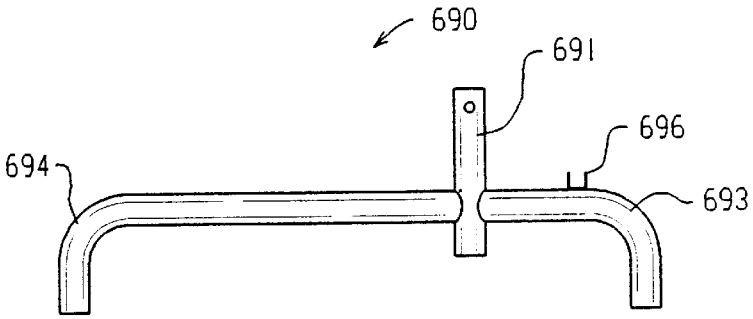
FIG. 81 is a side elevational view of another form of foot for the stand shown in FIG. 78.

Referring now to FIG. 81, another form of stand foot is illustrated. The stand foot 690 includes a vertical tube 691 into or over which a leg of the upper frame may be telescoped. The vertical tube is secured at its lower end, as by welding, to the ends of the longer legs of oppositely extending L-shape members 993 and 694. The other or shorter legs of the members 693 and 694 turn downwardly from the longer legs for resting atop a floor to provide a broad-base support for the stand. The members 693 and 694 may be tubular and casters may be attached to the ends thereof for rolling of the stand from location to location. For a stationary installation, the ends of the members 693 and 694 may have rubber feet or other anti-skid means secured thereto to prevent the stand from skidding across a floor. The foot also includes a cradle 696 for receiving an end of a stock roller holder. As will be appreciated, the foot may be used with another such foot in place of the aforedescribed feet of the machine stand.

Cushioning conversion machines according to the present invention provide for production of a low density cushioning product. It has been found that a pad produced in a cushioning conversion machine according to the present invention using 27 inch wide stock material composed of three plies of 30 pound recycled APC Kraft paper has the following properties:

Height 2.12 inch

Width 7.62 inch

Yield 46.24 $ft^3$/450 foot roll

Density 0.67 $lbs/ft^3$

Crimp Loss 8.33%

Accordingly, there is provided a dunnage strip having a height of about 2 to 2.25 inches, a width of about 7.5 to 8 inches, and a density of about 0.64 to 0.7 $lbs/ft^3$ using three 27 inch wide plies of 30 pound Kraft paper.

While a particular feature of the invention may have been described above with respect to only one of the illustrated embodiments, such feature may be combined with one or more other features of the other embodiments, as may be desired and advantageous for any given or particular application.

Although the invention has been shown and described with respect to several preferred embodiments, it will be apparent that equivalent alterations and modifications will occur to others skilled in the art upon the reading and understanding of this specification. Therefore, the present invention includes all such equivalent alterations and modifications.

What is claimed is:

1. A method of making a cushioning product from stock material, said method comprising the steps of:

supplying a stock material;

providing a cushioning conversion machine comprising a housing, a conversion assembly which converts the stock material into a three-dimensional strip of dunnage and, a stock supply assembly, positioned upstream of the conversion assembly, which supplies the stock material to the conversion assembly wherein the conversion assembly includes a forming assembly which forms the stock material and a manual feed assembly, positioned downstream of the stock supply assembly, which feeds the stock material to the forming assembly, wherein the manual feed assembly includes at least one rotatable member for advancing the stock material and an operator member mechanically coupled to the rotatable member to rotate the rotatable member upon movement of the operator member wherein the rotating member is positioned within the housing and the operator member extends outside the housing;

loading the stock material onto the stock supply assembly; and manually powering the manual feed assembly to feed the stock material to the conversion assembly thereby converting the stock material into a three-dimensional strip of dunnage to form a cushioning product;

said manually powering step including the step of moving the operator member without opening the housing.

2. A method as set forth in claim 1 wherein said supplying step includes supplying stock material that is biodegradable, recyclable, and reusable.

3. A method as set forth in claim 1 wherein said supplying step includes supplying stock material that comprises multiple plies of Kraft paper.

4. A method as set forth in claim 3 wherein said supplying step includes supplying stock material that comprises multiple plies of Kraft paper.

5. A method as set forth in claim 4 wherein said supplying step includes supplying stock material that comprises a roll of two or three superimposed plies of Kraft paper.

6. A method as set forth in claim 5 wherein said supplying step comprises supplying stock material that has a width of approximately 27 inches.

7. A cushioning conversion machine for converting stock material into a relatively low density cushioning dunnage product, comprising a housing, a shaping member over which the stock material is drawn to form the stock material into a three-dimensional shape, and a feed mechanism for drawing the stock material over the shaping member, said feed mechanism including at least one rotatable member for engaging and advancing the stock material, and an operator member mounted for reciprocating movement and mechanically connected to said rotatable member to rotate said rotatable member during movement of said operator member from a first position to a second position and not during return movement of the operator member from said second position to said first position, wherein the rotatable member is positioned within the housing and the operator member extends outside of the housing for movement between the first and second positions without opening the housing.

8. A cushioning conversion machine as set forth in claim 7, including a one-way clutch device connecting said operator member to said rotatable member.

9. A cushioning conversion machine as set forth in claim 8, wherein said operator member includes a handle mounted for back and forth swinging movement.

10. A cushioning conversion machine as set forth in claim 7, further comprising a cutting assembly for cutting the cushioning dunnage product into cut sections, said cutting assembly including a pair of relatively movable blades, and said operator member being movable from said first position away from said second position to a third position to move said blades together and from said third position to said second position to move said blades apart.

11. A cushioning conversion machine as set forth in claim 7, including a first gear connected to said one rotatable member and a second gear connected to said operator member, said second gear having a toothed segment for meshing with said first gear during movement of said operator between said first and second positions and an untoothed segment for passing over the teeth of said first gear during movement of said operator member between said first and third positions.

12. A cushioning conversion machine as set forth in claim 11, including a one-way clutch device connecting said first gear to said rotatable member.

13. A cushioning conversion machine for converting stock material into a cushioning product, the machine comprising:

a housing;

a conversion assembly which converts the stock material into a three-dimensional strip of dunnage; and a stock supply assembly, positioned upstream of the conversion assembly, which supplies the stock material to the conversion assembly;

wherein the conversion assembly includes a forming assembly which forms the stock material and a manual feed assembly, positioned downstream of the stock supply assembly, which feeds the stock material to the forming assembly;

wherein the manual feed assembly includes at least one rotatable member for advancing the stock material and an operator member mechanically coupled to the rotatable member to rotate the rotatable member upon movement of the operator member;

wherein the rotating member is positioned within the housing and the operator member extends outside the housing for access without opening the housing.

14. A cushioning conversion machine as set forth in claim 13 wherein the operator member rotates the rotatable member during movement of the operator member from a first position to a second position.

15. A cushioning conversion machine as set forth in claim 14 wherein the rotatable member does not rotate during return movement of the operator member from the second position to the first position.

* * * * *